US007187892B2

(12) United States Patent
Horike et al.

(10) Patent No.: US 7,187,892 B2
(45) Date of Patent: Mar. 6, 2007

(54) TONER TRANSPORT DEVICE FOR IMAGE-FORMING DEVICE

(75) Inventors: Masanori Horike, Kanagawa (JP); Yoichiro Miyaguchi, Kanagawa (JP); Nobuaki Kondoh, Kanagawa (JP); Katsuo Sakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 169 days.

(21) Appl. No.: 10/863,294

(22) Filed: Jun. 9, 2004

(65) Prior Publication Data

US 2005/0025525 A1 Feb. 3, 2005

(30) Foreign Application Priority Data

Jul. 31, 2003 (JP) ..... 2003-204291
Mar. 2, 2004 (JP) ..... 2004-057195

(51) Int. Cl.
*G03G 15/08* (2006.01)

(52) U.S. Cl. ..... 399/252; 399/254

(58) Field of Classification Search ..... 399/252, 399/253, 254, 256, 289, 258
See application file for complete search history.

(56) References Cited

U.S. PATENT DOCUMENTS 3,677,751 A 7/1972 Ohta et al.
4,045,134 A 8/1977 Suzuki et al.
4,173,402 A 11/1979 Horike et al.
4,178,595 A 12/1979 Jinnai et al.
4,189,224 A 2/1980 Sakai
4,217,595 A 8/1980 Horike et al.
4,228,440 A 10/1980 Horike et al.
4,231,047 A 10/1980 Iwasaki et al.
4,231,048 A 10/1980 Horike et al.
4,250,239 A 2/1981 Sakai
4,281,051 A 7/1981 Sakai
4,281,332 A 7/1981 Horike
4,286,273 A 8/1981 Horike
4,288,797 A 9/1981 Horike et al.
4,293,865 A 10/1981 Jinnai et al.
4,310,610 A 1/1982 Sakai
4,310,846 A 1/1982 Horike
4,313,123 A 1/1982 Jinnai et al.
4,335,194 A 6/1982 Sakai (Continued)

FOREIGN PATENT DOCUMENTS

JP 04335369 A * 11/1992

OTHER PUBLICATIONS

U.S. Appl. No. 11/370,057, filed Mar. 8, 2006, Yamada et al.

(Continued)

*Primary Examiner*—David M. Gray
*Assistant Examiner*—Erika J. Villaluna
(74) *Attorney, Agent, or Firm*—Oblon, Spivak, McClelland, Maier & Neustadt, P.C.

(57) ABSTRACT

An image-forming device that is capable of minimizing toner charge deficiency while feeding an adequate amount of toner to an electrostatic toner transport substrate for transporting toner by an EH effect, having a first storage chamber for storing a mixture of toner and a friction-promoting substance; a second storage chamber; a first transport screw for stirring the mixture in the containers; a second transport screw; and a mesh provided to the first storage chamber; wherein a toner feeding unit is provided for sifting the toner in the mixture in the first storage chamber through the mesh and feeding the toner to a first electrostatic toner transport substrate (not pictured). A potential difference generator is also provided for creating an electrical potential difference between the first transport screw and the mesh, and between the mesh and the first electrostatic toner transport substrate.

51 Claims, 30 Drawing Sheets

U.S. PATENT DOCUMENTS 4,364,060 A 12/1982 Jinnai et al.
4,364,061 A 12/1982 Horike et al.
4,365,255 A 12/1982 Horike et al.
4,370,664 A 1/1983 Horike et al.
4,384,033 A 5/1983 Sakai
4,393,385 A 7/1983 Jinnai et al.
4,395,717 A 7/1983 Horike et al.
4,400,705 A 8/1983 Horike
4,407,917 A 10/1983 Sakai
4,418,352 A 11/1983 Horike et al.
4,426,652 A 1/1984 Horike et al.
4,434,428 A 2/1984 Horike et al.
4,435,720 A 3/1984 Horike et al.
4,437,101 A 3/1984 Ebi et al.
4,502,055 A 2/1985 Horike et al.
4,504,844 A 3/1985 Ebi et al.
4,510,509 A 4/1985 Horike et al.
4,520,367 A 5/1985 Ishikawa et al.
4,521,502 A 6/1985 Sakai et al.
4,535,339 A 8/1985 Horike et al.
4,544,935 A 10/1985 Sakai
4,550,321 A 10/1985 Sato et al.
4,558,995 A 12/1985 Furukawa et al.
4,562,442 A 12/1985 Jinnai et al.
4,615,607 A 10/1986 Yanagawa et al.
4,626,867 A 12/1986 Furukawa et al.
4,655,579 A 4/1987 Adachi et al.
4,664,501 A 5/1987 Koizumi et al.
4,677,845 A 7/1987 Izumi et al.
4,690,541 A 9/1987 Sakai et al.
4,834,533 A 5/1989 Horike et al.
4,847,631 A 7/1989 Naruse et al.
4,933,727 A 6/1990 Mizuma et al.
5,121,170 A 6/1992 Bannai et al.
5,204,716 A 4/1993 Kasahara et al.
5,317,438 A 5/1994 Suzuki et al.
5,412,413 A 5/1995 Sekiya et al.
5,600,356 A 2/1997 Sekiya et al.
5,768,666 A * 6/1998 Ito et al. ..... 399/273
5,955,228 A 9/1999 Sakai et al.
6,367,914 B1 4/2002 Ohtaka et al.
6,398,345 B1 * 6/2002 Sakai et al. ..... 347/55
6,597,884 B2 7/2003 Miyaguchi et al.
6,597,887 B2 7/2003 Sakai et al.
6,708,014 B2 3/2004 Miyaguchi et al.
6,719,469 B2 4/2004 Yasui et al.
2003/0128243 A1 7/2003 Okamoto et al.
2005/0158073 A1 * 7/2005 Nakazato et al. ..... 399/252 X

OTHER PUBLICATIONS

U.S. Appl. No. 11/370,823, filed Mar. 9, 2006, Nakagawa et al.
U.S. Appl. No. 11/376,434, filed Mar. 16, 2006, Takahashi et al.
U.S. Appl. No. 11/481,914, filed Jul. 7, 2006, Tsukamoto.

* cited by examiner

TONER TRANSPORT DEVICE FOR IMAGE-FORMING DEVICE

BACKGROUND OF THE INVENTION

1. Field of the Invention

The present invention relates to a toner transport method and toner transport device for moving the toner on the surface of an electrostatic toner transporting device relative to the surface thereof by means of electrostatic force. The present invention also relates to a developing device, process unit, image-forming device, and image-forming method that use the aforementioned toner transport method.

2. Description of the Related Art

The devices disclosed in Japanese Laid-open Patent Application Nos. H9-197781 and H9-329947 are known as conventional examples of a copier, facsimile device, printer, or other image-forming device. In these image-forming devices, toner that is supported on a developing roller or other developer carrier with a moving surface is transported to a development position opposite from a photoreceptor or other latent image carrier, and the electrostatic latent image on the latent image carrier is developed. In this arrangement, the toner sometimes rubs between the developer carrier with the moving surface and the latent image carrier, bonds to either of the surfaces, and adversely affects the image. The toner is supposed to be moved electrostatically at the development position by the electrical potential difference between the surface of the developer carrier and the electrostatic latent image on the latent image carrier, but this electrical potential difference must be fairly large. This is because a force must be imparted to the toner prior to the start of electrostatic movement that is sufficient to overcome the adhesive force of the toner to the developer carrier that results from van der Waals forces, image forces, or the like, and this requires a large electrostatic force.

On the other hand, the device disclosed in Japanese Laid-open Patent Application No. 2002-341656, for example, is known as an image-forming device for developing a toner image without the use of a developer carrier with a moving surface. The developing device of this image-forming device utilizes the EH (Electrostatic Transport and Hopping) effect on the surface of an electrostatic toner transport substrate provided with a plurality of electrodes arranged at a prescribed pitch to transport the toner to the development position. This "EH effect" is an effect whereby the energy of a phase-shifted electric field acting on the grains is converted into mechanical energy, and the grains themselves move dynamically. The toner in which the EH effect occurs jumps with a forward-directed component by means of the phase-shifted electric field on the surface of the electrostatic transport substrate, and movement (transport) in the direction of the substrate surface and movement (hopping) in the direction perpendicular to the substrate surface are performed. Development with an extraordinarily low electrical potential can be achieved in a configuration that uses a developer carrier with a moving surface by transporting toner on an electrostatic toner transport substrate to the development position while causing the toner to hop. For example, it is also possible to selectively affix toner to an electrostatic latent image in which the potential difference from that of the surrounding blank portions is only a few dozen volts.

However, the developing device of this image-forming device is unable to adequately supply charged toner to the electrostatic toner transport substrate, and there is a risk of adverse effects due to deficient charging of the toner. Specifically, the toner is charged as it is rubbed by the rotation of the agitator inside the toner hopper, drawn up from the toner hopper to the surface of an electrostatic roller, and rubbed by a regulating blade, but this amount of friction can be inadequate.

Therefore, the four inventors are developing a new toner feeding device for feeding toner to an electrostatic toner transport substrate after adequately friction-charging the toner by mixing the toner with glass beads or other friction-facilitating particles made up of a substance that promotes friction, and agitating the toner while in this mixture. This toner feeding device has a mixture container for holding the mixture, a rotating screw member or other stirring and transport member disposed inside the mixture container, and a mesh provided in a portion of the bottom panel of the mixture transport path thus formed. A toner refill device for refilling new toner into the mixture container is also provided. Frictional charging of the toner is facilitated by the process whereby the mixture in the mixture container is transported while being agitated by the stirring and transport member. The toner then passes over the top of the mesh, whereupon the toner is discharged onto the electrostatic toner transport substrate through the holes in the mesh. In this arrangement, the toner can be fed to the electrostatic toner transport substrate after being reliably charged by friction with the friction-promoting substance.

However, such new drawbacks as the following occur in this developing device. Specifically, not enough toner can be sifted by the mesh, and the quantity of toner that is fed to the electrostatic toner transport substrate is inadequate.

Therefore, as a result of concentrated investigation of the cause whereby an adequate quantity of toner cannot be sifted, the inventors made such discoveries as the following. Specifically, as a result of strong electrostatic attachment of toner receiving adequate frictional charging to the surface of the friction-promoting particles constituting the main component of the friction-promoting substance in the mixture container, it becomes difficult to separate the toner from that surface. Even if effort is also expended to scrape the toner from the surfaces of the friction-promoting particles with the edge of the mesh holes, the toner is sometimes retained around the periphery of the holes and reattaches to the surfaces of the friction-promoting particles. This phenomenon makes sifting of the toner with a mesh even more difficult.

SUMMARY OF THE INVENTION

An object of the present invention developed in view of the foregoing is to provide a toner transport method and toner transport device, and to provide a developing device, process unit, image-forming device, and image forming method that use the aforementioned devices, whereby deficient charging of toner can be minimized while supplying an adequate quantity of toner to an electrostatic toner transport substrate or other electrostatic toner transporting device for transporting toner by means of an EH effect.

In accordance with the present invention, there is provided a toner transport device provided with electrostatic toner transport means for moving and transporting toner on a surface by an electrostatic force. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion, and potential difference generating means for creating an electrical potential difference between the counter electrode and the mesh.

In accordance with the present invention, there is also provided a toner transport device provided with electrostatic toner transport means for moving and transporting toner on a surface by an electrostatic force. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, and potential difference generating means for generating an electrical potential difference between the mesh and the electrostatic toner transport means.

In accordance with the present invention, there is also provided a toner transport device provided with electrostatic toner transport means for moving and transporting toner on a surface by an electrostatic force. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion, and potential difference generating means for creating an electrical potential difference between the counter electrode and the mesh, and between the mesh and the electrostatic toner transport means.

In accordance with the present invention, there is also provided a toner transport method for moving and transporting toner on the surface of electrostatic toner transport means by an electrostatic force. The toner transport method comprises the steps of sifting the toner through a mesh from a mixture of toner and a friction-promoting substance stored in a mixture container or in a connecting portion that is communicated therewith, and feeding the toner to the electrostatic toner transport means, stirring the mixture in the mixture container, and creating an electrical potential difference between a mesh provided to the mixture container or the connecting portion and a counter electrode that faces the mesh via the mixture in the mixture container or connecting portion.

In accordance with the present invention, there is also provided a toner transport method for moving and transporting toner on the surface of electrostatic toner transport means by an electrostatic force. The toner transport method comprises the steps of sifting the toner through a mesh from a mixture of toner and a friction-promoting substance stored in a mixture container or in a connecting portion that is communicated therewith, and feeding the toner to the electrostatic toner transport means, stirring the mixture in the mixture container, and creating an electrical potential difference between a mesh provided to the mixture container or the connecting portion and the electrostatic toner transport means.

In accordance with the present invention, there is also provided a toner transport method for moving and transporting toner on the surface of electrostatic toner transport means by an electrostatic force. The toner transport method comprises the steps of sifting the toner through a mesh from a mixture of toner and a friction-promoting substance stored in a mixture container or in a connecting portion that is communicated therewith, and feeding the toner to the electrostatic toner transport means, stirring the mixture in the mixture container, creating an electrical potential difference between a mesh provided to the mixture container or the connecting portion and a counter electrode that faces the mesh via the mixture in the mixture container or connecting portion, and creating an electrical potential difference between the mesh and the electrostatic toner.

In accordance with the present invention, there is also provided a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion, and potential difference generating means for creating an electrical potential difference between the counter electrode and the mesh.

In accordance with the present invention, there is also provided an image forming method for forming an image. The image forming method comprises a latent image formation step whereby a latent image is formed on a latent image carrier; and a development step whereby toner is moved on the surface of electrostatic toner transport means by an electrostatic force, the toner is transported to a position that faces the latent image carrier, and the latent image is developed into a toner image. The image forming method further comprises a feeding step, whereby the toner is separated from the mixture of toner and the friction-promoting substance and fed to the electrostatic toner transport means, is carried out and also carries out a step for storing the mixture in the mixture container, a step for stirring the mixture in the mixture container, and a step whereby an electrical potential difference is created between a mesh provided to the mixture container or to a connecting portion that communicates therewith and a counter electrode that faces the mesh via the mixture in the mixture container or the connecting portion, and between the mesh and the electrostatic toner transport means. The toner in the mixture is sifted by the mesh and fed to the electrostatic toner transport means.

In accordance with the present invention, there is also provided a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, and potential difference generating means for creating an electrical potential difference between the mesh and the electrostatic toner transport means.

In accordance with the present invention, there is also provided a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion, and potential difference generating means for creating an electrical potential difference between the counter electrode and the mesh, and between the mesh and the electrostatic toner transport means.

In accordance with the present invention, there is also provided a process unit in which at least a latent image carrier for carrying a latent image in an image-forming device and developing means for developing a latent image on the latent image carrier are supported as a single unit by a shared support. The developing means is a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion, and potential difference generating means for creating an electrical potential difference between the mesh and the electrostatic toner transport means.

In accordance with the present invention, there is provided a process unit in which at least a latent image carrier for carrying a latent image in an image-forming device and developing means for developing a latent image on the latent image carrier are supported as a single unit by a shared support. The developing means is a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, and potential difference generating means for creating an electrical potential difference between the counter electrode and the mesh.

In accordance with the present invention, there is also provided a process unit in which at least a latent image carrier for carrying a latent image in an image-forming device and developing means for developing a latent image on the latent image carrier are supported as a single unit by a shared support. The developing means is a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion, and potential difference generating means for creating an electrical potential difference between the counter electrode and the mesh, and between the mesh and the electrostatic toner transport means.

In accordance with the present invention, there is also provided an image-forming device which comprises a latent image carrier for carrying a latent image, and developing means for developing the latent image on the latent image carrier. The developing means is a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion, and potential difference generating means for creating an electrical potential difference between the counter electrode and the mesh.

In accordance with the present invention, there is also provided an image-forming device which comprises a latent image carrier for carrying a latent image, and developing means for developing the latent image on the latent image carrier. The developing means is a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, and potential difference generating means for creating an electrical potential difference between the mesh and the electrostatic toner transport means.

In accordance with the present invention, there is also provided an image-forming device which comprises a latent image carrier for carrying a latent image, and developing means for developing the latent image on the latent image carrier. The developing means is a developing device for transporting toner residing on the surface of electrostatic toner transport means provided to a toner transport device to a position that faces a latent image carrier while moving the toner by an electrostatic force, and developing the latent image carried on the latent image carrier. The toner transport device comprises a mixture container for storing a mixture of toner and a friction-promoting substance, stirring means for stirring the mixture in the mixture container, a mesh provided to the mixture container or to a connecting portion that is communicated therewith, toner feeding means for sifting the toner in the mixture in the mixture container or the connecting portion through the mesh and feeding the toner to the electrostatic toner transport means, a counter electrode that faces the mesh via the mixture in the mixture container or the connecting portion; and potential difference generating means for creating an electrical potential difference between the counter electrode and the mesh, and between the mesh and the electrostatic toner transport means.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

An embodiment will be described hereinafter in which the present invention is applied to a laser copier (hereinafter referred to simply as "copier"), which consists of a xerographic image-forming device.

Figure 1:
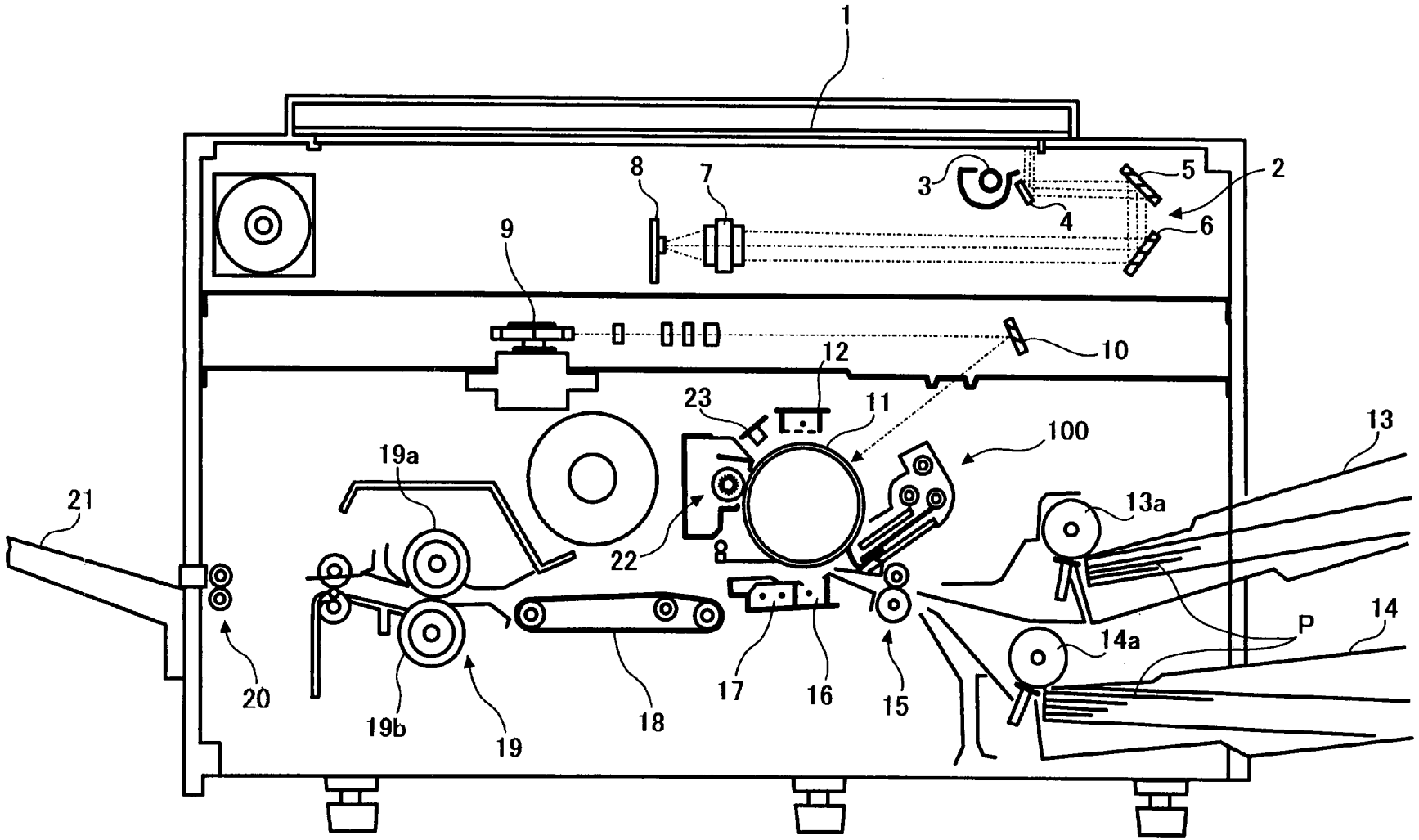
FIG. 1 is a diagram depicting the schematic layout of the copier pertaining to Embodiment 1 of the present invention.

The basic structure of the copier pertaining to the present embodiment is depicted in FIG. 1. A scanner device having a contact glass 1, a scanning optical system 2, and the like is provided to the top of the main body of the copier. After a document is placed on the contact glass 1, a copy start button (not pictured) is pressed, whereupon reading of the document by the scanner device is initiated. Specifically, optical scanning of the document on the contact glass 1 is performed while a moving unit having a document-illuminating light source 3, reflecting mirrors 4, 5, and 6, and the like moves in the direction of the document face. The light reflected off the document by this optical scanning passes through a lens 7 and is read as an image signal by an image-reading element 8, and digital image processing is performed. The signal thus processed actuates a laser diode LD (not shown), and laser light is emitted.

This emitted laser light is reflected on a polygon mirror 9 and scans a photoreceptor 11 via a mirror 10 while being deflected in the principal scanning direction. Prior to this scanning, a drum-shaped photoreceptor 11 is uniformly charged by a drum charger 12 while being rotated by a driving device (not shown) in the clockwise direction in the diagram. The surface is scanned with the laser light, and an electrostatic latent image is formed. The electrostatic latent image is developed into a toner image by the developing device 100.

A charger unit faces the photoreceptor 11 from underneath in the diagram. Two paper feeding cassettes 13 and 14 are disposed to the right of the charger unit in the diagram, and transfer paper P consisting of recording media is stored in each cassette in bundles in which a plurality of sheets is stacked. When copying is started, the paper feeding roller 13*a* or 14*a* of the paper feeding cassette 13 or 14 that contains the transfer paper P of the appropriate size and orientation for the image information is rotated, and the topmost transfer paper P of the transport paper bundle is sent along the paper feeding path. A pair of registration rollers 15 is disposed downstream in the paper feeding path, and the transfer paper P coming from the paper feeding device is sandwiched between the rollers. The transfer paper is then sent toward the opposing portion of the photoreceptor 11 and the charger unit at a timing at which the sandwiched transfer paper can be superposed on the toner image on the photoreceptor 11. The toner image on the photoreceptor 11 is electrostatically transferred onto the transfer paper P in this opposing portion by means of the corona discharge that arises from the transfer charger 16 of the charger unit.

The transfer paper P separated from the photoreceptor 11 by the separation charger 17 is then sent to a fixing device 19 by a transport belt 18 that moves endlessly between tension rollers. The fixing device 19 is sandwiched in a fixing nip that is formed by a heating roller having a heat source therein and a pressing roller that is in contact therewith at a prescribed pressure, and is pressed while being heated. The toner image is fixed onto the transfer paper P by the effects of this heating and pressing. The transfer paper P on which the toner image is thus fixed is stacked on a stacking unit 21 outside the apparatus via a pair of paper delivery rollers 20.

The photoreceptor 11 that has passed through the position opposite from the charger unit is cleared of static electricity by a charge-removing lamp 23 and initialized after the residual transfer toner adhering to the surface thereof is removed by a cleaning device 22.

Figure 2:
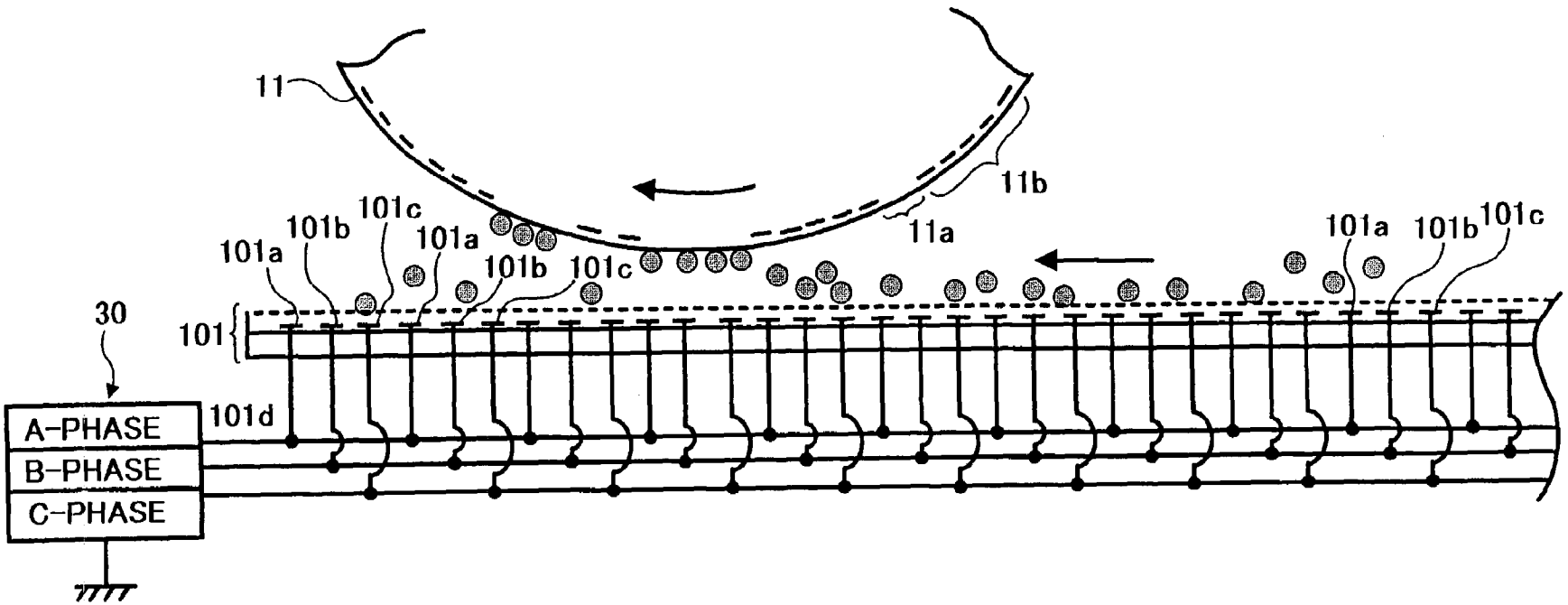
FIG. 2 is a diagram depicting the structure of the photoreceptor of the same copier and the first electrostatic toner transport substrate of the developing device.

FIG. 2 is a diagram depicting the structure of the photoreceptor 11 and the first electrostatic toner transport substrate 101 of the developing device 100. Toner is fed from a feeding unit described hereinafter onto the first electrostatic toner transport substrate 101 in an area (not pictured) inside the developing device 100. The first electrostatic toner transport substrate 101 is positioned against an insulating plate 101*d* composed of glass or the like so that a plurality of strip-shaped transport electrodes is arranged at a prescribed pitch in the longitudinal direction of the substrate (the horizontal direction in the figure). These transport electrodes are 30 μm wide (dimension in the longitudinal direction of the substrate) and are arranged parallel to each other and spaced apart at 30 μm intervals. With this type of arrangement, the strip-shaped transport electrodes are arranged in stripes on the insulating substrate. An insulation layer (not pictured) composed of an insulating material also covers the insulating substrate 101 and the transport electrodes.

As a more detailed description of the transport electrodes, the transport electrodes are classified into three types consisting of group A, group B, and group C, and electrodes belonging to the same group are electrically connected to each other. The transport electrodes are also arranged on the insulating layer 101*d* with the sequence A (transport electrodes 101*a* belonging to group A), B (transport electrodes 101*b* belonging to group B), and C (transport electrodes 101*c* belonging to group C) repeated in order from the left side of the figure. An A-phase drive pulse voltage, a B-phase drive pulse voltage, and a C-phase drive pulse voltage from the drive power source circuit 30 are applied to the Group A transport electrodes 101*a*, Group B transport electrodes 101*b*, and Group C transport electrodes 10*c*, respectively. In the figure, the toner is charged with a negative polarity and transported on the first electrostatic toner transport substrate 101 from the right to left in the figure.

Figure 3:
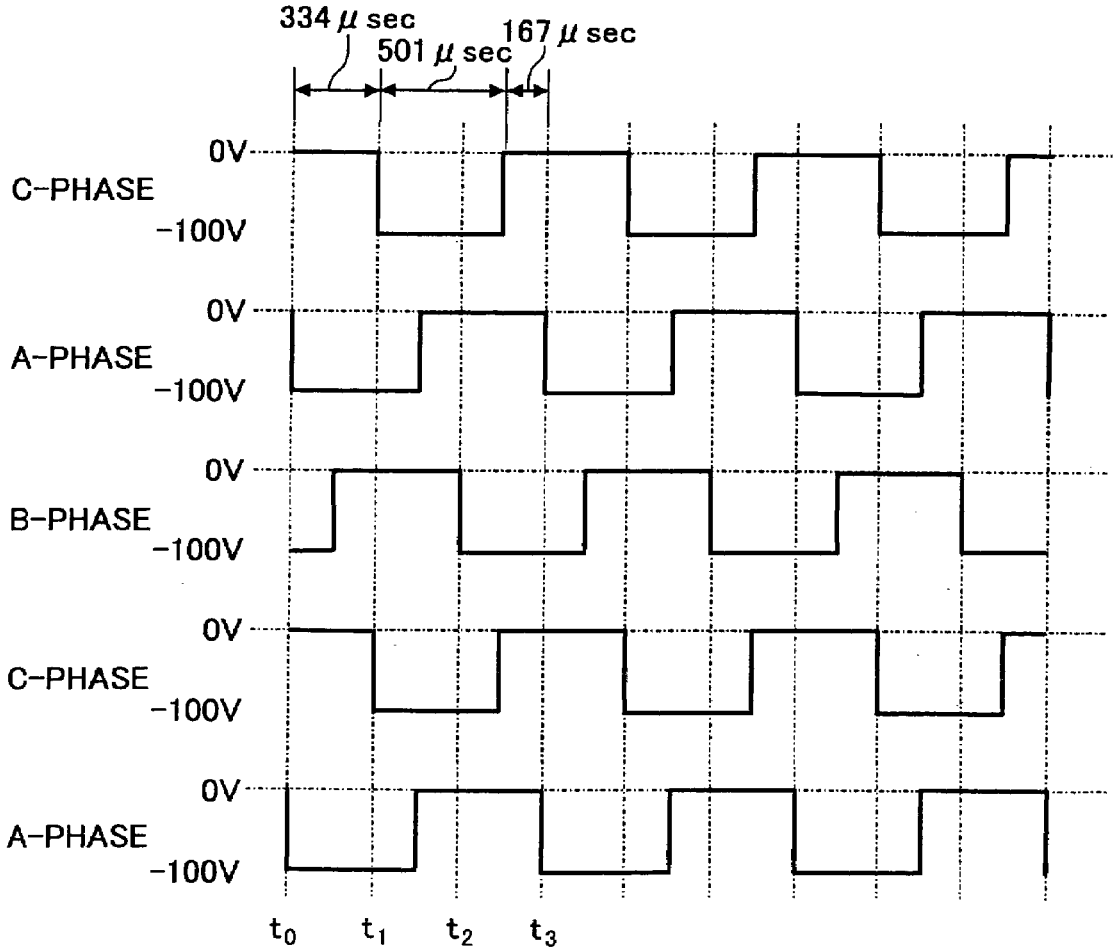
FIG. 3 is a waveform diagram depicting the waveforms of the A-phase drive pulse voltage, B-phase drive pulse voltage, and C-phase drive pulse voltage applied to the transport electrodes of the electrostatic toner transport substrate of the same copier.

FIG. 3 is a waveform diagram depicting the waveforms of the A-phase drive pulse voltage, B-phase drive pulse voltage, and C-phase drive pulse voltage described above. In each phase, a direct current pulse wave with a voltage of −100 V and a duration of 501 μsec is output at an interval of 501 μsec. First, speaking of the C-phase drive pulse voltage applied to the transport electrodes 101*c*, the voltage at time $t_0$ is 0 V. At this time, the Group A transport electrodes 101*a* adjacent to each other in the upstream direction of toner transport to the Group C transport electrodes 101*c* are also at 0 V (see C-phase drive pulse). A voltage of −100 V is applied to the Group B transport electrodes 101*b* that are adjacent to each other in the downstream direction of toner transport (see B-phase drive pulse voltage). In this state, the toner on the Group C transport electrodes 101*c* is stationary with almost no movement at time $t_0$.

334 μsec then elapses until time $t_1$ is reached, whereupon a voltage of −100 V is applied to the Group C transport electrodes 101*c*. Whereupon, an electrostatic force in opposition to the Group C transport electrodes 101*c* acts on the negatively charged toner that is present on the Group C transport electrodes 101*c*. At this time, a voltage of −100 V is also applied to the Group A transport electrodes 101*a* that are adjacent to the Group C transport electrodes upstream in the toner transport direction. On the other hand, the Group B transport electrodes 101*b* that are adjacent to each other in the downstream direction of toner transport are at 0 V. The negatively charged toner present on the Group C transport electrodes 101*c* is therefore electrostatically shifted toward the Group B transport electrodes 101*b*.

Another 334 μsec then elapses until time $t_2$ is reached, whereupon a voltage of −100 V is applied to the Group B transport electrodes 101*b* that have thus far been at 0 V. An electrostatic force in opposition to the Group B transport electrodes 101*b* then acts on the toner that has come to be present on the Group B transport electrodes 101*b* by means of electrostatic movement from the top of the Group C transport electrodes 101*c*. At this time, a voltage of −100 V is also applied to the Group C transport electrodes 101*c* that are adjacent to the Group B transport electrodes 101*b* upstream in the toner transport direction. On the other hand, the Group A transport electrodes 101*a* that is adjacent to each other in the downstream direction of toner transport are at 0 V. The toner on the Group B transport electrodes 101*b* is therefore electrostatically shifted toward the Group A transport electrodes 101*a*.

Another 334 μsec then elapses until time $t_3$ is reached, whereupon a voltage of −100 V is applied to the Group A transport electrodes 101*a* that have thus far been at 0 V. An electrostatic force in opposition to the Group A transport electrodes 101*a* then acts on the toner that has come to be present on the Group A transport electrodes 101*a* by means of electrostatic movement from the Group B transport electrodes 101*b*. At this time, a voltage of −100 V is also applied to the Group B transport electrodes 101*b* that are adjacent to the Group A transport electrodes 101*a* upstream in the toner transport direction. On the other hand, the Group C transport electrodes 101*c* that are adjacent to each other in the downstream direction of toner transport are at 0 V. The toner on the Group A transport electrodes 101*a* is therefore electrostatically shifted toward the Group C transport electrodes 101*c*.

By repetition of electrostatic movement such as is described above, the toner on the first electrostatic toner transport substrate 101 moves electrostatically in FIG. 2 from the right side in the figure to the left side while hopping. The toner then enters the development area at which the first electrostatic toner transport substrate 101 and the photoreceptor 11 face each other across a prescribed gap. In this development area, the image portion 11*a* of the photoreceptor 11 is at 0 V while the non-image portion 11*b* is at −100 V. Whereupon, the toner adheres to the image portion 11*a* of the photoreceptor 11 by the process of electrostatic movement in the development area from the right side in the figure to the left side, and the electrostatic latent image is developed.

As for the non-image portion 11*b* of the photoreceptor 11, the charge polarity of the toner must be made to take on an even larger potential than the potential average value of the drive pulse voltage applied to the transport electrodes of the first electrostatic toner transport substrate 101. For example, the drive pulse voltage for each phase depicted in FIG. 3 cycles between a potential of −100 V for a duration of 501 μsec and a potential of 0 V for a duration of 501 μsec, so the potential average value is −50 V. On the other hand, the potential of the non-image portion 11*b* of the photoreceptor 11 in FIG. 2 is −100 V, which is greater in its negative polarity than −50 V. With the potentials in this type of relation, the toner in the development area between the first electrostatic toner transport substrate 101 and the non-image portion 11*b* of the photoreceptor 11 electrostatically moves in relative fashion toward the first electrostatic toner transport substrate 101, so adhesion to the non-image portion 11*b* is prevented. Also, there is a risk of the toner electrostatically moving in relative fashion toward the non-image portion 11*b* and adhering thereto if the potential of the non-image portion 11*b* is made smaller in its negative polarity than the potential average value of the drive pulse voltage.

Therefore, the potential of the non-image portion 11*b* is made larger than the potential average value of the drive pulse voltage in the charge polarity of the toner.

The characteristic structure of the present copier will next be described.

Figure 4:
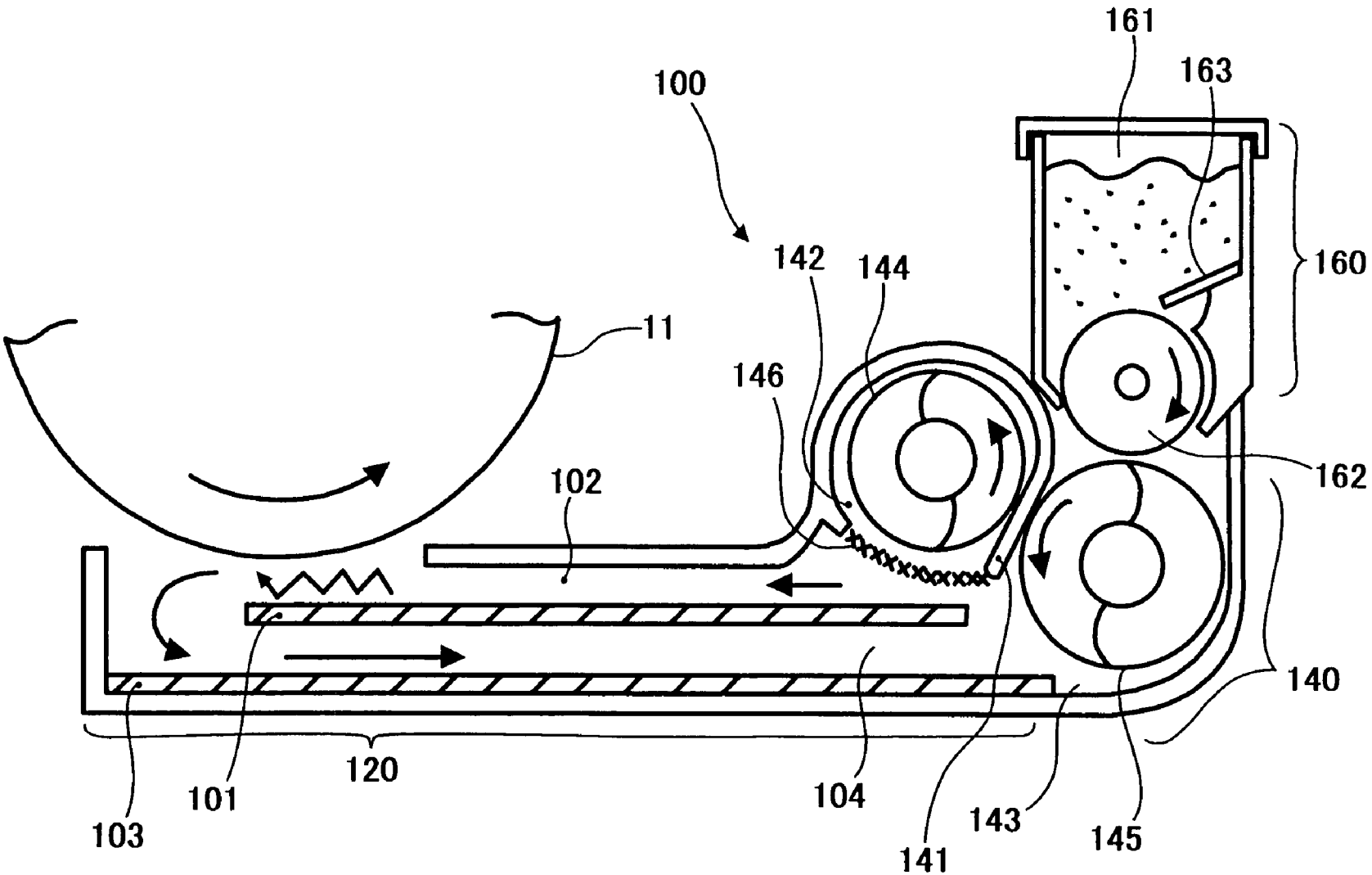
FIG. 4 is a diagram depicting the structure of the developing device and photoreceptor of the same copier.

A structural diagram of the developing device 100 and the photoreceptor 11 is shown in FIG. 4. The developing device 100 in the figure is provided with a toner transport unit 120 for circulating and transporting toner in the vicinity of the photoreceptor 11, a toner feeding unit 140 for feeding toner thereto, a toner refill unit 160 for refilling toner into this assembly, and the like.

Figure 5:
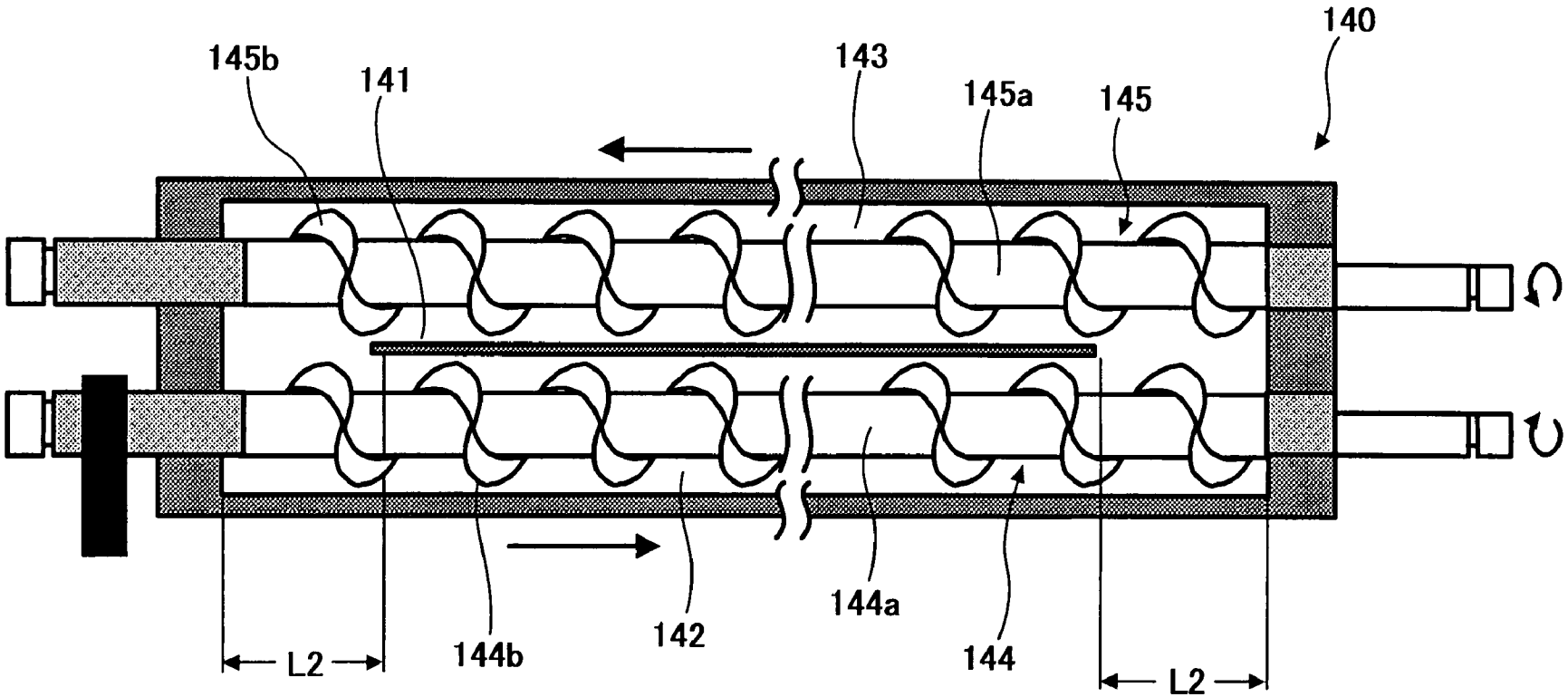
FIG. 5 is a planar cross-sectional diagram depicting the structure of the toner feeding unit of the same developing device.
Figure 6:
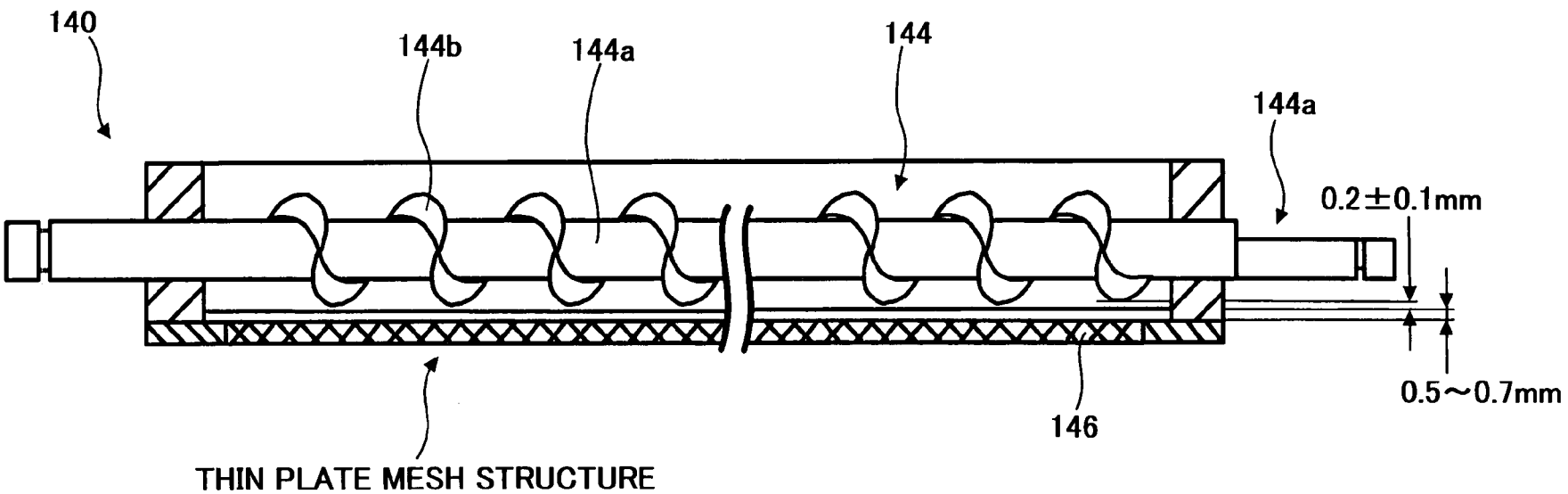
FIG. 6 is a longitudinal cross-sectional diagram depicting the structure of the same toner feeding unit.
Figure 7:
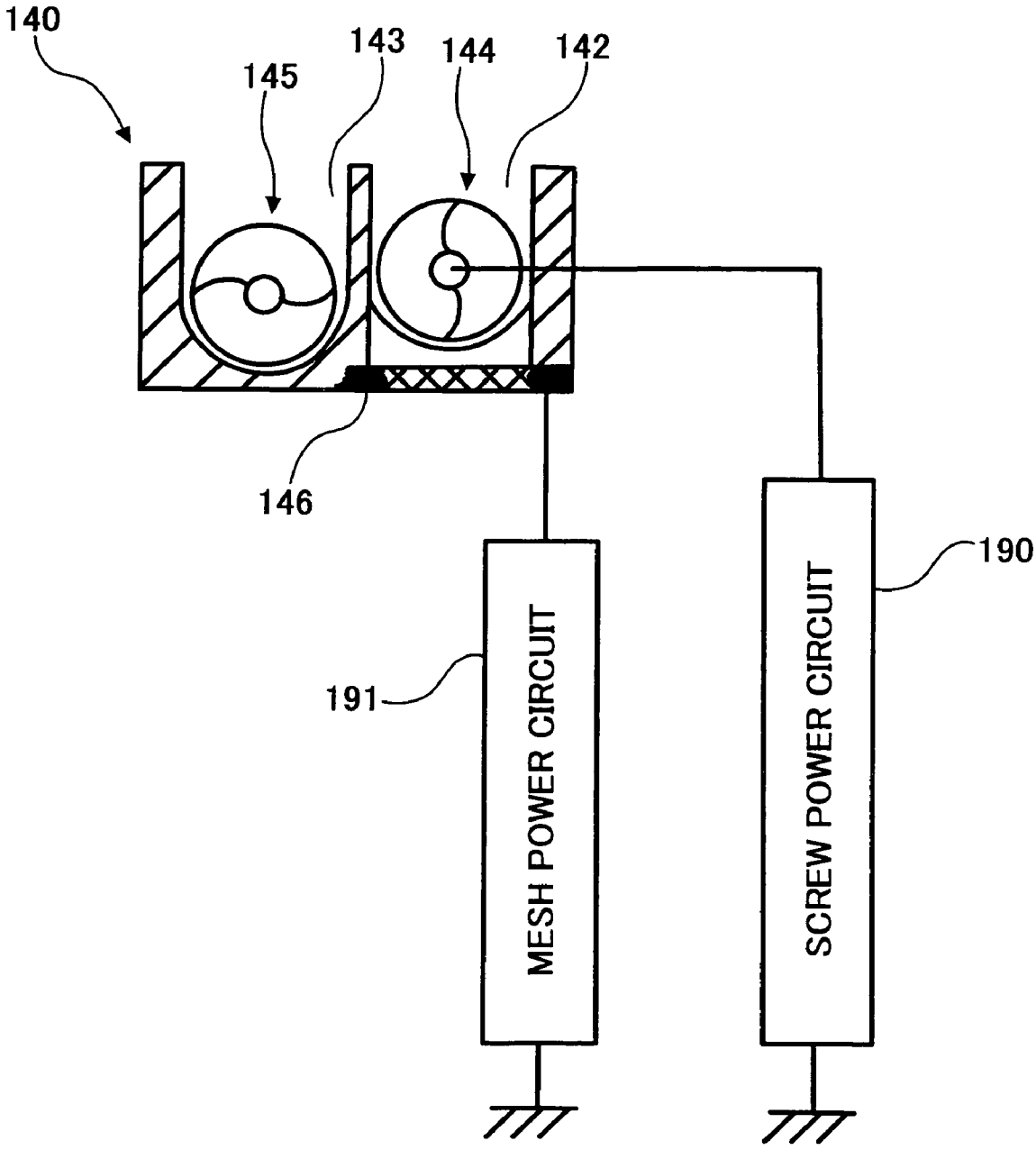
FIG. 7 is a transverse cross-sectional diagram depicting the structure of the same toner feeding unit.

A planar cross-sectional view, a longitudinal cross-sectional view, and a transverse cross-sectional view of the toner feeding unit 140 are shown in FIGS. 5, 6, and 7, respectively. The toner feeding unit 140 has a storage chamber that acts as a mixture storage unit for storing a mixture of the toner and the friction-promoting substance (not pictured), and this storage chamber is divided by a dividing wall 141 into two chambers consisting of the first storage chamber 142 and the second storage chamber 143. A first transport screw 144 rotated by a driving device (not pictured) is provided inside the first storage chamber 142. A second transport screw 145 rotated by a driving device (not pictured) is also provided inside the second storage chamber 143.

The first transport screw 144 and second transport screw 145 are configured with helical threads 144*b* and 145*b* protruding from the surface of rotating shafts 144*a* and 145*a*. Each screw pitch is 120 mm and the thickness of the helical threads is 1.5 mm. The rotating shafts 144*a* and 145*a* are rotated so as to move the leading ends of the helical threads 144*b* and 145*b* at a peripheral speed of 60 mm/sec. The screws are also coated with a polyimide resin layer consisting of an insulating material about 1-μm thick on the surface of a base material consisting of aluminum or another electrically conductive material.

Near both ends of the storage chamber, there are connecting portions that each span a distance L2 (25 mm, for example) and are devoid of the dividing wall 141, and the two storage chambers 142 and 143 are communicated at these spaces. In FIG. 5, as the first transport screw 144 is rotated by a screw drive system (not pictured), the mixture stored in the first storage chamber 142 is agitated and transported from the left side in the figure to the right side. The mixture thus transported to the connecting portion of the first storage chamber 142 on the right side of the figure makes its way into the second storage chamber 143. The mixture is then transported from the right side in the figure toward the left side by the second transport screw 145 rotated by the screw drive system, and returns to the first storage chamber 142 through the connecting portion of the second storage chamber 143 on the left side in the figure. The mixture thus circulates within the storage chamber in the counterclockwise direction in the figure while being agitated and transported.

A toner concentration detecting device (not pictured) is disposed in the second storage chamber 143, and the toner concentration of the mixture in the second storage chamber 143 is detected and a toner concentration signal is outputted to a refill controller (not pictured). The refill controller refills the first storage chamber 142 with the appropriate quantity of toner by actuating and controlling the toner refill unit (160 in FIG. 4) according to the toner concentration signal. Thus, the toner concentration of the mixture in the storage chamber is maintained within a prescribed range. After the toner that is refilled into the second storage chamber 143 is incorporated into the mixture, the mixture is sent to the first storage chamber 142 while caused to rub against the friction-promoting substance during stirring and transport.

As depicted in FIG. 6, a mesh 146 is provided in the bottom of the first storage chamber 142. In the first storage chamber 142, the mixture passes over the mesh 146 while being agitated and transported by the first transport screw 144. The mesh 146 consists of a metal plate member made of stainless steel or the like with a thickness of 0.08 mm in which a plurality of holes with a major axis of 0.2 mm and a minor axis of 0.15 mm are provided with an open area ratio of approximately 50%. The holes are arranged so that the minor axis direction thereof is aligned with the direction of the screw axis line.

A prescribed gap is maintained between the leading end of the helical thread 144*b* of the first transport screw 144 and the mesh 146. This gap is preferably set to a range of about ⅕ to 10 times the diameter of the toner. A range of about ⅓ to 2 times the carrier radius is preferred, because the mixture recycling efficiency and the mixing/stirring efficiency are enhanced. The gap is set to about 0.7 to 1.0 mm in the copier of the present embodiment. A prescribed gap is preferably provided between the leading end of the helical thread 144*b* of the first transport screw 144 and the mesh 146.

As depicted in FIG. 7, a screw power circuit 190 is connected to the electrically conductive material of the first transport screw 144. A mesh power circuit 191 is also connected to the mesh 146. These power circuits both create a negative electrical potential in either the screw or the mesh, and the output voltage of each is controlled by a main controller (not pictured). When toner is fed from the toner feeding unit 140 to the toner transport unit 120 (not pictured), the first transport screw 144 and the mesh 146 each take on a potential of the same polarity as the toner by means of the output from the power circuits. Specifically, the first transport screw 144 takes on a greater potential in the same polarity as the toner (negative polarity) than does the mesh 146. The mesh 146 also takes on a greater potential in the same polarity as the toner than the drive pulse voltage applied to the transport electrodes of the first electrostatic toner transport substrate 101 (not pictured).

The average drive pulse voltage is defined as the area under the curve of the drive pulse voltage per unit time. For example, in the case of a rectangular wave with 50% duty ratio and 0 to −100 V from peak to peak, the average voltage of the drive pulse is −50 V. If the duty ratio rises above 50%; specifically, if the appearance time of −100 V is longer than the appearance time of 0 V, the average voltage increases beyond −50 V in the minus direction. If the duty ratio decreases below 50%; specifically, if the appearance time of −100 V is shorter than the appearance time of 0 V, the average voltage becomes smaller than −50 V. In experiments by the inventors, applying a voltage of −0.05 to −3.5 kV to the mesh 146, preferably, a mesh voltage of −0.2 to −2.5 kV, was found to be effective under the conditions described below.

Gap with leading end of the helical thread 144*b* of the first transport screw 144: 1 mm Average drive pulse voltage: −50 V Potential of first transport screw 144: ground When using positively charged toner, a mesh voltage that is greater in the positive direction than −50 V may be applied to the mesh 146 if the average drive pulse voltage is −50 V, for example. More specifically, a mesh voltage of 0 to −49 V may be applied.

Figure 8:
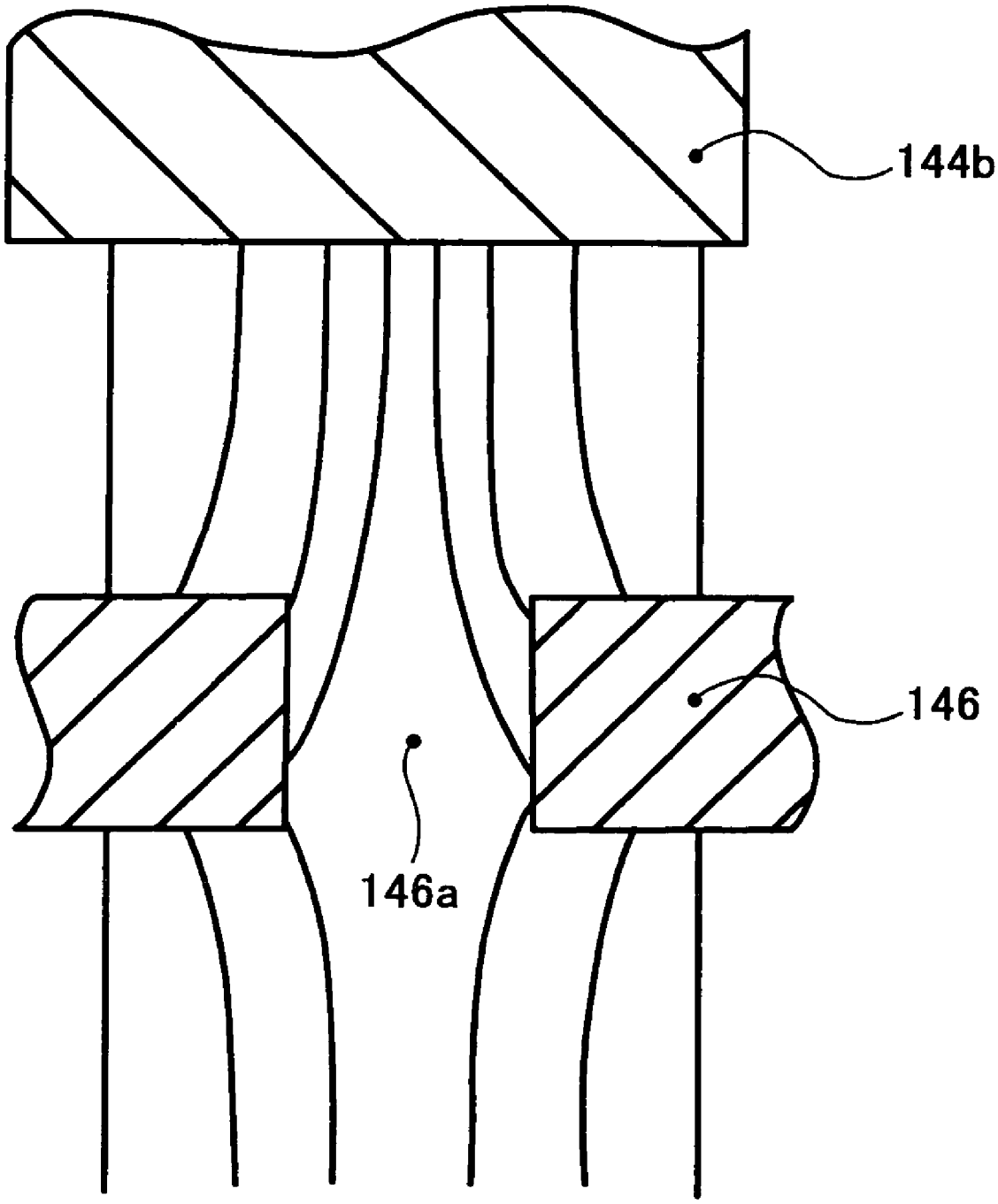
FIG. 8 is a schematic diagram depicting the electric field formed between the first transport screw of the same toner feeding unit and the mesh.

An electrical field such as the one depicted in FIG. 8 is formed when the first transport screw 144 is caused to take on a charge that is more negative than that of the mesh 146, and the mesh 146 is caused to take on a charge that is more negative than the average drive pulse voltage. In the same figure, electric flux lines extending from the leading end of the helical thread 144*b* of the screw to the inside of the hole 146*a* of the mesh 146 are formed between the first transport screw 144 and the mesh 146. Electric flux lines extending from the vicinity of the exit of the hole 146*a* toward the substrate are also formed between the mesh 146 and the first electrostatic toner transport substrate 101 (not pictured). The toner in the mixture that is agitated and transported by the first transport screw 144 first receives the effects of both electric flux lines, separates from the surfaces of the friction charging particles, and electrostatically moves into the hole 146*a*. After the toner then receives the effects of the latter electric flux lines and passes through the hole 146*a*, the toner electrostatically moves toward the first electrostatic toner transport substrate 101.

By means of this type of electrostatic movement, the toner in the mixture that is agitated and transported in the first storage chamber 142 depicted in FIG. 7 is separated from the friction charging substance and fed to the first electrostatic toner transport substrate 101. The toner after passing through the mesh 146 also continues to electrostatically move on the substrate in relative fashion in the toner transport direction while electrostatically moving in relative fashion toward the transport electrodes on the substrate whose average voltage is less than the potential of the mesh 146.

The difference in potential between the helical thread 144*b* of the first transport screw 144 and the mesh 146 is preferably set so that the electric field strength between these two components is in the same polarity as the toner and has an absolute value in the range of 0.3 to 3.5 kV/mm. This is because the electric flux line extending from the helical thread 144*b* is concentrated at the edge of the hole 146*a* and electrical discharge easily occurs from the screw to the mesh if the absolute value described above is more than 3.5 kV/mm. If this absolute value is less than 0.3 kV/mm, it becomes impossible to impart an electrostatic force that is greater than the adhesion force (image force and van der Waals force) to the toner adhering to the surfaces of the friction-promoting particles. When the distance between the helical thread 144*b* and the mesh 146 is 1 mm, the electric field strength can be kept within the aforementioned range if the absolute value of the difference in the potentials thereof is 0.3 to 3.5 kV. A more preferred range for the electric field strength is an absolute value of 0.8 to 3.0 kV.

According to experimentation by the inventors, the preferred screw voltage was as follows in a case in which the gap between the helical thread 144*b* and the mesh 146 was 1 mm, the mesh 146 was grounded, and voltage was applied only to the first transport screw 144. Specifically, the voltage was −0.3 to −3.5 kV. A more preferred screw voltage was −0.8 to −3.0 kV.

According to experimentation by the inventors, the preferred screw voltage was as follows in a case in which the gap was 1 mm, the first transport screw 144 was grounded, and voltage was applied only to the mesh 146. Specifically, the voltage was −0.05 to −3.5 kV. A more preferred screw voltage was −0.2 to −2.5 kV.

According to experimentation by the inventors, in a case in which both the screw voltage and the mesh voltage were applied, the preferred total value of both voltages was −0.35 to −7.0 kV. A more preferred total value was −1.0 to −5.5 kV.

As depicted in FIG. 7, a mesh is not provided in the bottom of the second storage chamber 143. Consequently, out of the two storage chambers, only the toner in the first storage chamber 142 is fed to the first electrostatic toner transport substrate 101.

In FIG. 8 mentioned previously, the relation indicated by Eq. (1) below exists when E1 is the electric field formed between the helical thread 144*b* and the mesh 146, and E2 is the electric field formed between the mesh 146 and the first electrostatic toner transport substrate 101 (not pictured).

$$E1 > E2 \qquad \text{Eq. (1)}$$

wherein E1 and E2 are of the same polarity.

In this relation, the electric flux lines emanating from the helical thread 144*b* enter deep into the hole in the mesh 146 as depicted in FIG. 8, and the electric flux lines extend from near the exit of the hole in the mesh 146 toward the first electrostatic toner transport substrate (not pictured). After the toner that has separated from the surfaces of the friction-promoting particles in the electric field E1 and flown toward the mesh 146 has entered the hole along the electric flux lines of the electric field E1, the toner then travels outside of the hole along the electric flux lines leading toward the first electrostatic toner transport substrate from near the hole exit. Consequently, the toner can be efficiently separated from the friction-promoting particles in the first storage chamber 142 and fed to the first electrostatic toner transport substrate.

On the other hand, when the relation "electric field E1<electric field E2" holds true, the electric flux lines extending from the first electrostatic toner transport substrate toward the mesh 146 lead from the hole exit all the way to the periphery of the hole entrance in the case of negatively charged toner. Consequently, the toner that has gone all the way from being separated from the friction-promoting particles to flying toward the mesh 146 now cannot enter into the hole, and the result is that the toner becomes unable to separate from the mixture.

The average particle size (diameter) of the toner used by the present copier is in the range of r=3 to 9 μm. The maximum minor axis (diameter) of the mesh 146 used by the present copier is in the range of 6 r to ½ R. R is the average particle size (diameter) of the friction-promoting particles. Specifically, the maximum minor axis of the holes in the mesh 146 is about 18 to 150 μm. The thickness of the mesh 146 is 20 to 150 μm. This thickness is preferably 50 μm or more in order for the mesh 146 to demonstrate a certain degree of stiffness.

Specific conditions for the various voltages to bring about the relation E1>E2 are as listed below, for example, when the gap between the helical thread 144*b* and the mesh 146, and the gap between the mesh 146 and the first electrostatic toner transport substrate are both 1 mm.

Difference in potential between the helical thread 144*b* and the mesh 146: −1.1 to −3.5 kV Difference in potential between the mesh 146 and the electrostatic toner transport substrate (average value of the drive pulse voltage): −0.05 to −1.0 kV.

In FIG. 4 described previously, the toner feeding unit 140 has a second electrostatic toner transport substrate 103 in addition to the first electrostatic toner transport substrate 101. This is dual structure obtained by stacking a transfer section 102 having the first electrostatic toner transport substrate 101 as the undersurface thereof, and a recovery section 104 disposed downward in the gravitational direction thereof and provided with the second electrostatic toner transport substrate 103 as the undersurface thereof. The toner that passes through the mesh 146 and is fed to the right-hand end in the figure of the first electrostatic toner transport substrate 101 of the toner feeding unit 140 is transported from the right side in the figure to the left side while hopping due to the EH effect. A portion thereof then contributes to the development of an electrostatic latent image in the development area opposite from the photoreceptor 11. The remaining toner that did not participate in development passes through the development area, and then falls onto the left-hand end of the second electrostatic toner transport substrate 103 in the figure. The second electrostatic toner transport substrate 103 also has a plurality of transport electrodes in the same manner as the first electrostatic toner transport substrate 101. The toner that falls onto the left-hand end of the second electrostatic toner transport substrate 103 in the figure receives the effects of the drive pulses of layers A through C applied to the transport electrodes, and is then transported from the left side in the figure to the right side while hopping. The toner then returns to the second storage chamber of the toner feeding unit 140. The toner that did not participate in development is thereby recycled.

The toner refill unit 160 is detachably connected to the second storage chamber 143 of the toner feeding unit 140. The toner refill unit 160 is actuated and controlled by the refill controller, whereby the toner stored therein is used to refill the second storage chamber 143.

In the developing device 100 configured as described above, a toner transporting device is constituted by combining the toner transport unit 120, the toner feeding unit 140, and the toner refill unit 160. The term "toner transporting device" refers to a device for transporting toner residing on the surface of a first electrostatic toner transport substrate 101 that constitutes an electrostatic toner transporting device to a position opposite a photoreceptor 11 constituting a latent image carrier while causing the toner to move relative to the aforementioned surface by means of an electrostatic force. In the developing device 100 of the present copier, the first storage chamber 142 and second storage chamber 143 function as mixture containers for holding a mixture in which a friction charging substance for promoting frictional charging of the toner is mixed with the toner. The first transport screw 144 also functions as a counter electrode that faces the mesh 146 via the mixture in the first storage chamber.

In the present copier as described above, an electrostatic force directed from the screw to the mesh is applied to the toner in the mixture residing between the counter electrode and the mesh in the first storage chamber 142 by the difference in potential between the first transport screw 144 and the mesh 146. The toner is separated from the surfaces of the friction-promoting particles and is electrostatically moved toward the mesh by means of this electrostatic force, whereby an adequate quantity of toner can be sifted by the mesh and fed to the first electrostatic toner transport substrate 101. An electrostatic force directed from the mesh to the substrate by means of the potential difference between the mesh 146 and the first electrostatic toner transport substrate 101 also acts in and around the holes on the toner that is scraped from the surfaces of the friction-promoting particles by the edges of the holes in the mesh 146. By this means, an adequate quantity of toner can be passed through the holes in the mesh 146 and fed to the first electrostatic toner transport substrate 101.

Figure 9A:
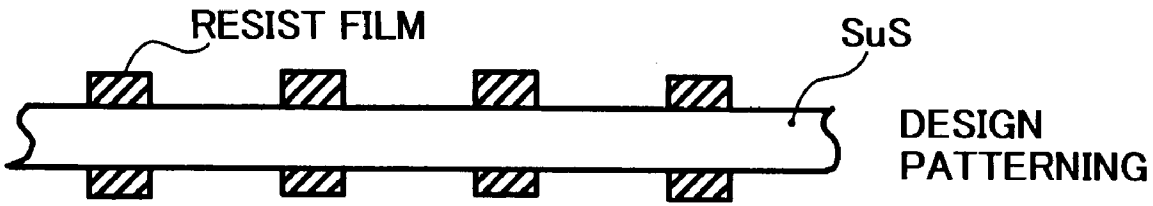
FIGS. 9A through 9C are schematic diagrams depicting an example of the mesh forming process for forming the same mesh.
Figure 9B:
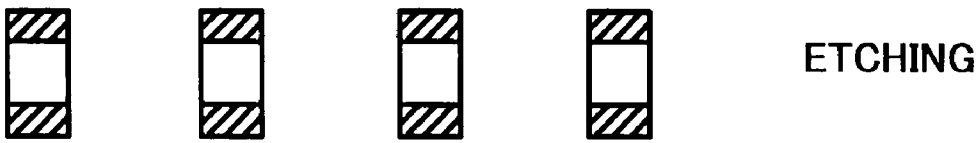
Figure 9C:
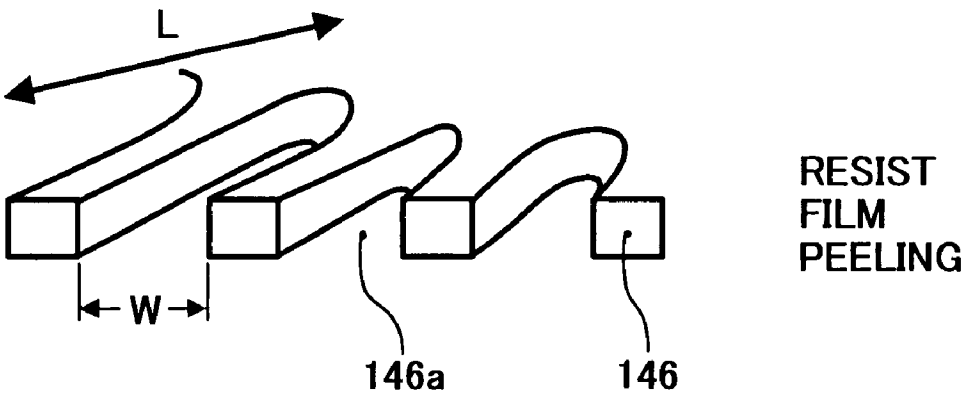
Figure 10A:
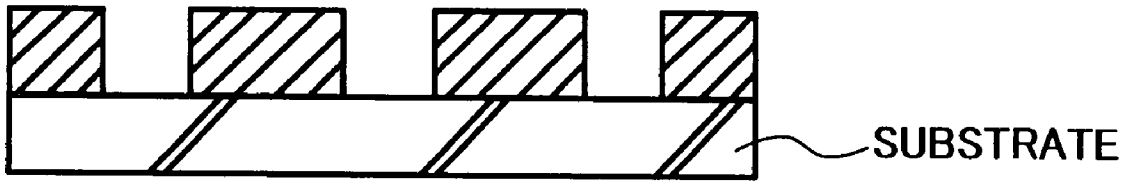
FIGS. 10A through 10C are schematic diagrams depicting an example of a mesh forming process by electroforming.
Figure 10B:
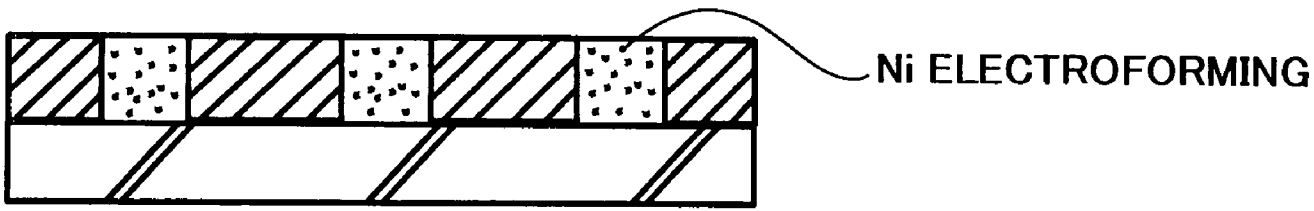
Figure 10C:
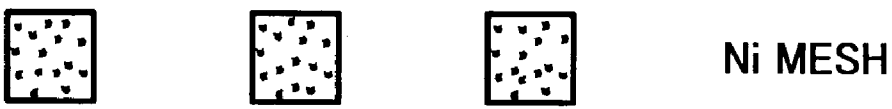

The mesh 146 consisting of a metal material can easily be manufactured by etching of a metal film (plate), electroforming (electrotyping), or the like. An example of a mesh-forming process using etching is depicted in FIGS. 9A through 9C. In this example, a hole pattern on a photomask that is micro-fabricated by laser machining on an SUS or other metal film is first formed by a photoresist, as depicted in FIG. 9A. Etching is then performed using $FeCl_3$ or the like and holes are formed, as depicted in FIG. 9B. The resist film is then peeled off and the mesh 146 is completed, as depicted in FIG. 9C. Mesh formation by electroforming may also be performed by a process such as is depicted in FIGS. 10A through 10C. The mesh 146 may also be formed by the braiding of fine-gauge wire.

The material used for the mesh 146 preferably demonstrates flexibility and resistance to abrasion. The shape employed for the holes in the mesh 146 may be round, elliptical, square, rectangular, star-shaped, irregular, or another shape. In the present copier, the holes in the mesh are elliptical, the size of the holes in the longitudinal direction is hole length L, and the size of the holes in the transverse direction is hole width W, as depicted in FIG. 9C.

The thickness T of the mesh 146 is preferably set to a range of 20 to 150 μm, more preferably 30 to 80 μm. The relation between the thickness T, length L, and width W is then preferably in the range $500\ W \geqq L$ and $W/5 \leqq T \leqq 3\ W$. This is because the mesh 146 has both a certain degree of high rigidity and a high open area ratio when the length L and width W of the holes satisfy the relation $500\ W \geqq L$. This is also because the smoothness and curvature machining of the metal film can be maintained when the relation between the width W and thickness T is $W/5 \leqq T \leqq 3\ W$. A bobbin shape or flat plate can thereby be made to maintain its straightness, contact deformation, and shape recovery on a functional level by the rigidity of the mesh 146.

The open area ratio of the mesh 146 is preferably in the range of 20 to 70%. It was confirmed by experimentation that the open area ratio must be in this range in order to maintain the discharge quantity without irregularities when the image being developed is solid black.

Figure 11A:
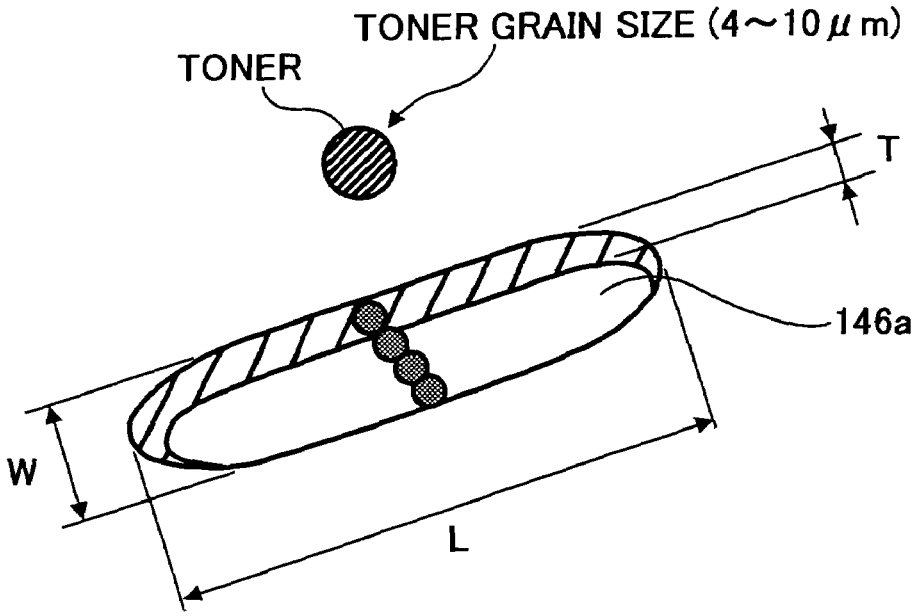
FIG. 11A is a schematic diagram depicting the relationship between the size of the toner and that of the openings in the same mesh.
Figure 11B:
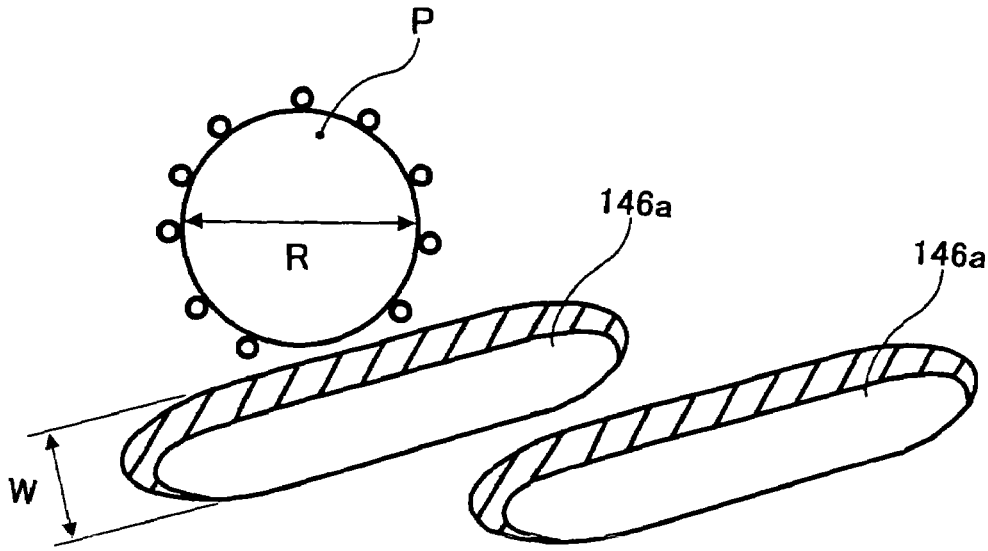
FIG. 11B is a schematic diagram depicting the relationship between the size of the friction charging particles and that of the same openings.

The hole 146*a* in the mesh 146 must be larger than the average particle size r of the toner and smaller than the average particle size R of the friction-promoting particles P. Furthermore, the relation between the toner depicted in FIGS. 11A and 11B and the friction-promoting particles P is preferably $6r \leqq W$ and $2\ W \leqq R$. By placing the average particle size r of the toner in the relation $6r \leqq W$, it is more difficult for the mesh to become clogged by toner clouds, and feeding of the toner that passes through the hole 146*a* can easily be maintained. Placing the average particle size R of the friction-promoting particles P in the relation $2\ W \leqq R$ also provides leeway in the particle size distribution of the friction-promoting particles P and prevents the friction-promoting particles P from passing through the holes in the mesh 146 even after being abraded and reduced in diameter through continued use.

Figure 12:
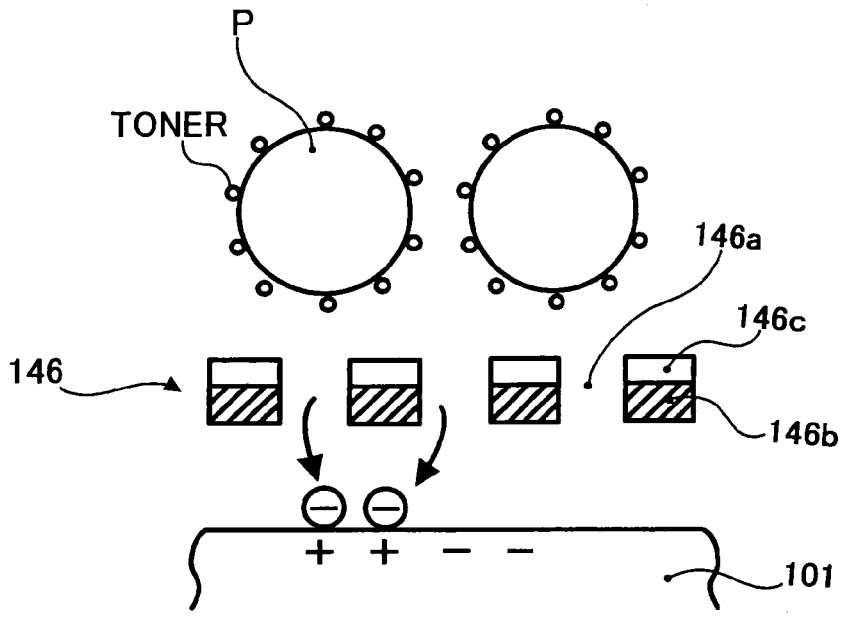
FIG. 12 is a cross-sectional diagram depicting the same mesh having a dual structure and the mixture.

In addition to the use of a metal material in the structure of the mesh 146, the surface thereof that faces the first electrostatic toner transport substrate 101 may be composed of a metallic layer 146*b* and the surface that contacts the mixture may have a dual structure composed of an organic resin 146*c* as depicted in FIG. 12. In a mesh 146 thus configured, the portion in contact with the friction-promoting particles P is composed of an organic material, making it possible to reduce the damage brought about by friction against the friction-promoting particles P, and to achieve greater durability than in the case of a metal material.

Figure 13:
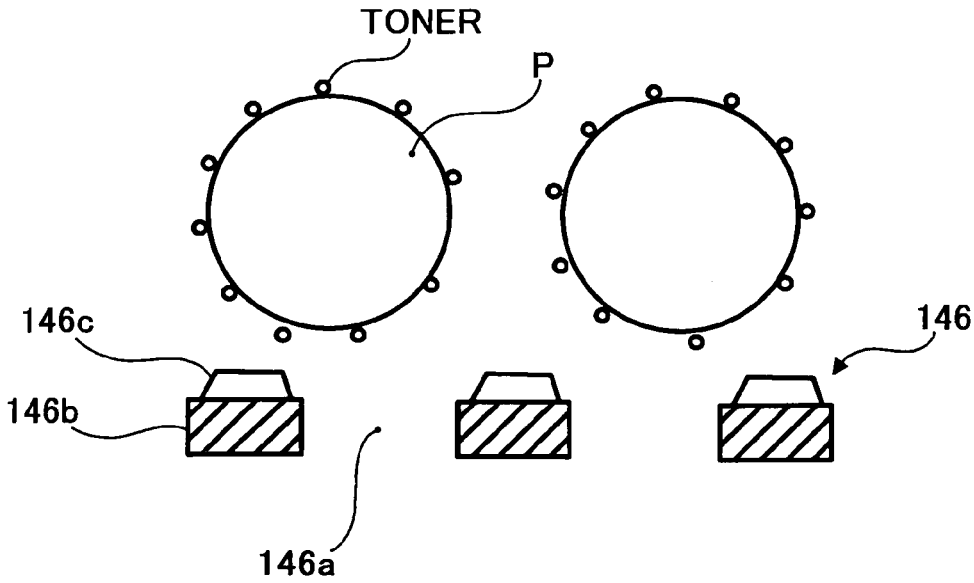
FIG. 13 is a cross-sectional diagram depicting the same mesh with chiseled openings and the mixture.

The hole 146*a* in the mesh 146 may have a structure that tapers off from the entrance side, at which the toner enters, toward the exit side, as depicted in FIG. 13. By adopting this structure, the electric flux lines can be reliably extended at the exit side from the metallic portion 146*b* of the inner wall of the hole 146*a* toward the first electrostatic toner transport substrate 101 (not pictured). The toner can thus be removed from the hole 146*a* with greater ease.

Figure 14:
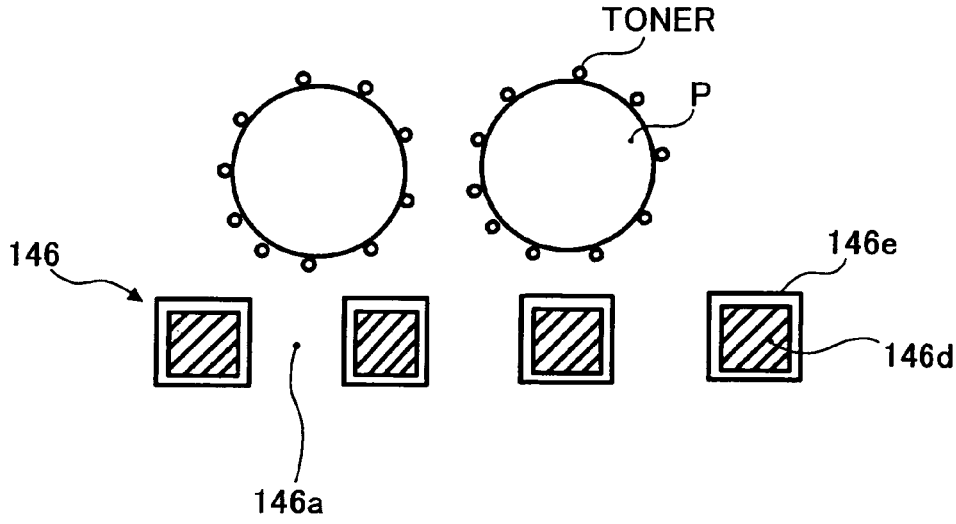
FIG. 14 is a cross-sectional diagram depicting the same mesh obtained by covering the surface of a base composed of a metal material with an insulating protective film, and the mixture.
Figure 15:
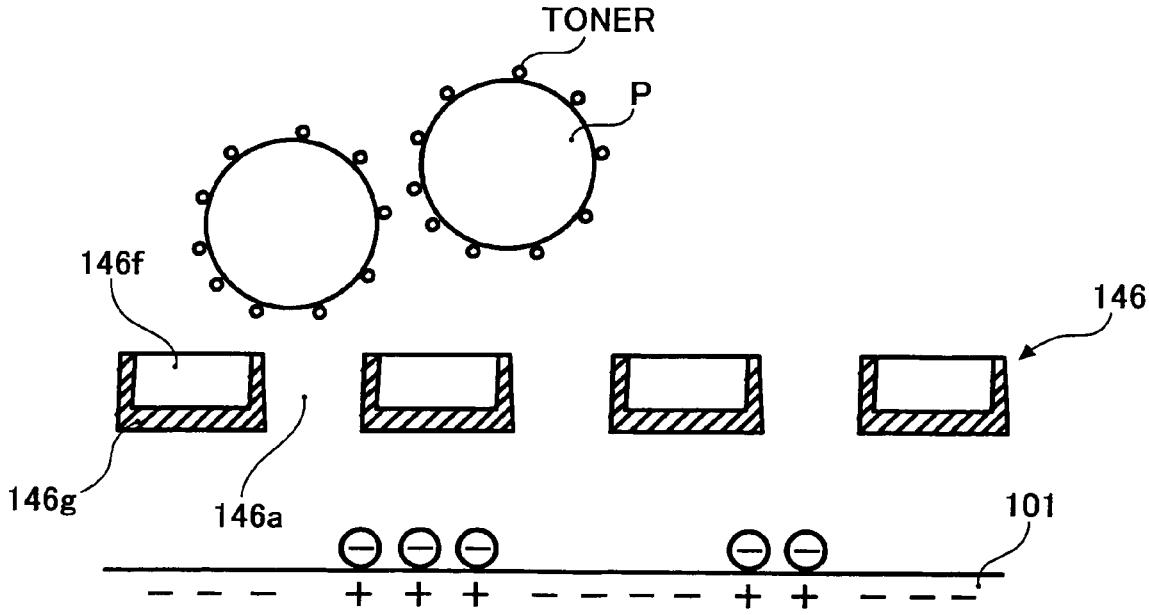
FIG. 15 is a cross-sectional diagram depicting the same mesh obtained by covering the external surface of a base composed of an organic resin material with a metal layer composed of a metal material, and the mixture.

A configuration may also be adopted for the mesh 146 whereby the surface of a base 146*d* composed of a metal material is covered by an insulating protective film 146*e* as depicted in FIG. 14. In this case, the protective film 146*e* consists of a thin film of 0.5 to 30 μm so as not to cause degradation of electric field strength, and $SiO_2$, SiN, $Ta_2O_5$, a polyimide, or another material may be used. In the mesh 146 thus configured, all of the surface that contacts the charged toner is covered by the insulating protective film 146*e*, whereby charge injection from the base 146*d* to the toner can be prevented, and the appropriate amount of charge can be maintained. The base 146*d* also does not come into contact with the mixture, so degradation of the mixture, especially the toner, can be reduced in comparison with coming in contact with metal parts.

The mesh 146 may also be configured such that a metal layer 146*g* composed of a metal material is covered by vapor deposition or electroforming on the external surface of a base 146*f* composed of an organic resin material. In this case, the organic resin material used in the base 146*f* preferably has a relatively strong ability to charge the toner. The metal layer 146*g* is a thin film of 0.5 to 5 μm, such that the toner in the hole 146*a* passes through the hole along the electric flux lines extending from this thin film toward the first electrostatic toner transport substrate 101. In the mesh 146 thus configured, the base 146*f* consists of an organic resin material, so good flexibility and elasticity are exhibited and good shape retention is maintained. The shape thereof can also be consistently maintained even when force is applied from the outside. Frictional charging of the toner can also be accelerated by maintaining contact with the toner in the hole 146*a*.

Figure 16:
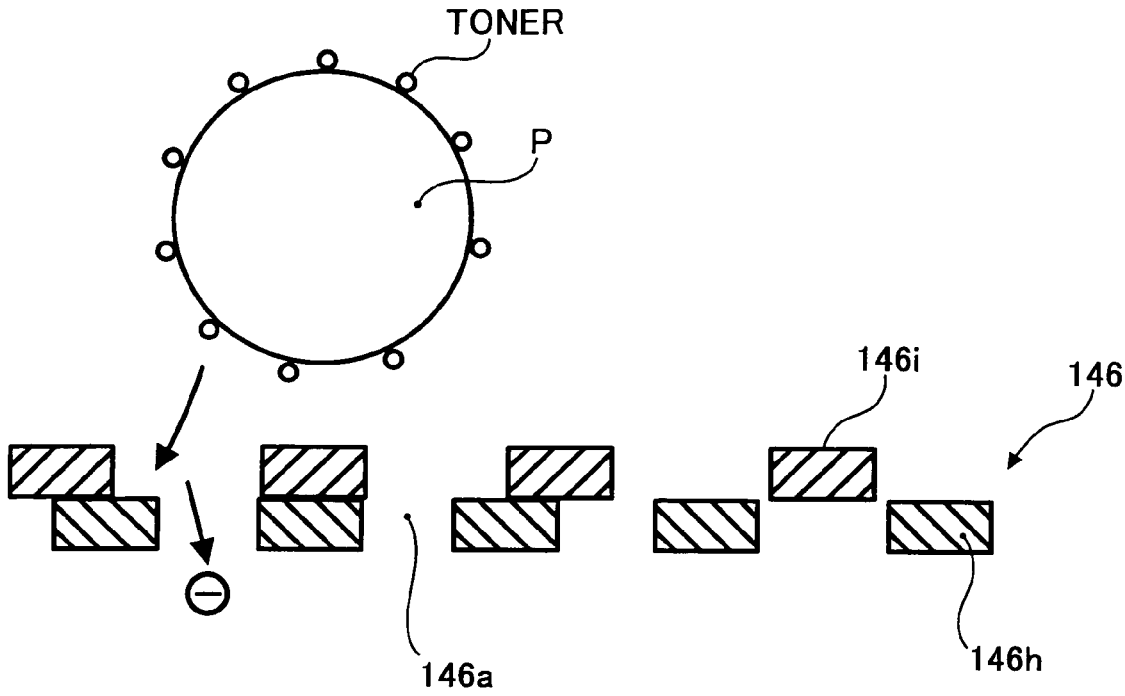
FIG. 16 is a cross-sectional diagram depicting the same mesh obtained by affixing a protective layer composed of an organic resin material onto the side facing the screw in the base composed of a metal material, and the mixture.

The mesh 146 may also be configured such that a protective layer 146*i* composed of an organic resin material is bonded to the surface of a base material 146*h* composed of a metal material that faces the screw as depicted in FIG. 16. In this case, the organic resin material used in the base material 146*h* preferably has a relatively strong ability to charge the toner. The method of bonding the two materials may involve heat joining or hot pressing. A mesh 146 in which an organic resin material is used is capable of demonstrating good flexibility, elasticity, and shape retention.

Figure 17:
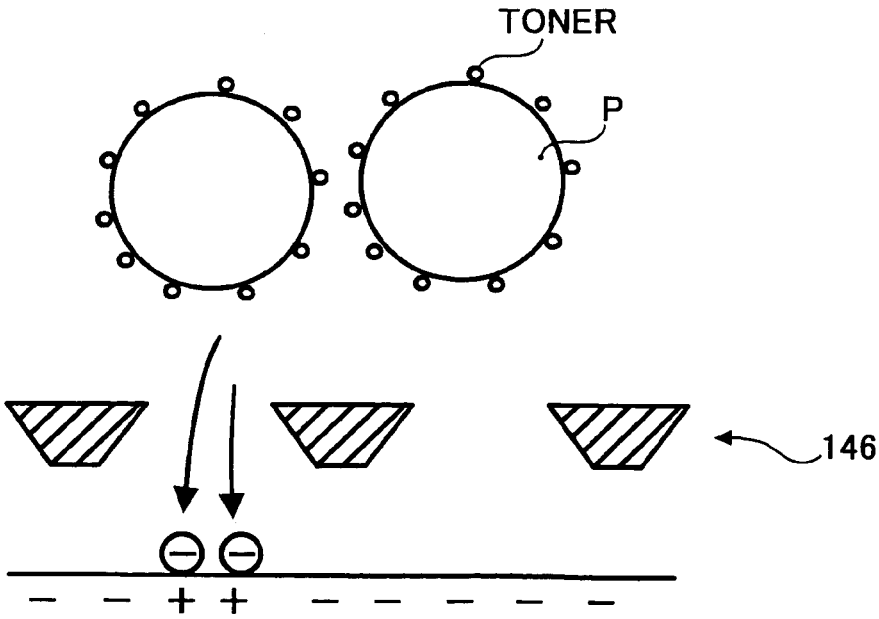
FIG. 17 is a cross-sectional diagram depicting the same mesh having openings formed with a tapered shape that widens from the entrance at which the toner comes in to the exit side thereof, and the mixture.

The mesh 146 may also be formed with a tapered shape that widens from the side at which the toner enters to the side at which it exits, as depicted in FIG. 17. The mesh may be inclined toward the external surface in a shape such that the hole diameter widens. The size of the holes is such that the relation between the length L, width W, and thickness T is in the range of $500\ W \geqq L$ and $W/5 \leqq T \leqq 3\ W$, and the relation between the average particle size r of the toner and the average particle size R of the friction-promoting particles P is $6r \leqq W$ and $2\ W \leqq R$, as described above. Adhesion of the toner to the inside wall can be minimized by forming an incline in the wall of the hole that widens toward the exit side.

The toner deemed appropriate for use in the present copier or the developing device 100 satisfies prescribed conditions.

This toner can be provided by being included in the copier or developing device 100 shipped to the customer, for example. Toner that satisfies the aforementioned conditions may also be packaged and shipped together with the main body of the copier or the developing device 100, for example. The product number, brand name, and other attributes of the toner that satisfies the aforementioned conditions may also be indicated on the main body of the copier, on the developing device 100, in the instruction manuals thereof, or the like, for example. Notice of the conditions, product number, brand name, and the like may also be given to a user in writing or as electronic data or the like, for example.

The shortest axis of the holes in the mesh 146 is set so that 80% or more of the particles in the toner grain size distribution thus specified can pass through the holes. Consequently, most of the toner particles in the mixture can be fed to the first electrostatic toner transport substrate 101. The size of the holes at the location of the shortest axis thereof is also preferably set to a value so as to place the toner passage ratio at less than 100%. This is because the particle size distribution of the toner participating in development can be sharpened and stable development performance can be obtained by preventing the passage of extremely large toner particles to a certain extent.

The friction-promoting substance that is specified as being appropriate for use by the present copier or developing device 100 has a friction-promoting particle composed of a non-magnetic material as the main component thereof. This specification may be established in the same manner as that of the toner. A non-magnetic material is generally easier to granulate than a magnetic material, and it is easier to reduce the particle diameter or to sharpen the particle size distribution, so the friction-promoting substance can have more consistent frictional charging performance. Reduced manufacturing cost can also be expected. An organic or inorganic material may be used as the non-magnetic material according to its charge performance. When a negatively charged toner is used, quartz ($SiO_2$), glass, polyacrylic resin, polyamide, nylon resin, melamine resin, or another material may be applied as a positively charged non-magnetic material. When a positively charged toner is used, Teflon (registered trademark) resin, polychloride resin, polyethylene resin, or the like may be applied as a negatively charged non-magnetic material. These materials do not require magnetic field control, and can therefore function as simple, highly durable carrier materials.

The shortest axis of the holes in the mesh 146 is set so that 80% or more of the toner particles in the grain size distribution of the friction-promoting particles, whose friction-promoting substance is composed of a non-magnetic material as the main component thereof specified as described above, cannot pass through the holes. Consequently, most of the toner particles in the mixture can be retained in the first storage chamber 142. The size of the holes at the location of the shortest axis thereof is also preferably set to a value so that less than 100% of the friction-promoting particle can pass through the holes. This is done for the reasons described below.

Specifically, the friction-promoting particles in the first storage chamber 142 and second storage chamber 143 are eventually reduced in size by the abrasion that accompanies stirring and transport of the mixture. Consistent toner-charging performance can be maintained by regularly refilling fresh friction-promoting substance as the friction-promoting particles that have been reduced in size to a certain degree gradually pass through the holes. Because they are also charged in the opposite polarity from the toner, the friction-promoting particles are transferred on the surface in the opposite direction from that of the toner when they pass through the holes and are fed to the surface of the first electrostatic toner transport substrate 101. Consequently, transport thereof to the development area is extremely rare, and these particles usually continue to be gradually pulverized over time by hopping while accumulating in the vicinity of the toner feeding unit 140. It is also possible that a portion of the particles after pulverization is transported toward the development area, but because the particles are extremely fine, adverse effects on the image are slight.

As described above, the holes in the mesh 146 are non-circular and have an elliptical shape with major and minor axes. The open area ratio of the mesh 146 with such holes can be easily adjusted to within a range of 20 to 80% by arranging the holes and selecting the appropriate pitch. An open area ratio of 40 to 60% is preferred from the perspective of rigidity of the mesh 146 and toner separation efficiency.

Figure 18:
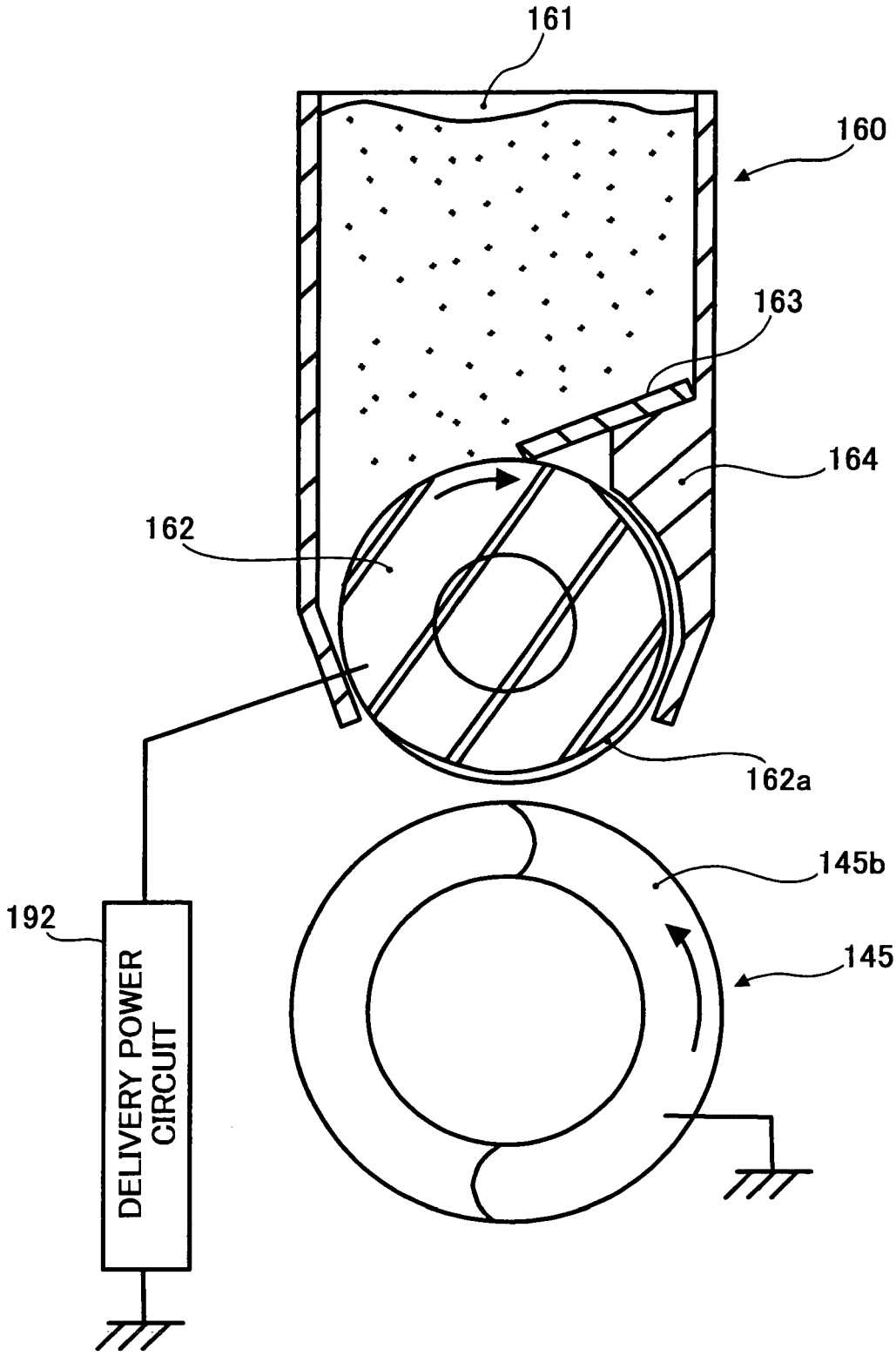
FIG. 18 is a diagram depicting the toner refill unit together with the second transport screw of the same toner feeding unit in the same copier.
Figure 19:
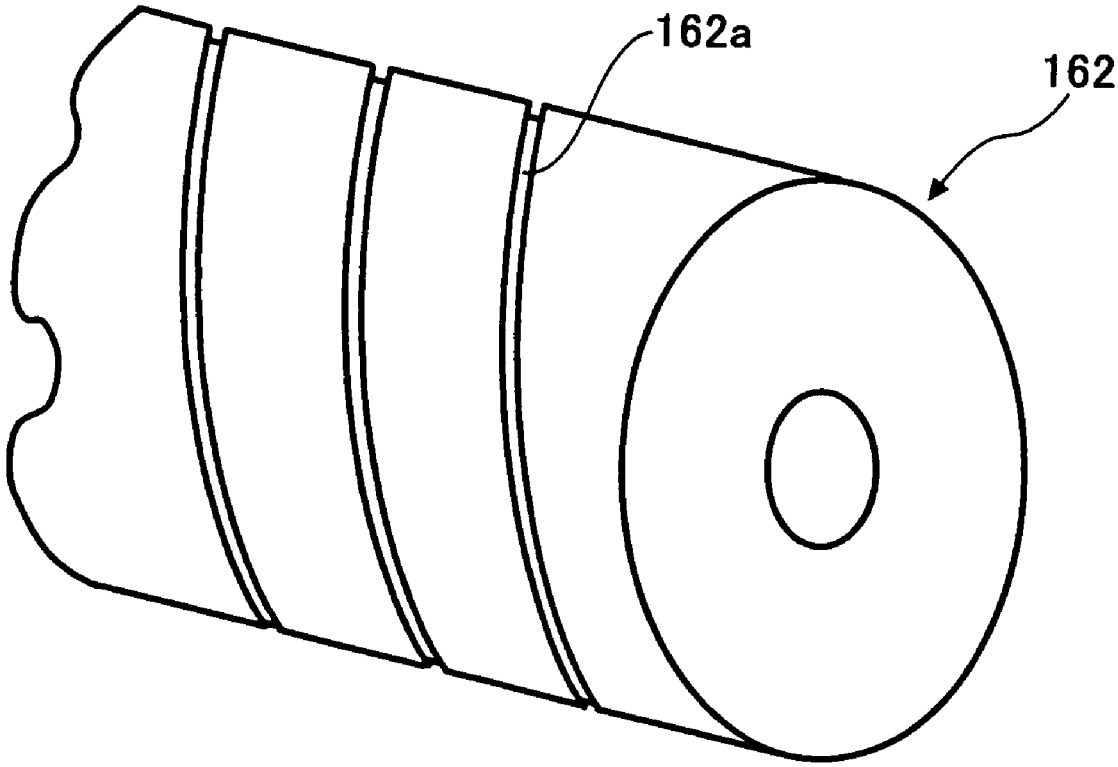
FIG. 19 is an oblique view depicting a portion of the delivery roller of the same toner refill unit.

FIG. 18 is a magnified structural diagram depicting the toner refill unit 160 together with the second transport screw 145 of the toner feeding unit 140. In this figure, the toner refill unit 160 has a toner container 161 for holding the toner used for refilling, a delivery roller 162 for delivering toner from inside the toner container to the second transport screw 145 of the toner feeding unit, a scraping blade 163, and the like. The delivery roller 162 is composed of metal or another material with high electrical conductivity. This delivery roller is disposed underneath the toner container 161 such that a portion of the peripheral surface thereof is exposed from an opening provided to the casing 164, and is rotated by a driving device (not pictured) in the clockwise direction in the figure. As depicted in FIG. 19, a helical groove 162*a* cut in a spiral shape is formed in the peripheral surface of the delivery roller 162. This helical groove 162*a* is formed with a width of 1 mm and a depth of 0.2 mm, and is at the same pitch as the helical thread 145*b* of the second transport screw 145 below the delivery roller 162. The delivery roller 162 and the second transport screw 145 are also rotated at the same peripheral speed so that the helical groove 162*a* and the helical thread 145*b* are continually facing each other.

In FIG. 18 described above, one end of the scraping blade 163 is fixed to the casing 164 while the other end is free and unattached. This free end is disposed so as to come into contact with the peripheral surface of the delivery roller 162. The toner stored in the toner container 161 is held down on the delivery roller 162 by its own weight, and a portion thereof is filled into the helical groove 162*a*. Excess toner adhering to the peripheral surface (non-grooved portion) of the delivery roller 162, with toner thus filled into the helical groove 162*a* thereof, is scraped off in the process of clockwise rotation in the figure by the scraping blade 163 composed of urethane rubber. The excess toner then exits through the opening in the casing 164 and travels to the refill area that is opposite from the second transport screw 145 located below. A prescribed gap is maintained between the peripheral surface of the delivery roller 162 and the leading end of the helical thread 145*b* of the second transport screw 145.

Figure 20:
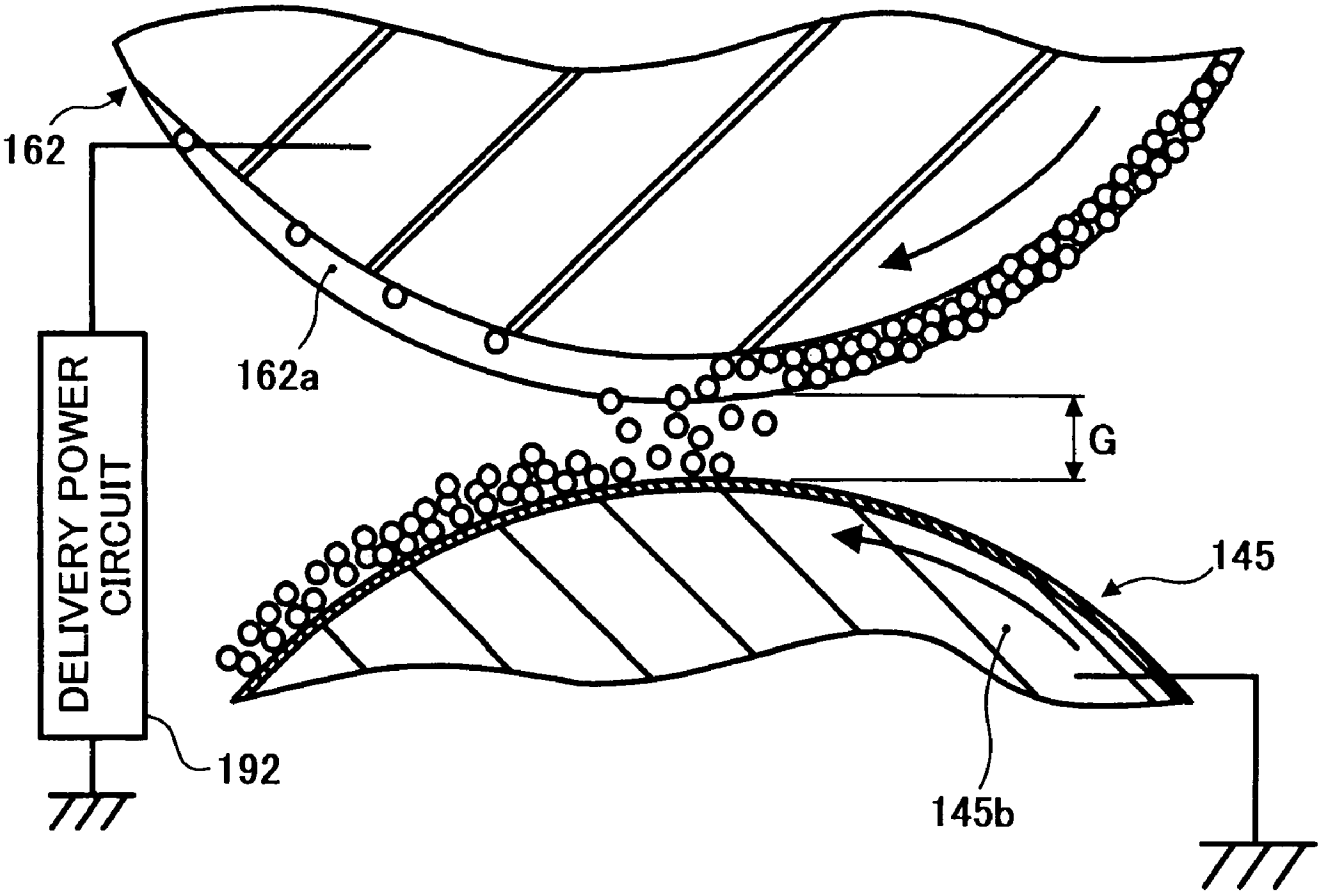
FIG. 20 is a diagram depicting the peripheral structure of the refill area formed between the same toner refill unit and the same toner feeding unit.

FIG. 20 is an enlarged view depicting the structure around the refill area formed between the toner refill unit 106 and toner feeding unit 140. In the figure, the base surface of the second transport screw 145 composed of aluminum or another metal is covered with a protective layer composed of an organic resin material. The metal base is also electrically grounded. On the other hand, a delivery power circuit 192 whose output is controlled by a controller (not pictured) is connected to the delivery roller 162 composed of a metal material. The delivery roller 162 takes on a negative potential of the same polarity as the charge polarity of the toner by means of the output from the delivery power circuit 192. This potential has a value of −1.0 kV, for example.

The toner that is filled into the helical groove 162*a* of the delivery roller 162 is transported toward the refill area in conjunction with the rotation of the delivery roller 162. A strong electric field is formed in the refill area between the delivery roller 162 having a potential of −1.0 kV and the helical thread 145*b* of the grounded second transport screw 145. The toner in the helical groove 162*a* that has reached the refill area receives this strong electric field, a negative charge is introduced from the delivery roller 162, and the toner is extracted from the helical groove 162*a*. The toner then passes through the gap G and adheres to the helical thread 145*b* of the second transport screw 145. Toner is thereby refilled into the second storage chamber 143 of the toner feeding unit 140 from the toner refill unit 160. The refilled toner is stirred and transported toward the first storage chamber 142 while being mixed into the mixture in the second storage chamber. Frictional charging of the toner is further accelerated by this process.

The amount of charge on the toner (Q/M) directly after refilling varies according to the type of toner, and according to experimentation by the inventors, this value was −2 to −7 μC/g. This value is still inadequate to cause the toner to participate in image development, but is adequate to cause the friction charged particles in the mixture to become attached by static electricity. The amount of charge on the toner in the mixture transported to the top of the mesh 146 had increased up to −15 to −30 μC/g, which was a value whereby the toner could adequately participate in development. For reference, even when toner that was very slightly charged to −1 μC/g was manually placed in the second storage chamber of the toner feeding unit 140, there was almost not spillage of toner from the mesh 146. Although very slight spillage was observed, it was at a practically insignificant level. However, the amount of spillage was found to increase sharply when the charge became smaller than the threshold of −1 μC/g. Consequently, spillage can be effectively minimized if the toner can be charged to an absolute value of 1 μC/g or higher prior to refilling. For further reference, the absolute value of the toner charge at which spillage was completely eliminated was 3 μC/g.

In FIG. 18 described previously, the delivery roller 162 functions as a delivery device for delivering the toner in the toner container 161 to the second transport screw 145 of the toner feeding unit 140, which is the refill destination. The combination of the delivery roller 162 and the delivery power circuit 192 also functions as a charging device for charging the toner prior to delivery by the delivery device.

Modifications of the copier pertaining to the present embodiment will next be described.

Figure 21:
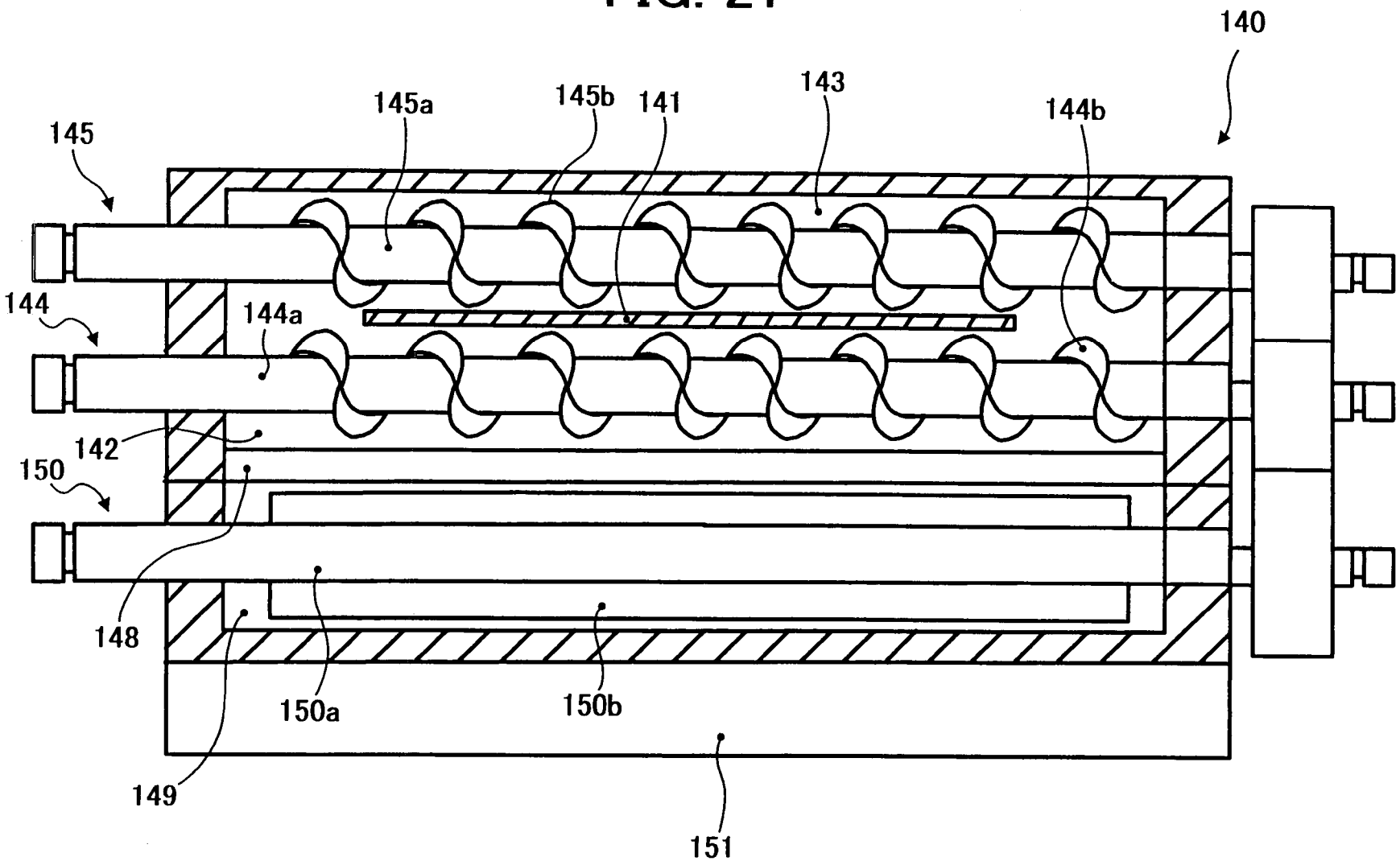
FIG. 21 is a planar cross-sectional diagram depicting the structure of the toner feeding unit in the device pertaining to Modification 1.
Figure 22:
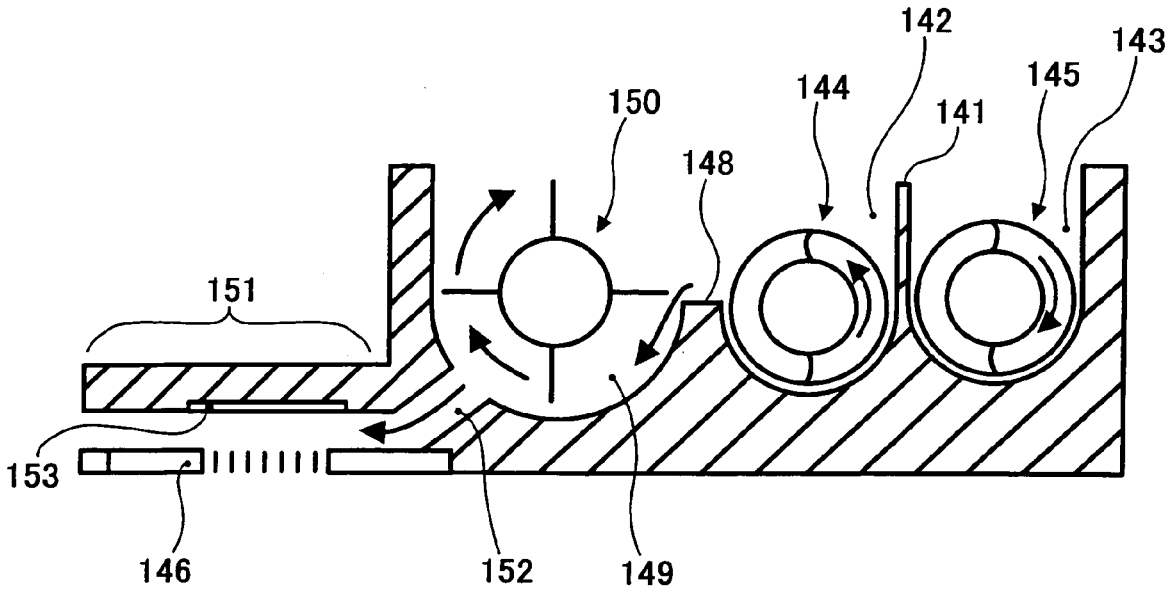
FIG. 22 is a transverse cross-sectional diagram depicting the structure of the same toner feeding unit.

The structure of the toner feeding unit 140 pertaining to Modification 1 is depicted in FIG. 21. A transverse cross-sectional view thereof is also depicted in FIG. 22. In these figures, the toner feeding unit 140 has a first storage chamber 142 and a second storage chamber 143, as well as a third storage chamber 149 consisting of a mixture storage unit for storing the mixture, and a mixture channel unit 151 connected thereto. The bottom panel of the first storage chamber 142 is not provided with a mesh 146. Instead, the mesh 146 is provided to the bottom panel of a mixture channel 151 that is a connecting unit. The third storage chamber 149 is connected to the first storage chamber 142 on the opposite side from the second storage chamber 143. The barrier between the first storage chamber 142 and the second storage chamber 143 consists of an overflow barrier 148 that is lower than the dividing wall 141 that divides the first storage chamber 142 from the second storage chamber 143. A portion of the mixture transported in the axial direction by the first transport screw 144 in the first storage chamber 142 crosses over the overflow barrier 148 and enters into the third storage chamber 149.

In the third storage chamber 149, a stirring paddle 150 having a rotating shaft 150*a* and a plurality of paddles 150*b* disposed on the peripheral surface thereof so as to extend in the axial direction is provided so as to be rotated by a driving device (not pictured) in the clockwise direction in the figure. The mixture that has entered into the third storage chamber 149 from the first storage chamber 142 falls under its own weight into an inclined connecting portion 152 provided near the bottom of the third storage chamber 149 and goes into a mixture channel 153 while being stirred by the stirring paddle 150 in the direction of rotation. A counter electrode 153 that acts as part of the channel ceiling is disposed via a prescribed gap on the side opposite from the mesh 146, which serves as the bottom surface of the channel in the mixture channel 151. The mixture that has entered the mixture channel 151 passes through the space between the counter electrode 153 and the mesh 146, whereupon the toner adhering by static electricity to the surface of the friction-promoting particles separates from that surface by means of the potential difference between the counter electrode and the mesh and jumps toward the mesh 146. The toner is then separated from the friction-promoting particles by passing through the holes in the mesh 146 and is fed to the first electrostatic toner transport substrate 101 (not pictured). The mixture that has passed through the mixture channel 153 is returned to the second storage chamber 143 by way of a circulating device (not pictured).

In Modification 1 thus configured, by providing the counter electrode 153 separately from the stirring members consisting of the transport screw, stirring paddle, and the like, the toner can be separated by the mesh 146 even in an area of the mixture storage unit in which a stirring device is not provided.

Figure 23:
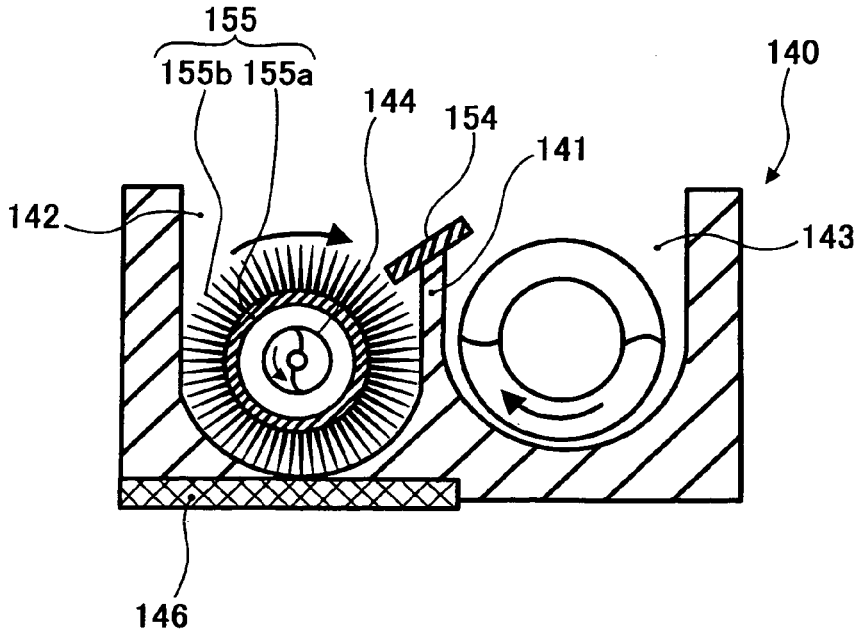
FIG. 23 is a transverse cross-sectional diagram depicting the structure of the toner feeding unit of the device pertaining to Modification 2.
Figure 24:
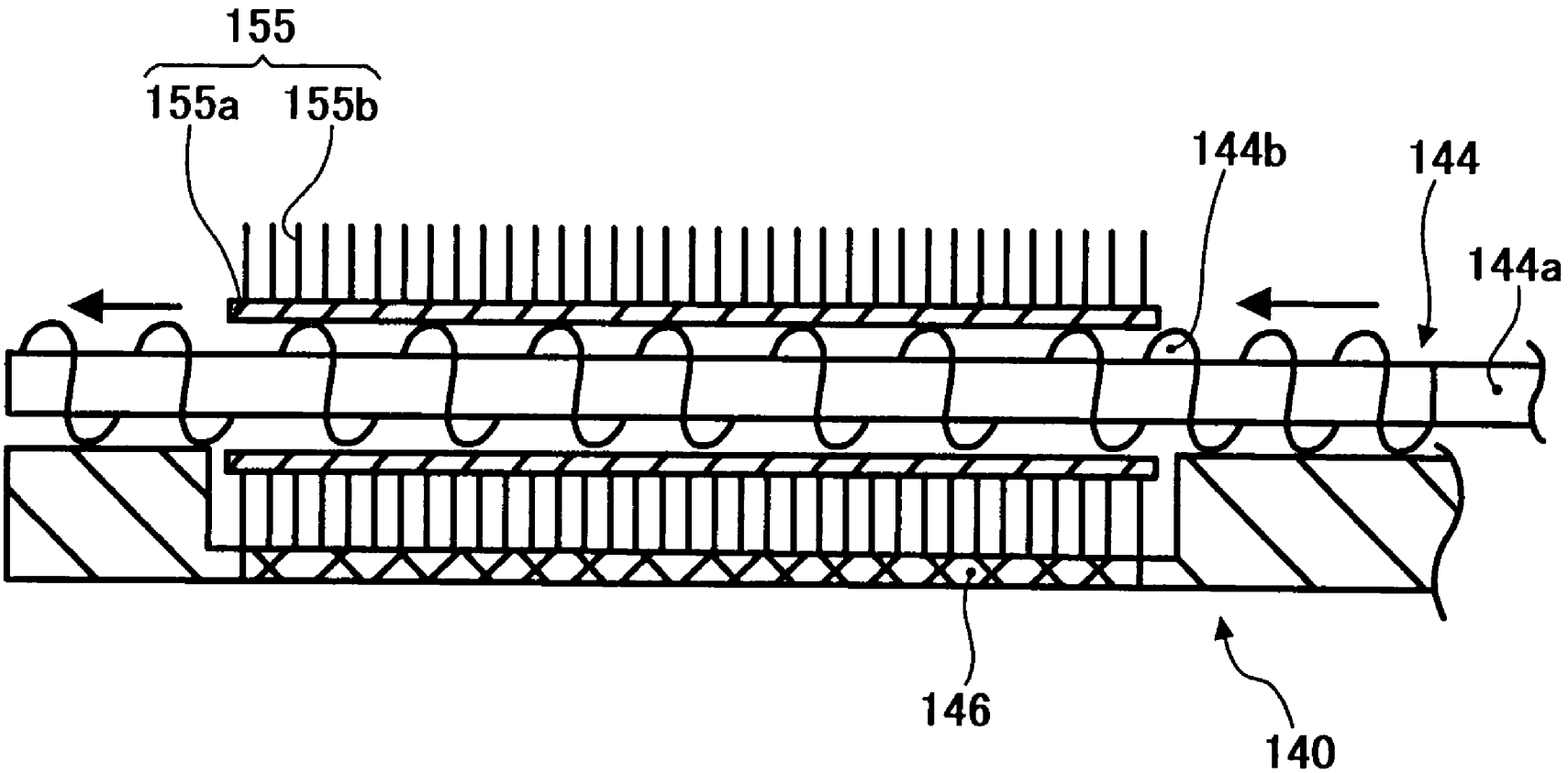
FIG. 24 is a longitudinal cross-sectional diagram depicting the structure of the same toner feeding unit.

The structure of the toner feeding unit 140 pertaining to Modification 2 is depicted in FIG. 23. A longitudinal cross-sectional view thereof is also depicted in FIG. 24. In Modification 2, the first transport screw 144 is enclosed in a rotating brush 155 inside the first storage chamber 142. The rotating brush 155 has a rotating cylinder 155*a* provided with a plurality of holes (not pictured), and a plurality of electrically conductive raisings 155*b* that stand uniformly on the external peripheral surface thereof in the area not provided with holes. Of the total area in the axial direction of the first transport screw 144, the central area is encapsulated by the rotating cylinder 155*a* of the rotating brush 155. Both ends in the axial direction are exposed and not contained within the rotating cylinder 155*a*, but protrude such that the casing turns upward toward the exposed portions. The mixture is held in the exposed portion of the screw by means of this protrusion.

In FIG. 24, the mixture that has entered the first storage chamber 142 from the second storage chamber 143 (not pictured) is transported from the right-hand side in the figure to the left-hand side with the supplemental aid of the right-hand end of the first transport screw 144 in the figure. By this process, the mixture enters into the rotating cylinder 155*a* of the rotating brush 155 and spills in small portions from the plurality of holes (not pictured) provided to the cylinder. The spilled mixture is stirred with the supplementary aid of the electrically conductive raisings 155*b* of the rotating brush 155. During this stirring, the toner adhering by static electricity to the surface of the friction-promoting particles separates from the friction-promoting particles by means of the potential difference between the electrically conductive raisings 155*b* and the mesh 146 and jumps toward the mesh 146. The toner is then separated from the friction-promoting particles by passing through the holes in the mesh 146 and is fed to the first electrostatic toner transport substrate 101 (not pictured).

More toner can be separated and fed to the first electrostatic toner transport substrate 101 in Modification 2 thus configured than in the copier pertaining to the present embodiment. Specifically, in the copier pertaining to the embodiment, a comparatively strong electric field between the first electrostatic toner transport substrate 101 and the mesh 146 is formed at the location of the helical thread 144*b*, at which the gap between those two components is the smallest. However, the gap becomes the same as the distance between the rotating shaft 144*a* of the screw and the mesh 146 at the space between protrusions, and the gap becomes much larger, so the electric field strength weakens considerably. The majority of the mixture held by the screw resides between the protrusions, so a strong electric field is only able to act on a portion of the toner. In contrast, electrically conductive brushes 155*b* are regularly erected in the area with no holes in the peripheral surface of the rotating cylinder 155*a* of the rotating paddle 155 in the device of Modification 2, and the number of locations that provide the shortest distance between the leading end of the brushes and the mesh 146 is greatly increased. Consequently, the time during which the toner is in a strong electric field can be increased and more toner can be separated and fed.

Figure 25:
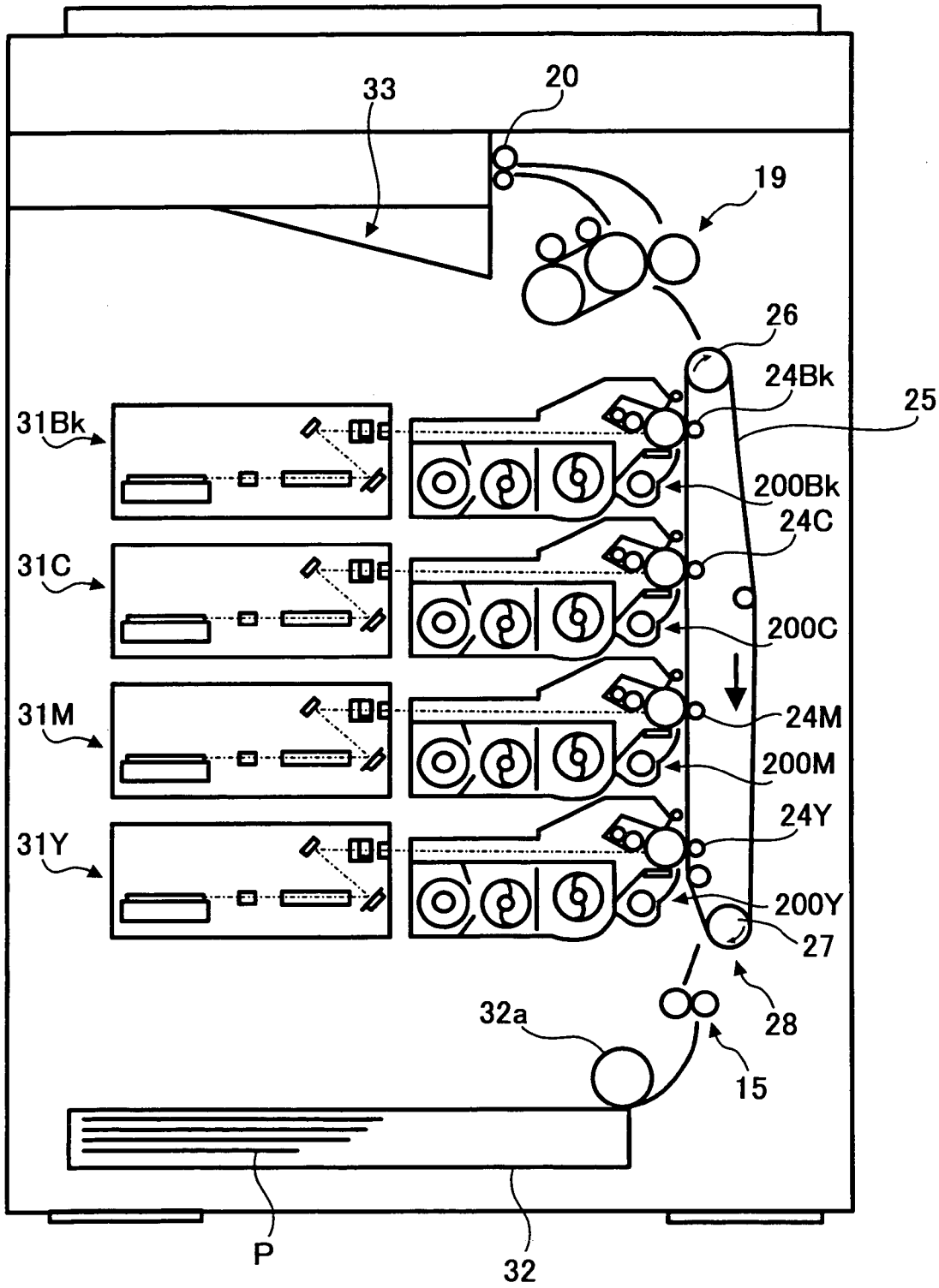
FIG. 25 is a schematic structural diagram depicting the device pertaining to Modification 3.

The basic structure of the image-forming device pertaining to Modification 3 is depicted in FIG. 25. The device of Modification 3 is for forming a full-color image using four colors of black (Bk), yellow (Y), cyan (C), and magenta (M), and a process unit 200 for each color Y, M, C, and Bk is provided thereto. The process units for each color have substantially the same structure, so the symbols Y, M, C, and Bk are omitted as necessary in the description.

Figure 26:
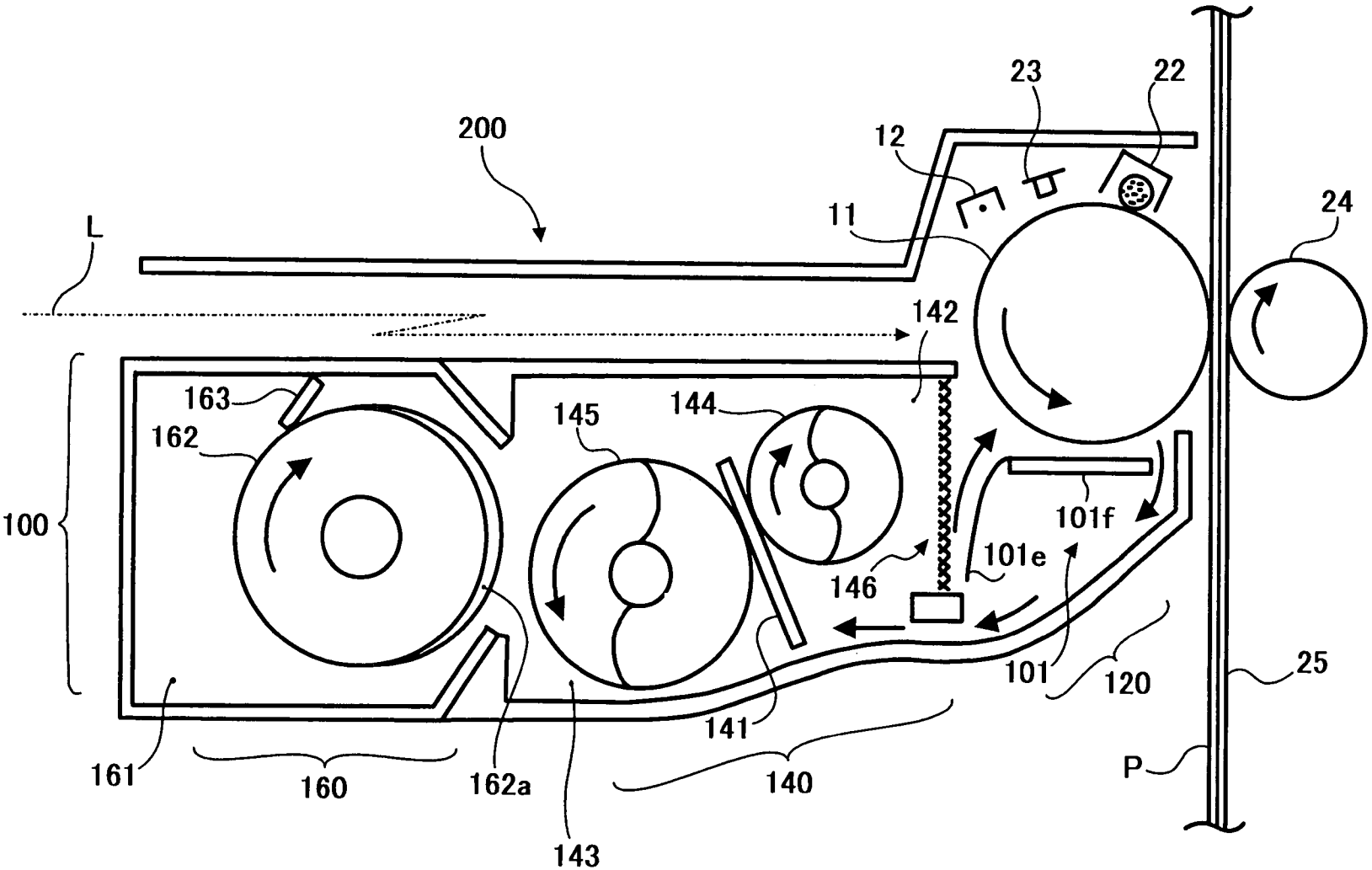
FIG. 26 is a diagram depicting one configuration of the process unit of the device of the same Modification 3.

As depicted in FIG. 26, the photoreceptor 11, drum charger 12, charge-removing lamp 23, cleaning device 22, and developing device 100 are integrated as a unit in the process unit 200, which can be attached to and detached from the main body of the copier. The process unit is replaced at the end of its service life.

The toner filled into the helical groove 162*a* of the delivery roller 162 of the toner refill unit 160 is refilled to the second transport screw 145 of the toner feeding unit 140 by charge injection in the developing device 100 in the same manner as in the copier pertaining to the present embodiment. The toner thus fed is transported to the first storage chamber 142 by the rotation of the second transport screw 145 while being incorporated into the mixture in the second storage chamber 143. After being transferred to the first transport screw 144 of the first storage chamber 142, the toner is separated from the mixture by the mesh 146 and fed to the toner transport unit 120. In the toner transport unit 120, only the first electrostatic toner transport substrate 101 for transporting the toner from the toner feeding unit 140 to the photoreceptor 11 is provided among the two electrostatic toner transport substrates provided to the copier of the embodiment. This first electrostatic toner transport substrate 101 has a rigid part 101*f* and a flexible part 101*e*. The base material of the rigid part 101*f* is composed of a material with comparatively high rigidity that does not easily bend and extends in substantially horizontal fashion so as to face the photoreceptor 11 at the bottom thereof.

On the other hand, a flexible material is used in the base material of the flexible part 101*e*, which bends downward in the vertical direction from the rigid part 101*f* and faces the mesh 146 of the toner feeding unit 140. The toner that has passed through the mesh 146 is fed to this flexible part 101*e*, and is then transported against gravity from the bottom in the figure to the top thereof while hopping. After then being transferred from the flexible part 101*e* to the rigid part 101*f*, the toner is transported while hopping to the development area in the horizontal direction and participates in development. Toner that is transported to the recovery area without participating in development spills from the end of the rigid part 101*f* and is then returned down along the taper in the bottom panel of the developing device 100 casing into the second storage chamber 143.

In FIG. 25 described previously, optical writing devices 31Y, M, C, and Bk are disposed on the left side of the process units 200Y, M, C, and Bk, respectively, and the photoreceptors of the corresponding process units are scanned by a light beam. Specifically, light scanning is performed using a semiconductor laser, collimating lens, polygon mirror, or other light focusing device, optical system used for scanning and imaging, or the like for emitting a laser beam that is adjusted according to color image data sent from a scanner device, (not pictured).

A transfer unit 28 for moving the paper transport belt 25 endlessly is disposed to the right side of the process units 200Y, M, C, and Bk. The transfer unit 28 tensions the paper transport belt 25 by means of a drive roller 26 that is rotated by a driving device (not pictured), a driven roller 27, and four transfer rollers 24Y, M, C and Bk. The paper transport belt 25 is moved endlessly in the clockwise direction in the figure in conjunction with the rotation of the drive roller 26. The transfer rollers 24Y, M, C and Bk each sandwich the paper transport belt 25 and form a transfer nip with the photoreceptors of the process units 200Y, M, C, and Bk.

A paper feeding cassette 32 containing a bundle of transfer paper is disposed at the bottom of the main body of the copier, and the topmost sheet of transfer paper P on the transfer paper bundle is sent down the paper feeding channel at a prescribed timing by the rotation of the paper feeding roller 32*a*. The transfer paper P thus sent is fed to the paper transport belt 25 via a pair of registering rollers 15. The paper transport belt 25 moves endlessly while retaining the transfer paper P thus fed on the surface thereof, and sends the transfer paper in sequence to the transfer nips used for Y, M, C, and Bk. Y, M, C, and Bk toner images are thereby transferred over each other in order on the transfer paper P, and a full-color image is formed. The transfer paper P on which a full-color image is formed in this manner is transferred from the paper transport belt 25 to a belt fixing-type fixing device 19, and is then stacked on an external stacking unit 33 via a pair of paper delivery rollers 20.

By means of the device of Modification 3 thus configured, a full-color image can be formed by superposing four-color toner images on the transfer paper P by means of the four process units 200Y, M, C, and Bk.

Figure 27:
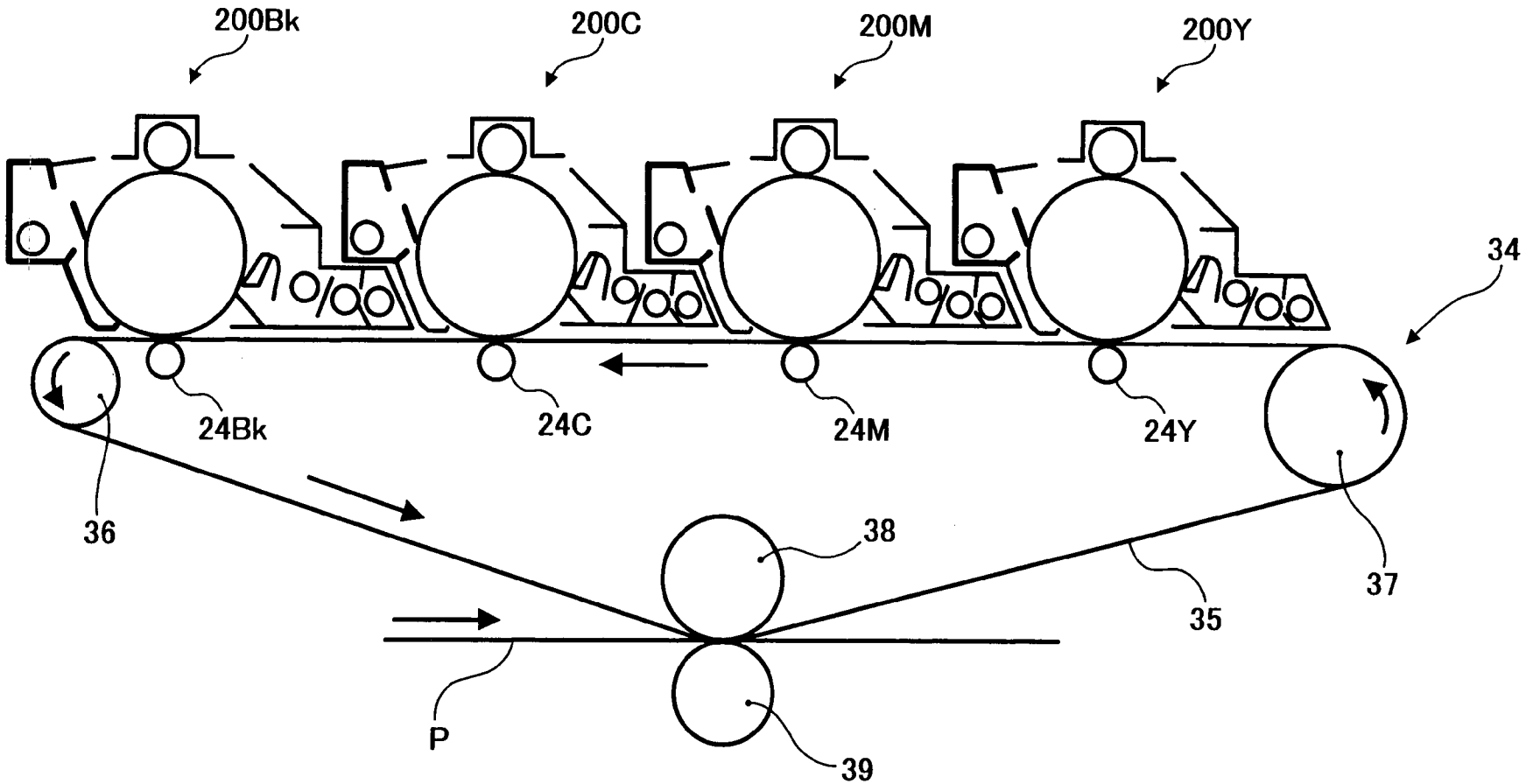
FIG. 27 is a diagram depicting the basic structure of the device pertaining to Modification 4.

The basic structure of the image-forming unit of the image-forming device pertaining to Modification 4 is depicted in FIG. 27. The device of Modification 4 is provided with a transfer unit 34 for endlessly moving the transfer belt 35 while applying tension along its length in the horizontal direction. Four process cartridges 200Y, M, C, and Bk are also disposed in parallel fashion at the top of the transfer unit 34. The symbols Y, M, C, and Bk will be omitted as necessary in the description hereinafter.

Figure 28:
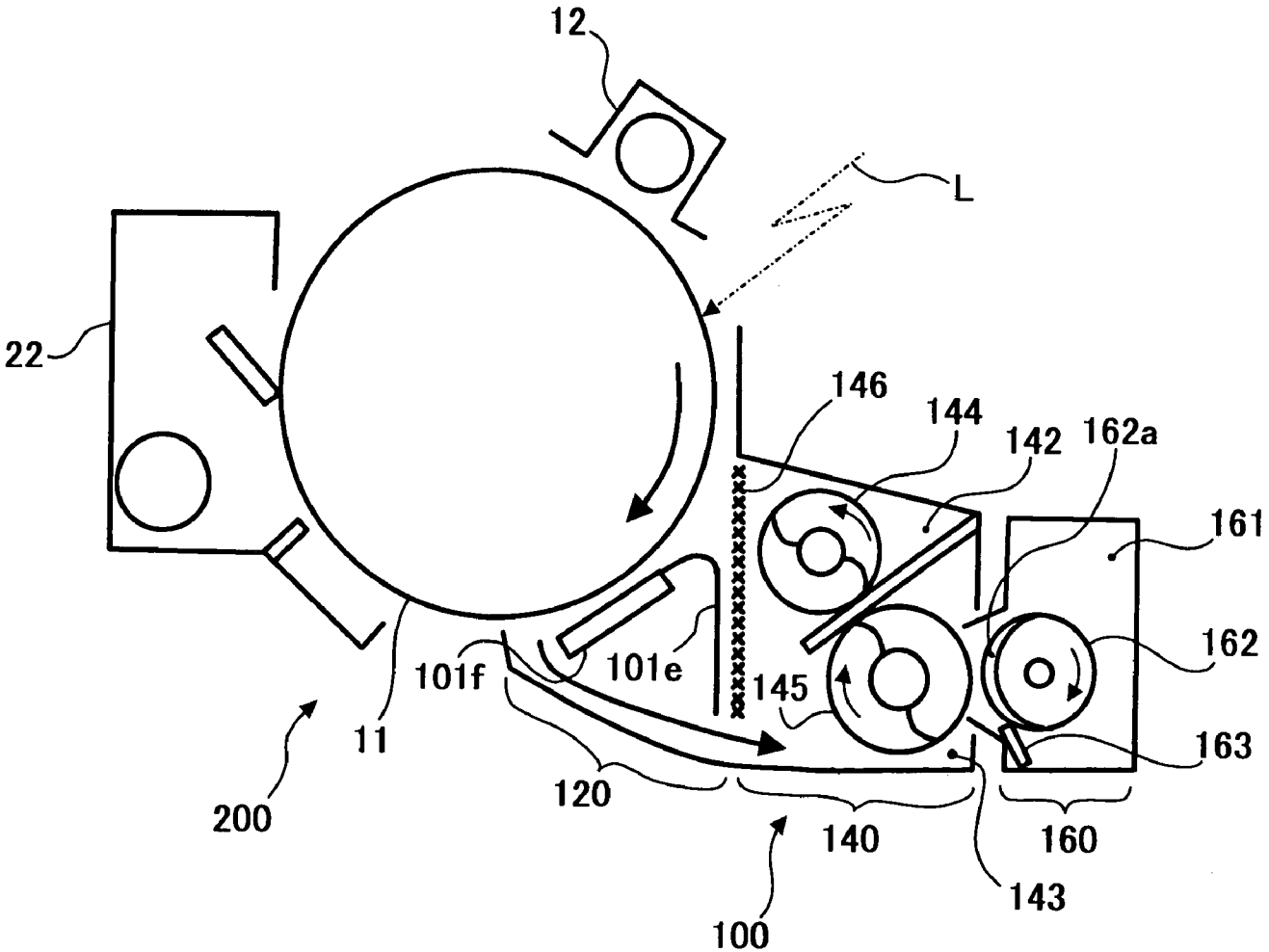
FIG. 28 is a diagram depicting one configuration of the process unit of the device of the same Modification 4.

In the process cartridge 200, the photoreceptor 11, drum charger 12, developing device 100, cleaning device 22, and the like form an integral unit and are configured so as to be capable of attaching to and detaching from the main body of the copier, as depicted in FIG. 28.

The toner filled into the helical groove 162*a* of the delivery roller 162 of the toner refill unit 160 is refilled to the second transport screw 145 of the toner feeding unit 140 by charge injection in the developing device 100 in the same manner as in the copier pertaining to the present embodiment. The toner thus refilled and incorporated into the mixture passes sequentially through the second storage chamber 143 and first storage chamber 142, and is then separated from the mixture by the sifting action of the mesh 146 and fed to the toner transport unit 120. The toner is transported to the development area while hopping due to the EH effect on the surface of the first electrostatic toner transport substrate 101 having a flexible part 101*e* and a rigid part 101*f* in the same manner as the device of Modification 5, and the electrostatic latent image on the photoreceptor 11 is developed. The toner that did not participate in development drops from the end of the first electrostatic toner transport substrate 101 and is then returned to the first storage chamber 142 by its own weight along the taper in the bottom panel of the toner transport unit 120.

In FIG. 27 described above, the transfer unit 34 tensions the transfer belt 35 by means of the drive roller 36, the driven roller 37, the secondary transfer backup roller 38, and the four transfer rollers 24Y, M, C and Bk. The transfer belt 35 is also moved endlessly in the counterclockwise direction of the figure by the drive roller 36 rotated by a driving device (not pictured). The four transfer rollers 24Y, M, C and Bk each sandwich the transfer belt 35 between the photoreceptors of the process cartridges 200Y, M, C, and Bk and form a primary transfer nip. The toner images developed on the photoreceptors of the process cartridges 200Y, M, C, and Bk are stacked and transferred on the transfer belt 35 in the primary transfer nip to form a four-color toner image.

The four-color toner image is secondarily transferred in one batch onto the transfer paper P transported at the appropriate timing in the secondary transfer nip in which the transfer belt 35 is sandwiched between the secondary transfer backup roller 38 and the secondary transfer roller 39. A full-color image is thus created in combination with the white of the transfer paper P.

A full-color image can also be formed in the device of Modification 4 thus configured, by stacking the four colored toner images formed by the four process units 200Y, M, C, and Bk.

Figure 31:
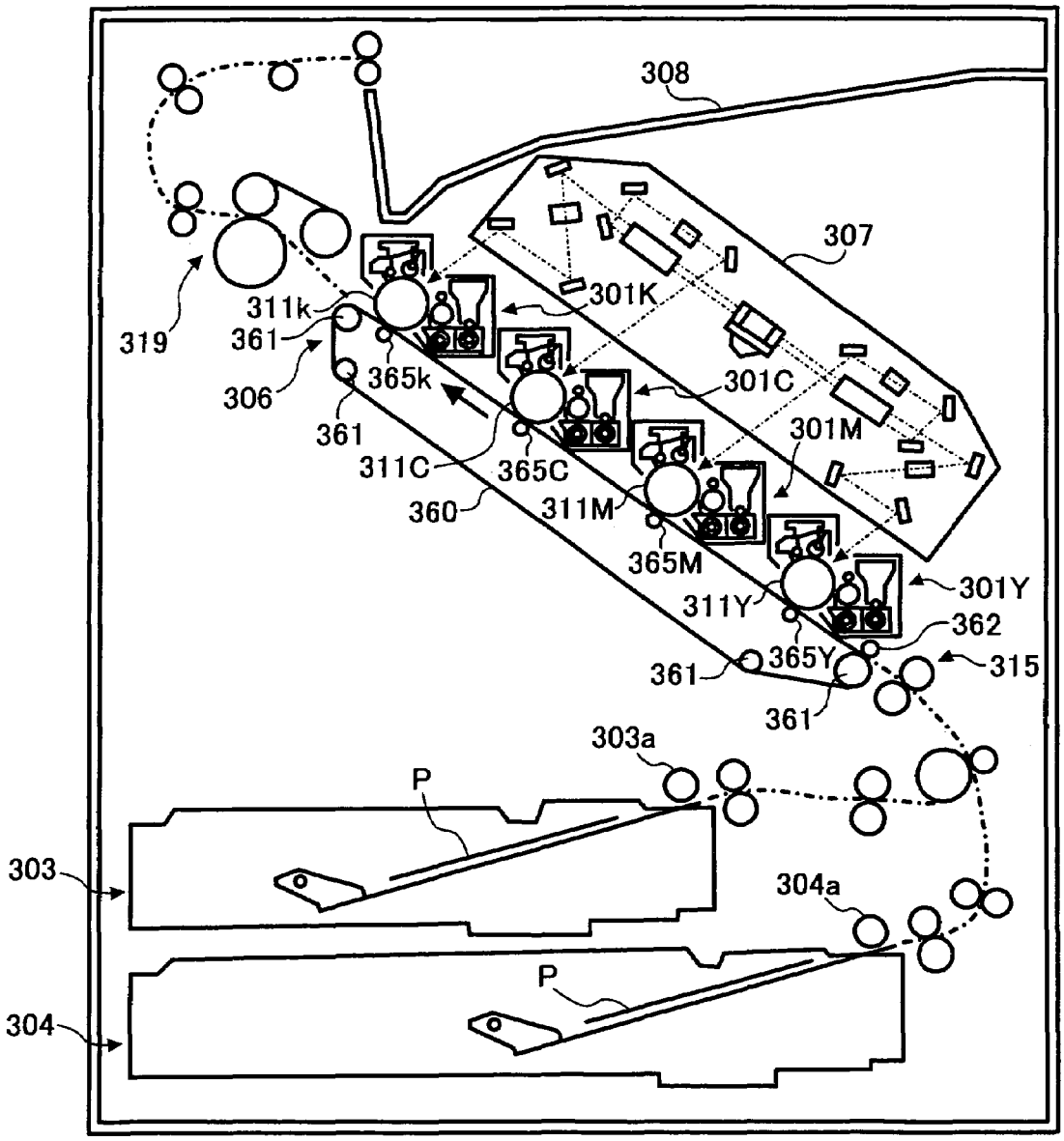
FIG. 31 is a diagram depicting the basic structure of the device pertaining to Modification 5.

The basic structure of the image-forming device pertaining to Modification 5 is depicted in FIG. 31. The device of Modification 5 is provided with the group of four process units 301Y, M, C, and K for forming an image with the four colors yellow (Y), magenta (M), cyan (C), and black (K). The symbols Y, M, C, and K refer to members used for yellow, magenta, cyan, and black, respectively.

The process units 301Y, M, C, and K have drum-shaped photoreceptors 311Y, M, C, and K as latent image carriers. In addition to the process units 301Y, M, C, and K, the device of the present Modification 5 is provided with an optical writing unit 307, paper cassettes 303 and 304, a pair of registering rollers 315, a transfer unit 306, a belt-type fixing device 319, and a paper delivery tray 308. A manual paper tray (not pictured), power supply unit, and the like are also provided.

The optical writing unit 307 is provided with a light source, a polygon mirror, an f-θ lens, a reflecting mirror, and the like, and made to emit laser light while the surfaces of the photoreceptors 311Y, M, C, and K are scanned with the laser light on the basis of image data.

The process units 301Y, M, C, and K are configured such that at least the photoreceptors 311Y, M, C, and K as latent image carriers, and the developing device as a developing device are supported as a single unit by a shared support. These components are also configured to as to be capable of attaching to and detaching from the main body of the device of Modification 5, and are replaced when their internal parts reach the end of their service lives.

Figure 32:
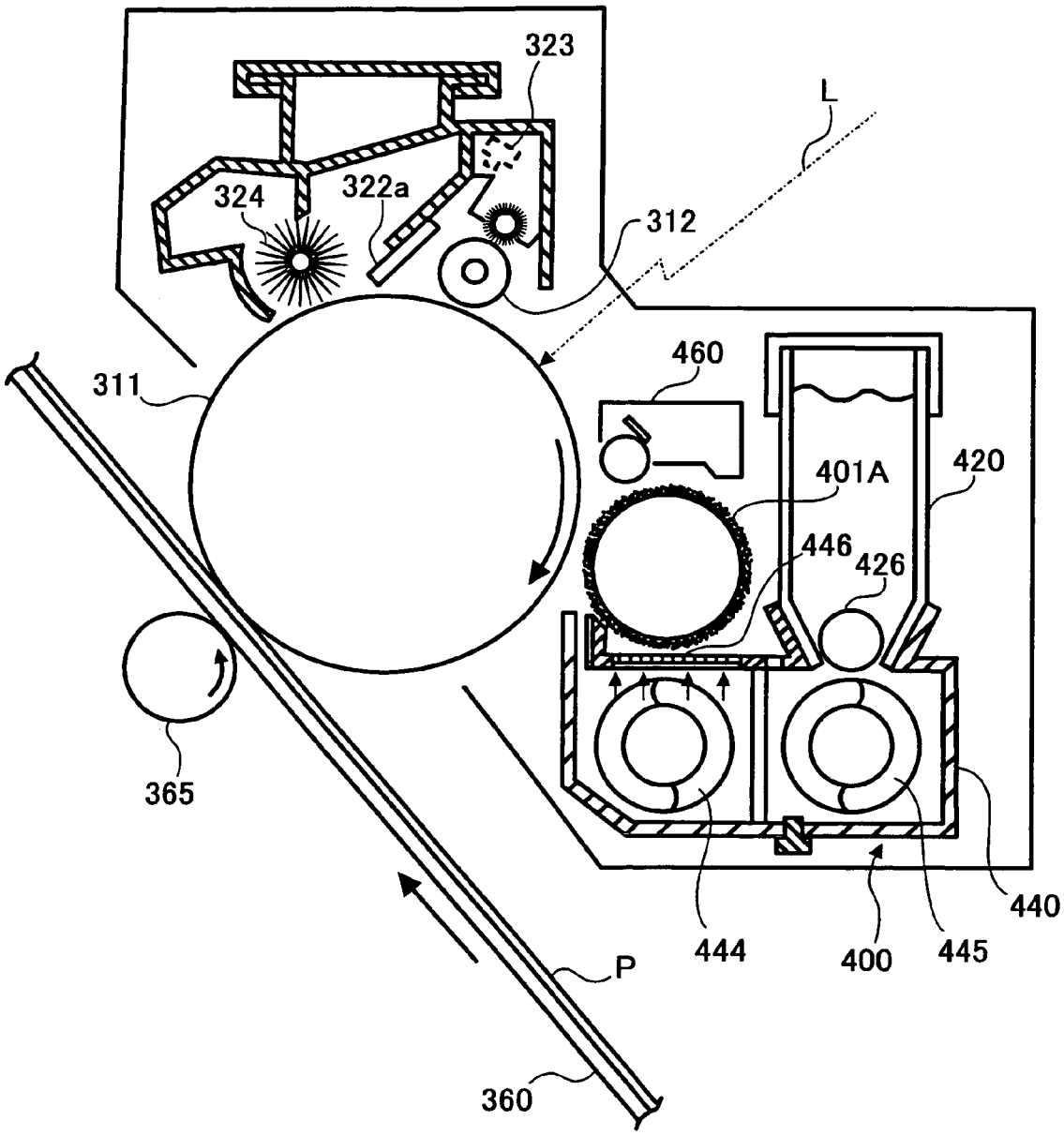
FIG. 32 is a diagram depicting any one of the four process units of the device of the same Modification 5 together with a portion of the transfer unit.

Only one of the process units 301Y, M, C, and K is depicted in FIG. 32 together with a portion of the transfer unit 306. Because the process units 301Y, M, C, and K have substantially the same structure except for the color of toner used therein, the symbols Y, M, C, and K are omitted in the figure. In the figure, the process unit 301 has a photoreceptor 311, as well as a brush roller 324 for applying a lubricant to the surface of the photoreceptor. The process unit 301 also has a drum cleaning device composed of a pivoting counter blade 322*a* and the like for cleaning, a charge-removing lamp 323 for removing static electricity, and the like. The process unit 301 also has a charging device 312 for uniformly charging the photoreceptor 311, a developing device 400, and the like.

A charging device 312 having a roller or other component in which an alternating current charge bias is applied by a power supply (not pictured) is disposed in the process unit 301 so as to make contact with the photoreceptor 311. The charging device uniformly charges the surface of the photoreceptor 311 while being rotated by a driving device (not pictured) such that its surface moves at the point of contact in the same direction as the surface of the photoreceptor 311. Laser light that is modulated and deflected by the optical writing device (307 in FIG. 31) is emitted while being scanned on the surface of the photoreceptor 311 that has been thus uniformly charged, whereupon an electrostatic latent image is formed on the surface of the photoreceptor 311. This electrostatic latent image is developed into a toner image by the developing device 400 described hereinafter.

In FIG. 31 described previously, two paper feeding cassettes 303 and 304 are disposed at the bottom of the main chassis. These paper feeding cassettes 303 and 304 contain transfer paper bundles, and paper feeding rollers 303*a* and 304*a* press against the topmost sheet of transfer paper P. The paper feeding rollers 303*a* and 304*a* are rotated at a prescribed timing, and the transfer paper P is sent into the paper feeding channel. A pair of registering rollers 315 is disposed at the end of the paper feeding channel, and transfer paper P that arrives at that point is sent to the transfer unit 306 at a timing that can be synchronized with the Y toner image formed on the photoreceptor 311Y of the Y process unit 301Y.

The transfer unit 306 has a transfer transport belt 360 that touches each of the photoreceptors 311Y, M, C, and K and moves endlessly while forming four transfer nips. The transfer transport belt 360 is engaged with four supporting rollers 361 so as to touch the photoreceptors 311Y, M, C, and K of the process units 301Y, M, C, and K and to form four transfer nips. An electrostatic adsorption roller 362 to which a prescribed voltage is applied from a power supply (not pictured) is disposed so as to face the rightmost supporting roller 361 in the figure. The transfer transport belt 360 can electrostatically adsorb the transfer paper P on the surface thereof (external surface of the loop by means of the charge applied from the electrostatic adsorption roller 362.

Transfer bias applying rollers 365Y, M, C, and K that touch the back surface of the transfer transport belt 360 are provided at the bottom of the transfer nips. A transfer bias controlled at a constant current is applied by a transfer bias power supply (not pictured) to the transfer bias applying rollers 365Y, M, C, and K. A transfer charge is thereby imparted to the transfer transport belt 360, and a transfer electric field with a prescribed strength is formed between the transfer transport belt 360 and the photoreceptor surfaces in the transfer nips. The transfer bias applying rollers 365 are provided as transfer bias applying members in the device of Modification 5, but brushes, blades, or other members may also be provided instead of the rollers.

The dashed line in the same figure indicates the transport path of the transfer paper. The transfer paper (not pictured) fed from the paper feeding cassettes 303 and 304 is transported by a plurality of transport roller pairs while being guided by transport guides (not pictured), and is sent to the temporary stopping position at which the pair of registering rollers 315 is provided. The transfer paper conveyed at a prescribed timing by the pair of registering rollers 315 is retained by the transfer transport belt 360 and sequentially passes through the Y transfer nip, M transfer nip, C transfer nip, and K transfer nip at which contact can be made with the photoreceptors 311Y, M, C, and K. The Y, M, C, and K toner images developed on the photoreceptors 311Y, M, C, and K of the process units 301Y, M, C, and K are thus superposed on the transfer paper P at their respective transfer nips and transferred onto the transfer paper by the action of the transfer electric field and nip pressure. A full-color image is formed on the transfer paper by mean of this superposition transfer.

After the full-color toner image is fixed in the fixing device 319 provided with a heating belt on the transfer paper (not pictured) on which a full-color image was formed, the transfer paper is discharged onto a paper delivery tray 308.

In FIG. 32 described previously, a prescribed quantity of lubricant is applied to the surface of the photoreceptor 311 by a brush roller 324 after the toner image is transferred, and cleaning thereof is then performed by a counter blade 322*a*. The charge on the photoreceptor is then removed by the light emitted from the charge-removing lamp 323 to prepare it for formation of the next electrostatic latent image.

A small amount of toner that could not be removed still remains on the surface of the photoreceptor 311 that has been cleaned by the counter blade 322*a*. This leftover toner that remains following cleaning adheres to and contaminates the charging device 312 that rotates while in contact with the surface of the photoreceptor 311. This contamination is removed by roller cleaning.

The developing device 400 is provided with a cylindrical electrostatic transport drum 401A as an electrostatic transporting device rather than an electrostatic transport substrate. The electrostatic transport drum 401A may be manufactured by the following process, for example. Specifically, after first an electrically conductive layer composed of aluminum or the like is vapor-deposited onto the entire surface of a cylindrical resin base material consisting of a polyimide or the like, the electrically conductive layer is patterned by photolithography into transport electrodes or bus lines (common electrodes). An insulating layer also covers the patterned electrodes and the resin base material. The insulating layer may consist of $SiO_2$ or another inorganic material that is made into a thin layer by sputtering, or may be formed by bonding an organic film or the like with a thickness of about 1 to 2 μm formed by spin coating onto the transport electrodes. The electrostatic transport drum 401A thus configured is rotated counterclockwise in the figure by a driving device (not pictured). The device of Modification 5 uses an electrostatic transport member whose surface can be moved endlessly. However, the rotation of the electrostatic transport drum 401A is stopped during the development period.

Figure 33:
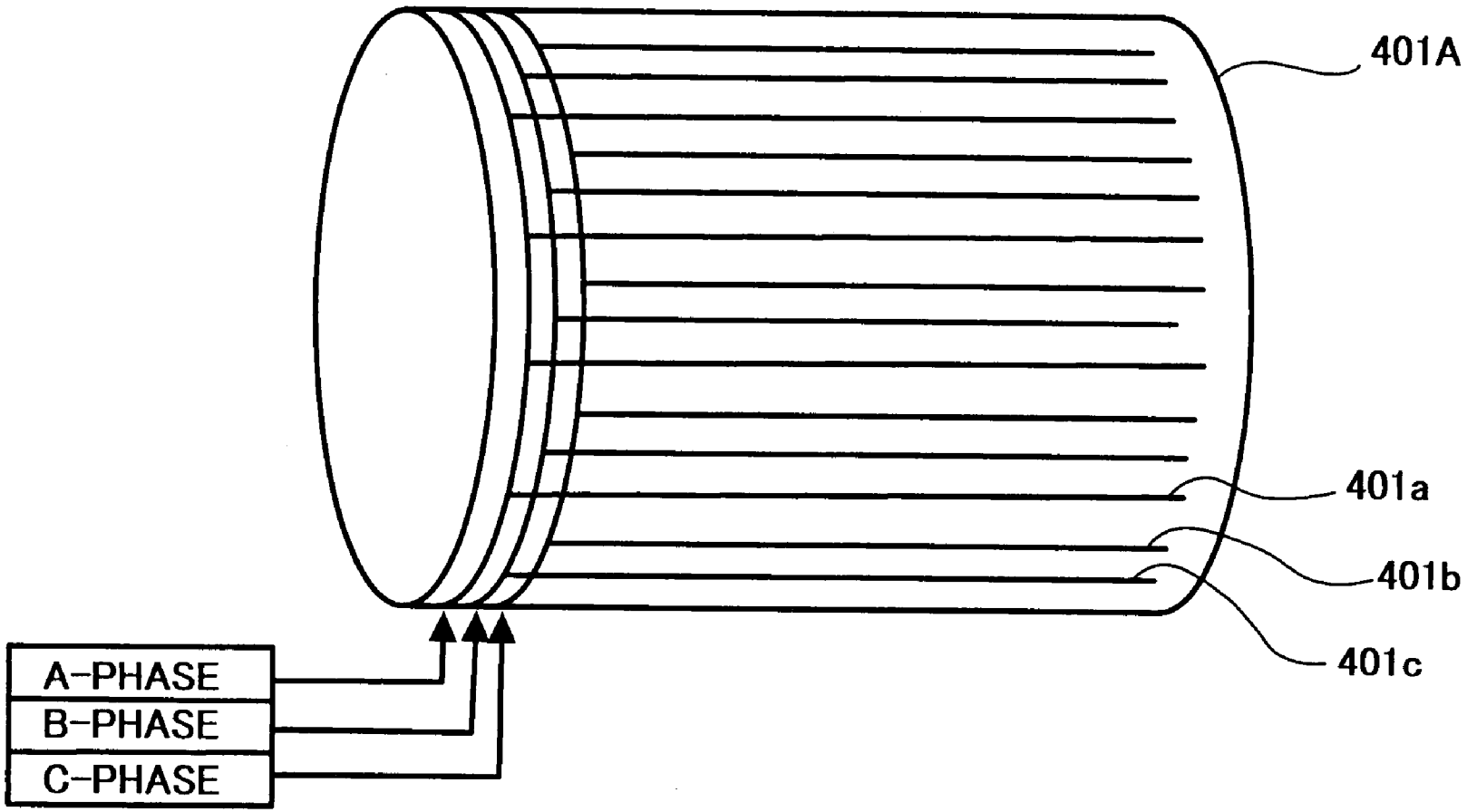
FIG. 33 is an oblique view depicting the electrostatic transport drum of the device pertaining to the same Modification 5.

The electrostatic transport drum 401A is depicted in FIG. 33. Depiction of the insulating layer that covers the drum surface is omitted in the figure for convenience. A plurality of strip-shaped transport electrodes extending in the drum axis direction is provided to the surface of the electrostatic transport drum 401A so as to line up at prescribed intervals along the entire periphery thereof. These transport electrodes are 30 μm wide and are spaced apart from each other at 30 μm intervals. The transport electrodes are also lined up in the sequence Group A transport electrodes 101*a*, Group B transport electrodes 101*b*, and Group C transport electrodes 101*c*, and output the A-phase, B-phase, and C-phase drive pulse voltages, respectively, depicted in FIG. 3 during development.

Figure 34:
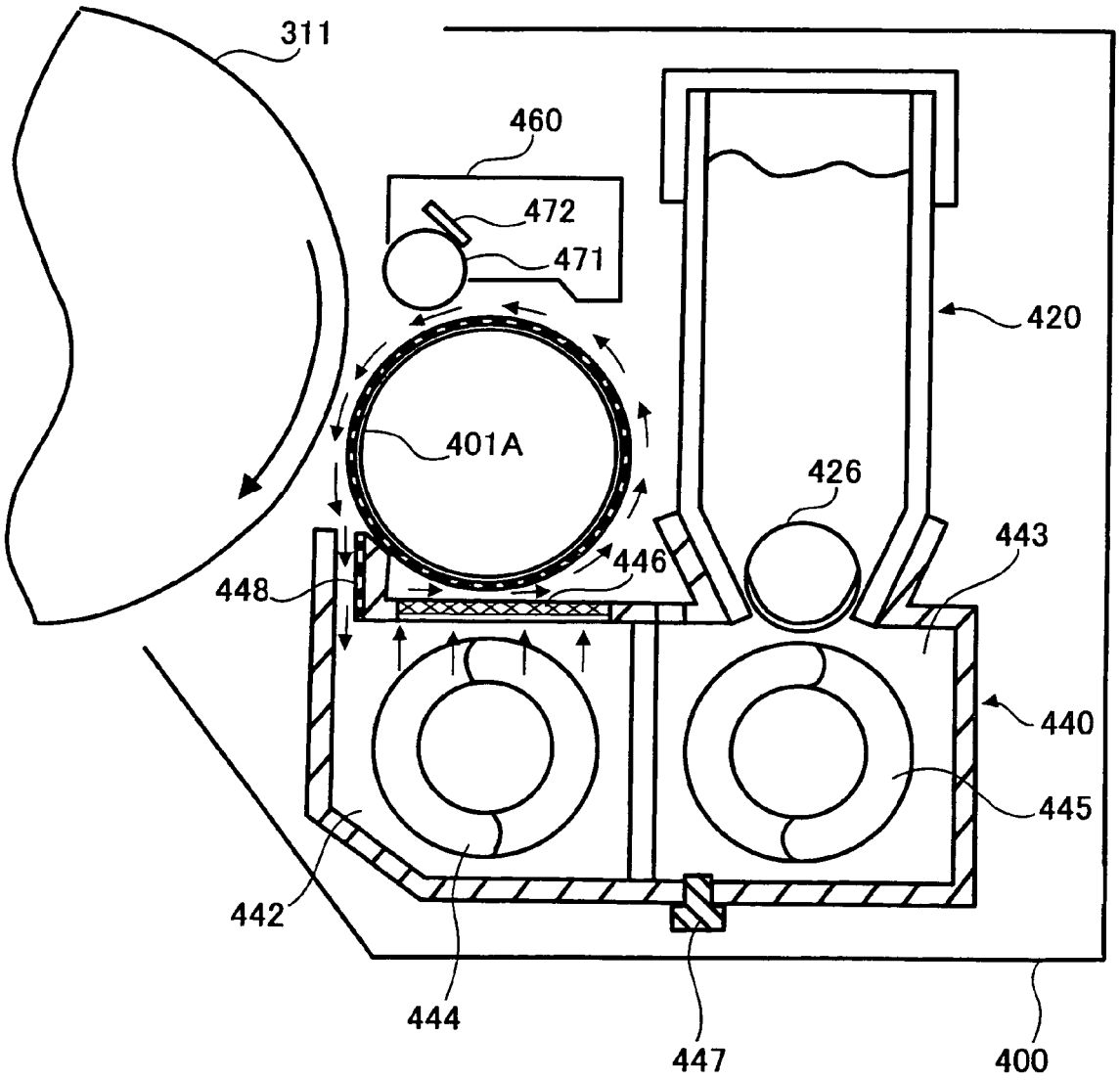
FIG. 34 is a diagram depicting the developing device of the device pertaining to the same Modification 5 together with the photoreceptor.

The developing device 400 of the device of Modification 5 is depicted in FIG. 34 together with the photoreceptor 311. The symbols Y, M, C, and K are also omitted in this figure. In the figure, the developing device 400 is provided with the electrostatic transport drum 401A as well as the toner refill unit 420, toner feeding unit 440, cleaning device 460, and the like. The structure of the toner refill unit 420 is substantially the same as that of the embodiment. The toner contained therein is refilled into the second storage chamber 443 of the toner feeding unit 440 by the rotation of a refill roller 426. The arrows around the periphery of the electrostatic transport drum 401A in the same figure do not indicate the rotation of the electrostatic transport drum 401A, but indicate the movement of the toner on the drum surface.

The toner feeding unit 440 is disposed at the bottom in the gravitational direction rather than at the top in the gravitational direction of the electrostatic transporting device. The toner refilled into the second storage chamber 443 of the toner feeding unit 440 is mixed into a mixture of toner and friction charging particles, transported by a second transport screw 445 while being frictionally charged, and transferred to the first storage chamber 442. A screw bias is applied by a power supply (not pictured) to the first transport screw 444 in the first storage chamber 442, whereupon a difference in electrical potential is created between the first transport screw 444 and the mesh 446 above it. The toner in the mixture being transported away in the z-axis of the figure by the first transport screw 444 separates from the surface of the friction charging particles in the mixture by means of this potential difference and jumps toward the mesh 446 against gravity. The toner then passes through the mesh 446 and is fed to the surface at the bottom of the electrostatic transport drum 401A in the figure. The toner is then transported over the curved surface of the electrostatic transport drum 401A to which the drive pulse voltage for development is outputted by the transport electrodes while hopping due to the EH effect counterclockwise along the curved surface in the figure. According to experimentation by the inventors, there is no separation of toner from the drum surface at this time.

The toner is transported approximately 280° in the counterclockwise direction of the figure along the curved surface of the electrostatic transport drum 401A, whereupon the toner reaches the development area facing the photoreceptor 411, and a portion thereof participates in the development of an electrostatic latent image. The leftover toner that did not participate in development passes through the development area.

A recovery channel is formed at the left-hand end of the toner feeding unit 440 in the figure, the channel is shaped so as to protrude toward the electrostatic transport drum 401A, and the recovery port at the leading end thereof is made to open toward the electrostatic transport drum 401A. A group of recovery electrodes 448 in which recovery electrodes that extend away in the z-axis of the figure are lined up at a prescribed pitch is also provided to the recovery channel. Recovery pulse waves consisting of positive direct current pulse voltages are also outputted to the recovery electrodes out of phase with each other. The leftover toner that has passed through the development area is electrostatically attracted by the group of recovery electrodes 448 when it passes through the position opposite from the recovery port described above and moves off the surface of the drum into the recovery channel. The toner is then transported along the recovery channel from top to bottom in the figure by the effects of the recovery pulse waves outputted by the recovery electrodes, and is recovered into the first storage chamber 442. The toner that did not participate in development is thereby recycled. The recovery channel and group of recovery electrodes 448 thereby function as a recovery device for recovering leftover toner from the surface of the electrostatic transport drum 401A that constitutes the electrostatic transporting device in the device of Modification 5.

A toner concentration detecting device 447 is disposed in the second storage chamber 443 of the toner feeding unit. The device detects the toner concentration of the mixture in the second storage chamber 443 and outputs a corresponding voltage. The value of this output voltage is sent to a controller (not pictured). The controller is provided with an RMA or other recording device for storing data that consists of the Vtref for Y, which is the target value of the voltage outputted from the toner concentration detecting device, and also consists of the Vtref for M, C, and K, which is the target value of the voltage outputted from a T sensor mounted to another developing device. In the developing device 400 used for Y, the value of the outputted voltage from the toner concentration detecting device 447 is compared with the Vtref for Y, and the toner refill unit is actuated for a period of time that corresponds to the results of that comparison. By thus controlling the actuation of the toner refill unit, the appropriate quantity of Y toner is refilled into the mixture in the toner feeding unit 440 whose toner concentration has decreased in conjunction with toner feeding, and the concentration of Y toner is maintained within a prescribed range. The same toner refill control is performed for the developing devices 400 of other colors.

A cleaning device 460 having a cleaning roller 471, clearing blade 472, and the like is disposed at the top of the electrostatic transport drum 401A in the figure and can be connected to and separated from the electrostatic transport drum 401A. The cleaning roller 471 can be connected with and separated from the electrostatic transport drum 401A by being moved up and down with the aid of a solenoid or other moving device (not pictured). The cleaning roller 471 is made of a metal core covered with rubber, resin, or another elastic material, and is rotated counterclockwise in the figure by means of a driving device (not pictured). A cleaning bias in the opposite polarity from the toner (positive in the present example) is also applied thereto by a power supply (not pictured). The cleaning roller 471 is withdrawn from the point of contact with the electrostatic transport drum 401A during development in which the electrostatic transport drum 401A is not rotated, so as not to impede the toner from hopping on the drum.

The device of an example in which a more characteristic structure is added to the copier pertaining to the present embodiment will next be described.

EXAMPLE 1

In the copier of Example 1, the screw power circuit 190 and the mesh power circuit 191 in the aforementioned FIG. 7 form an integral unit. An electrical potential difference is also created between the first transport screw 144 and the mesh 146 by application of an AC/DC superimposed bias in which a direct current voltage is superimposed on an alternating current voltage. In this AC/DC superimposed bias, a direct current voltage with a value of −0.3 to −1.5 kV is superimposed on an alternating current voltage with a peak-to-peak value of ±0.6 to 2.0 kV, for example. A more specific example is a voltage with a wave height of 0 to −0.6 kV in which a DC voltage of −0.3 kV is superimposed on an AC voltage with a peak-to-peak value of ±0.3 kV. Another example is a voltage with a wave height of −0.5 to −2.5 kV in which a DC voltage of −1.5 kV is superimposed on an AC voltage with a peak-to-peak value of ±1.0 kV. The waveform of the AC voltage may have a frequency of several hundred to 5,000 Hz and may be a sine wave or sinusoidal wave.

When this AC/DC superimposed bias is applied, an oscillating electric field that changes strength and direction in a short time acts on the toner that is electrostatically adsorbed by the friction-promoting particles. By this arrangement, the toner can be better separated from the friction-promoting particles and made to jump toward the mesh 146 compared to a case in which a uniform electric field is applied by means of a DC bias.

EXAMPLE 2

In the copier pertaining to Example 2, a counter electrode in which the surface of an electrically conductive base composed of aluminum or the like is covered with an insulating layer composed of a resin or other insulating material is used as the first transport screw 144 that functions as the counter electrode in FIG. 7 described above. The first transport screw 144 can be manufactured with a process such as the following, for example. Specifically, an electrically conductive base composed of aluminum or the like is covered with a thin film composed of $SiO_2$, SiN, $Ta_2O_5$, a polyimide, or another insulating material having a thickness of 0.5 to 30 μm. By using the first transport screw 144 thus configured, the toner can be made to come into contact only with the insulating material on the surface of the first transport screw 144 that functions as the counter electrode in the first storage chamber 142, and contact with the electrically conductive base can be prevented. Injection of charge from the first transport screw 144 into the toner can thereby be prevented, and the amount of charge on the toner can be properly maintained. Furthermore, degradation of the toner or friction-promoting particles can be reduced in comparison with a case in which contact with the electrically conductive base is allowed.

EXAMPLE 3

In the copier pertaining to Example 3, a mesh 146 is used that is covered with an insulating layer composed of an insulating material at least on the surface of the electrically conductive base composed of aluminum or the like that is opposite from the screw in FIG. 7 described above. The method of forming the insulating layer is the same as in the first transport screw 144 of Example 2. By using the mesh 146 thus configured, the toner can be made to come into contact only with the insulating material on the surface of the mesh 416 that faces the screw in the first storage chamber 142, and contact with the electrically conductive base is prevented. Charge injection from the mesh 146 into the toner can also be minimized by this arrangement. Furthermore, degradation of the toner or friction-promoting particles can be reduced in comparison with a case in which contact with the electrically conductive base is allowed. Particularly when the holes in the mesh 146 are etched so as to have a sharp edge, it is easy for electrical discharge to occur from the first transport screw 144 to the sharp edge, but this electrical discharge can be effectively minimized. Charge injection from the mesh 146 to the toner can be prevented if a mesh is used whose entire surface is covered with an insulating layer.

EXAMPLE 4

In the copier pertaining to Example 4, the first electrostatic toner transport substrate 101 depicted in FIG. 2 described above is used wherein at least the surface thereof that makes contact with the toner is covered with an insulating layer composed of an insulating material. Specifically, the surface at the top of the figure that comes into contact with the toner in the insulating plate 101*d* is covered from the top of the transport electrodes by an insulating layer with a thickness of about 0.5 to 3 μm (not pictured). Examples of the material of the insulating layer include $SiO_2$, $Si_3N_4$, $Ta_2O_5$, $TiO_2$, SiON, $Si_3N_4$, and other substances with low moisture absorbance and surface friction coefficients. Materials composed of SiN, Bn, W, and other inorganic nitride compounds may also be used. The amount of charge on the toner tends to decrease during transport if the number of hydroxyl groups on the surface increases, so it is effective to use an inorganic nitride compound with few surface hydroxyl groups (SiOH, silanol).

The material of the insulating plate 101*d* may consist of a glass substrate, resin, ceramic, or other insulating material. A base layer composed of SUS or another electrically conductive material may also be covered with $SiO_2$ or another insulating film. In this case, a layer composed of polyimide film or another flexible material may be used for the base layer.

The transport electrodes 101*a* through 101*c* may be configured such that an insulating plate 101*d* covered with Al, Ni—Cr, or another electrically conductive material with a thickness of 0.1 to 0.2 μm is patterned in a prescribed shape by photolithography or the like. The width of this plurality of transport electrodes in the toner transport direction is adjusted to one to twenty times the average grain size of the toner. The distance between electrodes in the toner transport direction is also adjusted to one to twenty times the average grain size of the toner.

Attachment of the toner to the first electrostatic toner transport substrate 101 can be minimized by providing an insulating layer composed of this material. Charge injection from the transport electrodes to the toner can also be prevented.

EXAMPLE 5

In FIG. 2 described previously, closed loop-type electric flux lines are formed between the transport electrodes by the potential difference in the drive pulse voltage of −100 V to 0 V. The electric flux lines are oriented from upstream to downstream in the transport direction with respect to the negatively charged toner. The toner on the first electrostatic toner transport substrate 101 electrostatically moves in relative fashion from right to left in the figure while hopping along these electric flux lines. A vertically directed component of a certain size is needed in the electric flux lines described above in order to induce the hopping effect.

On the other hand, electric flux lines are formed from the mesh toward the susbtrate for the negatively charged toner between the mesh 146 (not pictured) and the first electrostatic toner transport substrate 101. In the space between the mesh and the first electrostatic toner transport substrate 101, the electric field created by these electric flux lines overcomes the electric field formed between the transport electrodes of the first electrostatic toner transport substrate 101 and reduces the vertically-directed component of the electric flux lines between the transport electrodes. Consequently, there is a risk of not being able to cause the toner to hop adequately, and of significantly reducing its transport capability.

Figure 29:
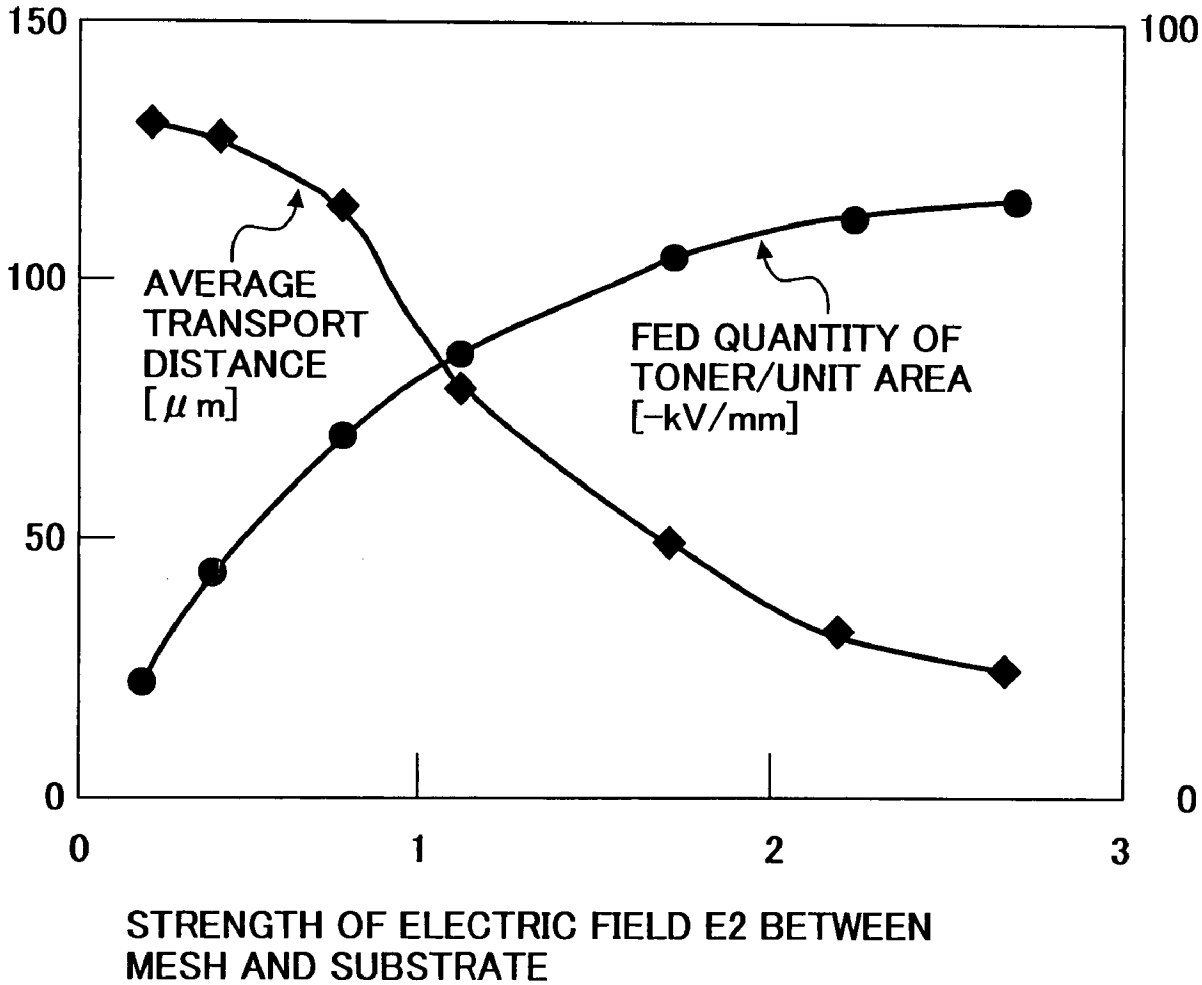
FIG. 29 is a graph depicting the relationship between the strength of the electrical field E2 formed between the mesh and the first electrostatic toner transport substrate, and the average transport distance or fed quantity of the toner.

FIG. 29 is a graph depicting the relationship between the strength of the electrical field E2 formed between the mesh 146 and the first electrostatic toner transport substrate 101, and the average transport distance or fed quantity of the toner. The strength of the electric field E2 indicates the average voltage of the drive pulse voltage and the strength of the electric field created by the potential difference with the mesh. This graph shows the results of experimentation conducted using a first electrostatic toner transport substrate 101 provided with transport electrodes 101*a* through 101*c* that have a width of 30 μm, an arrangement pitch of 60 μm, and an interelectrode distance of 30 μm. The drive pulse voltage was as shown in FIG. 3. The average transport distance of the toner indicates the average distance on the substrate that the toner has moved in 2 msec. The fed quantity is indicated by the quantity of toner per unit area of the substrate that was fed from the first storage chamber 142 to the first electrostatic toner transport substrate 101.

It is apparent from FIG. 29 that, the smaller the strength of the electric field E2, the smaller the quantity of toner fed from the first storage chamber 142 to the first electrostatic toner transport substrate 101. In contrast, the average transport distance of the toner increases as the strength of the electric field E2 decreases. This is because the degree to which the transport electric field is weakened by the electric field E2 was reduced. The amount of decline in the average transport distance sharply increases as soon as the strength of the electric field E2 exceeds −0.8 kV/mm. When the strength of the electric field E2 exceeds −2 kV, the toner adhering to the substrate surface begins to emerge, and an average transport distance of only about 25 μm is obtained.

Consequently, in the copier pertaining to Example 5, the mesh power circuit 191 and screw power circuit 190 are provided so as to switch the output voltage in FIG. 7 described previously. The mesh power circuit 191 is caused to function as a device for switching the potential difference. The electrical potential of the mesh 146 is switched between a feeding potential for feeding toner that has passed through the holes in the mesh 146 to the first electrostatic toner transport substrate 101, and a transport potential for electrostatically moving the fed toner and transporting it on the first electrostatic toner transport substrate 101.

Figure 30:
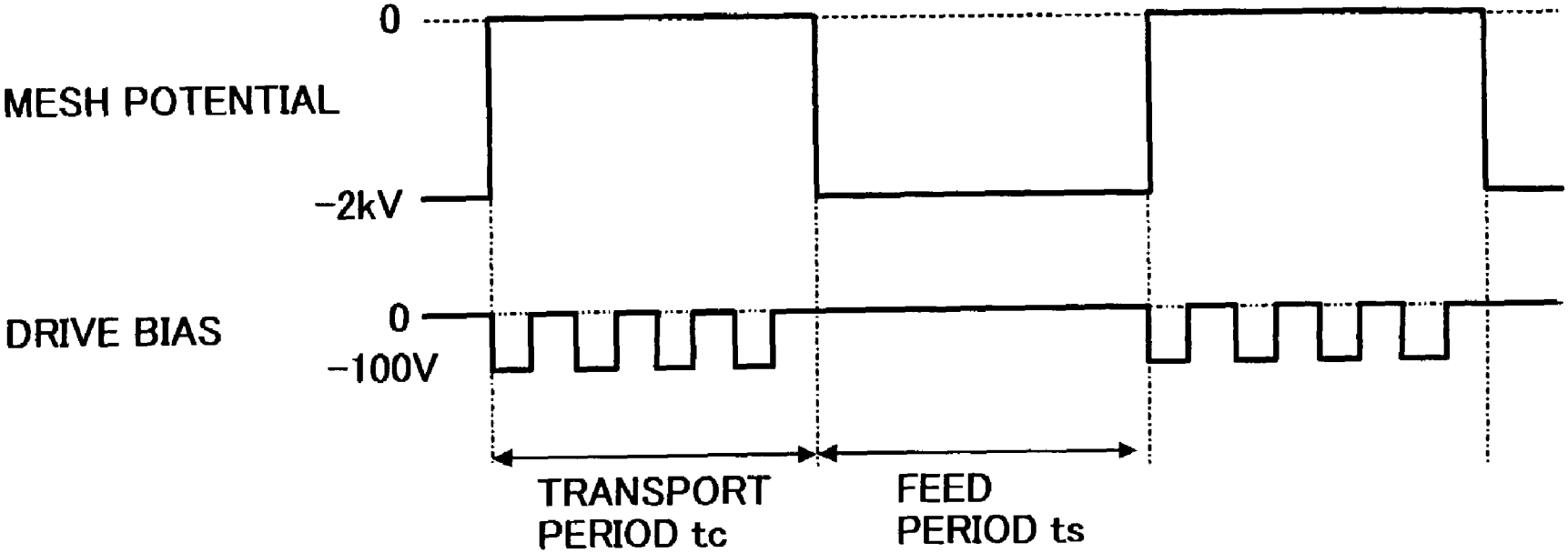
FIG. 30 is a waveform diagram depicting the electrical potential of the mesh and the drive pulse voltage in the device pertaining to Modification 5.

FIG. 30 is a waveform diagram depicting the electrical potential of the mesh 146 and the drive pulse voltage. In the diagram, the A- through C-phase pulses of FIG. 3 are shown as the same drive pulse voltage. As depicted in FIG. 30, a drive pulse voltage is not applied to the transport electrodes, and the transport electrodes are at 0 V when the mesh potential is set to the feeding potential of −2 kV. The mesh potential is thus set to the feeding potential during the feed period ts. When the feed period ts elapses, the transport period tc begins in which the mesh potential is switched to the transport potential of 0 V. The drive pulse voltage is applied to the transport electrodes during this transport period tc. The feed period ts begins again upon completion of the transport period tc. The feed period ts and the transport period tc thus alternate with each other.

By this arrangement, the toner is efficiently fed from the first storage chamber to the first electrostatic toner transport substrate 101 during the feed period ts in which the potential of the mesh 146 is set to the feeding potential, and the effects of the electric field E2 are then removed and the toner can be efficiently transported in the transport period tc in which the potential of the mesh 146 is set to the transport potential. Consequently, drawbacks can be prevented whereby the toner accumulates on the first electrostatic toner transport substrate 101 in the area in which it faces the mesh 146.

A mesh voltage with a cycling frequency of 3 kH and tc=ts=3.33 to 33.3 msec may be used as the mesh voltage applied to the mesh 146, for example, in order to achieve the alternation between tc and ts depicted in FIG. 30. The toner that has passed through the mesh 146 also falls toward the first electrostatic toner transport substrate 101 under its own weight even without the effects of the electric field E2. Drawbacks whereby the toner is pulled back onto the mesh 146 do not occur if the toner is caused to reach the electric field formed between the transport electrodes of the first electrostatic toner transport substrate 101 as a result of such falling. Consequently, it is better to make the feed period ts shorter than the transport period tc when the feed quantity and transport quantity are considered. Doing this resulted in more toner ultimately being transported to the development area in experiments as well. Therefore, the mesh power circuit 191 and drive power circuit 30 were configured in Example 5 so that the feed period ts was shorter than the transport period tc.

EXAMPLE 6

The inventors conducted detailed experimentation and concentrated investigation of the relation between the strength of the electric field E2 described above, the maximum strength of the electric field E3 formed between the transport electrodes (strength of the electric field created by the potential difference of 0 V to −100 V in Example 6), and the average transport distance. Consequently, they discovered that the amount of reduction of the average transport distance due to the effect of the electric field E2 can be limited to a factor of ½ or less when the strength of the electric field E2 is made no more than half the maximum strength of the electric field E3. For example, under conditions consisting of the electrode configuration depicted in FIG. 2 and the drive pulse voltage depicted in FIG. 3, the electric field strength between adjacent transport electrodes is 3.3 kV/mm in the case of 0 V and 100 V. In such a case as this, the electric field E2 may be given a strength of 1.65 kV/mm. If this is done, as shown in FIG. 29, the amount of reduction of the average transport distance due to the effect of the electric field E2 can be limited to a factor of no more than half that of a case in which the electric field E2 is not formed. The average transport distance when the strength of the electric field E2 was 1.65 kV/mm was 60 μm. The inventors confirmed by experimentation that no decline in image concentration is brought about in an image-forming device with a print speed of 20 ppm if the average transport distance is near this value.

The copier pertaining to the present embodiment as described above has a first storage chamber 142 and second storage chamber 143 as mixture containers for storing a mixture of toner and friction-promoting particles, a first transport screw 144 and second transport screw 125 as stirring devices for stirring the mixture stored in the containers, a mesh 146 provided to the first storage chamber 142, and a counter electrode that faces the mesh 146 via the mixture. The copier is also provided with a toner feeding unit 140 as a toner feeding device for sifting the toner in the mixture in the first storage chamber 142 through the mesh 146 and feeding the toner to the first electrostatic toner transport substrate 101. A potential difference generator is also provided for creating a potential difference between the mesh 146 and the electrostatic toner transport substrate 101 in addition to the potential difference between the counter electrode (the first transport screw 144 or counter electrode) and the mesh 146. It becomes possible by means of this configuration to promote separation of the toner electrostatically adsorbed on the surface of the friction-promoting particles in the mixture from the friction-promoting particles by means of the former potential difference, as well as to promote electrostatic movement of the toner that has moved into and around the openings in the mesh 146 by that separation to the first electrostatic toner transport substrate 101 by means of the latter potential difference. Consequently, more of the toner can be fed to the first electrostatic toner transport substrate 101 than in a case in which only one of the potential differences was generated.

In the copier pertaining to Example 1 above, the mesh power circuit 191 as a potential difference generator is combined with the screw power circuit 190 so as to generate a potential difference by applying an AC/DC superimposed bias between the counter electrode and the mesh 146. By this configuration, the toner that is electrostatically adsorbed on the friction-promoting particles in the first storage chamber can be better separated from the friction-promoting particles by the oscillating electric field due to the AC component, as described previously.

In the copier pertaining to the present embodiment, the first transport screw 144 as a stirring device also serves as a counter electrode that faces the mesh 146 via the mixture, so cost increases can be prevented by providing the stirring device separately from the counter electrode.

In the copier pertaining to the present embodiment, a first transport screw 144 for stirring the mixture while transporting it in relative fashion in the linear direction of the rotating shaft, which screw has a rotating shaft 144*a* and a helical thread 144*b* that protrudes in a spiral shape from the peripheral surface thereof, is used as a stirring device for stirring the mixture in the first storage chamber 142. The first transport screw 144 thus configured is capable of performing mixture renewal whereby new mixture is fed to the position opposite from the mesh 146 while toner-depleted mixture is retrieved from this position by also causing the mixture to move in the peripheral direction of rotation while transporting the mixture in relative fashion in the linear direction of the rotating shaft. Consequently, it is possible to prevent situations in which the toner feeding is compromised due to the fact that the toner-depleted mixture is continuously fed to the position opposite from the mesh 146 without being retrieved.

A rotating brush 155 consisting of an electrically conductive brush electrode that rotates around the rotating cylinder 155*a* is also used as a stirring device for stirring the mixture in the first storage chamber 142 in Modification 2 described above. More toner can be separated and fed by means of this configuration than in a case in which a screw member is used as a stirring device, as described previously.

A counter electrode whose surface is covered with an insulating layer composed of an insulating material is also used as the first transport screw 144 in the copier pertaining to Example 2 described above. By this configuration, toner charge reduction due to charge leakage when frictionally charged toner comes into contact with the electrically conductive surface of the counter electrode can be securely prevented. Charge injection from the electrically conductive surface of the counter electrode to the toner can also be prevented.

A mesh in which the surface of a base composed of an electrically conductive material is covered with an insulating layer composed of an insulating material is used as the mesh 146 in the copier pertaining to Example 3 described above, so toner charge reduction due to charge leakage when frictionally charged toner comes into contact with the electrically conductive surface of the counter electrode can be securely prevented. Charge injection from the electrically conductive surface of the mesh 146 to the toner can also be prevented.

The first electrostatic toner transport substrate 101 used in the copier pertaining to Example 4 described above is covered with an insulating layer composed of an insulating material at least on the surface that fixes the toner. By this configuration, charge injection into the toner due contact with the transport electrodes 101*a* through 101*c* of the first electrostatic toner transport substrate 101 can be prevented. Fixing of the toner on the surface of the transport electrodes can also be minimized.

An electrical potential switching device for switching the potential of the mesh 146 at least between a feeding potential for feeding toner that has passed through the holes in the mesh 146 to the first electrostatic toner transport substrate 101, and a transport potential for electrostatically moving the fed toner and transporting it on the first electrostatic toner transport substrate 101 is provided in the copier pertaining to Example 5 described above. An adequate amount of toner can be transported in this structure by temporarily reducing the strength of the electric field formed for feeding the toner from the first storage chamber 142 to the first electrostatic toner transport substrate 101 if this field weakens the electric field formed on the first electrostatic toner transport substrate 101 and toner transport performance is reduced.

The mesh power circuit 191 is also provided as a potential switching device in the copier pertaining to Example 5 described above, so as to make the feed period ts during which the potential of the mesh 146 is set to the feeding potential shorter than the transport period tc during which the potential of the mesh 146 is set to the transporting potential. More toner can be transported to the development area in this configuration than in a case in which the feed period ts is made longer than the transport period tc.

The copier pertaining to Example 6 described above is also provided with a potential difference generator for generating a potential difference so as to make the strength of the electric field E2 formed by the potential difference between the mesh 146 and the first electrostatic toner transport substrate 101 no more than half the maximum strength of the electric field E3 formed between the transport electrodes 101*a* through 101*c*. It is possible by this configuration to minimize the reduction in toner transport performance due to the electric field E3 formed on the first electrostatic toner transport substrate 101 for toner transport from being weakened by the electric field E2 formed between the first storage chamber 142 and the first electrostatic toner transport substrate 101 for feeding the toner from the first storage chamber 142 to the first electrostatic toner transport substrate 101. The amount of reduction of the average transport distance can also be limited to a factor of no more than half that of a case in which the electric field E2 is not formed.

The present invention as heretofore described has the following effects.

(1) Frictional charging of the toner is accelerated and the toner can be adequately charged by being stirred while in a mixture with a friction-promoting substance. Consequently, deficient charging of the toner can be minimized.

(2) It becomes possible to impart an electrostatic force directed from the counter electrode toward the mesh to the toner in the mixture that resides between the counter electrode and the mesh in the mixture container or the connecting portion by means of the potential difference between the counter electrode and the mesh. The toner is separated from the surface of the friction-promoting particles and electrostatically moved toward the mesh by this electrostatic force, whereby an adequate amount of toner can be sifted by the mesh and fed to the electrostatic toner transport device.

(3) A potential difference between the mesh and the electrostatic toner transport device causes an electrostatic force directed toward the electrostatic toner transport device to act on the toner disposed in or around the holes and scraped from the surface of the friction-promoting particles by the edges of the holes in the mesh. An adequate amount of toner can thereby be passed through the holes in the mesh and fed to the electrostatic toner transport device.

(4) Consequently, the present invention possesses excellent effects whereby toner charge deficiency can be minimized while an adequate amount of toner is fed to the first electrostatic toner transport substrate 101 for transporting toner by the EH effect.

After becoming familiar with the details of the present disclosure, various modifications will become possible for those skilled in the art without departing from the scope thereof.

What is claimed is:

1. A toner transport device provided with electrostatic toner transport means having a plurality of electrodes arranged at a prescribed pitch, for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating an electrical potential difference between the counter electrode and the mesh, wherein the electric potentials of the counter electrode and the mesh include a DC component.

2. The toner transport device as claimed in claim 1, wherein the potential difference generating means is configured so as to create a potential difference by application of an alternating current/direct current superimposed voltage between the counter electrode and the mesh.

3. The toner transport device as claimed in claim 2, wherein the surface of the counter electrode is covered with an insulating layer composed of an insulating material.

4. The toner transport device as claimed in claim 1, wherein the stirrer also serves as a counter electrode.

5. The toner transport device as claimed in claim 4, wherein the stirrer comprises a rotating shaft and a helical thread that protrudes in a spiral shape from the peripheral surface thereof, and stirs the mixture while transporting the mixture in relative fashion in the linear direction of the rotating shaft.

6. The toner transport device as claimed in claim 4, wherein the stirrer is an electrically conductive brush electrode that rotates about the rotating shaft.

7. The toner transport device as claimed in claim 4, wherein the surface of the counter electrode is covered with an insulating layer composed of an insulating material.

8. The toner transport device as claimed in claim 4, wherein the mesh is a base composed of an electrically conductive material that is covered with an insulating layer composed of an insulating material.

9. The toner transport device as claimed in claim 1, wherein the electrostatic toner transport means is covered with an insulating layer composed of an insulating material at least on the surface that fixes the toner.

10. The toner transport device as claimed in claim 1, wherein the DC component of the electric potential of the counter electrode and the mesh has the same polarity as the toner.

11. A toner transport device provided with electrostatic toner transport means having a plurality of electrodes arranged at a prescribed pitch, for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means; and potential difference generating means for generating an electrical potential difference between the mesh and the electrostatic toner transport means, wherein the electric potentials of the counter electrode and the electrostatic toner transport means include a DC component.

12. The toner transport device as claimed in claim 11, wherein the mesh is a base composed of an electrically conductive material that is covered with an insulating layer composed of an insulating material.

13. The toner transport device as claimed in claim 11, wherein the electrostatic toner transport means is covered with an insulating layer composed of an insulating material at least on the surface that fixes the toner.

14. A toner transport device provided with electrostatic toner transport means for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means; and potential difference generating means for generating an electrical potential difference between the mesh and the electrostatic toner transport means, further comprising electrical potential switching means for switching the potential of the mesh between a feeding potential for feeding toner that has passed through the holes in the mesh to the electrostatic toner transport means, and a transport potential for electrostatically moving the fed toner and transporting the fed toner on the electrostatic toner transport means.

15. The toner transport device as claimed in claim 14, wherein the electrical potential switching means is configured so as to make the time during which the potential of the mesh is set to the feeding potential shorter than the time during which the potential of the mesh is set to the transporting potential.

16. The toner transport device as claimed in claim 11, wherein the DC component of the electric potential of the electrostatic toner transport means and the mesh has the same polarity as the toner.

17. A toner transport device provided with electrostatic toner transport means for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means; and potential difference generating means for generating an electrical potential difference between the mesh and the electrostatic toner transport means, wherein the electrostatic toner transport means transports the toner toward the transport destination by means of the potential difference between a plurality of transport electrodes, and the electrical potential generating means is configured so as to generate an electrical potential with a value that makes the strength of the electric field formed by the potential difference between the mesh and the electrostatic toner transport means no more than half the maximum strength of the electric field formed between the transport electrodes.

18. A toner transport device provided with electrostatic toner transport means having a plurality of electrodes arranged at a prescribed pitch, for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating an electrical potential difference between the counter electrode and the mesh, and between the mesh and the electrostatic toner transport means, wherein the electric potentials of the counter electrode and the mesh include a DC component.

19. The toner transport device as claimed in claim 18, wherein the potential difference generating means is configured so as to generate a potential difference by application of an alternating current/direct current superimposed voltage between the counter electrode and the mesh.

20. The toner transport device as claimed in claim 19, wherein the surface of the counter electrode is covered with an insulating layer composed of an insulating material.

21. The toner transport device as claimed in claim 18, wherein the stirrer also serves as a counter electrode.

22. The toner transport device as claimed in claim 21, wherein the stirrer comprises a rotating shaft and a helical thread that protrudes in a spiral shape from the peripheral surface thereof, and stirs the mixture while transporting the mixture in relative fashion in the linear direction of the rotating shaft.

23. The toner transport device as claimed in claim 21, wherein the stirrer is an electrically conductive brush electrode that rotates about the rotating shaft.

24. The toner transport device as claimed in claim 21, wherein the surface of the counter electrode is covered with an insulating layer composed of an insulating material.

25. The toner transport device as claimed in claim 18, wherein the mesh is a base composed of an electrically conductive material that is covered with an insulating layer composed of an insulating material.

26. The toner transport device as claimed in claim 18, wherein the electrostatic toner transport means is covered with an insulating layer composed of an insulating material at least on the surface that fixes the toner.

27. The toner transport device as claimed in claim 18, wherein the DC component of the electric potential of the counter electrode, the electrostatic toner transport means and the mesh has the same polarity as the toner.

28. The toner transport device as claimed in claim 27, wherein the electric potential of the counter electrode is greater than that of the mesh, and the electric potential of the mesh is greater than that of the electrostatic toner transport means.

29. A toner transport device provided with electrostatic toner transport means for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating an electrical potential difference between the counter electrode and the mesh, and between the mesh and the electrostatic toner transport means, further comprising electrical potential switching means for switching the potential of the mesh between a feeding potential for feeding toner that has passed through the holes in the mesh to the electrostatic toner transport means, and a transport potential for electrostatically moving the fed toner and transporting the fed toner on the electrostatic toner transport means.

30. The toner transport device as claimed in claim 29, wherein the electrical potential switching means is configured so as to make the time during which the potential of the mesh is set to the feeding potential shorter than the time during which the potential of the mesh is set to the transporting potential.

31. A toner transport device provided with electrostatic toner transport means for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating an electrical potential difference between the counter electrode and the mesh, and between the mesh and the electrostatic toner transport means, wherein the electrostatic toner transport means transports the toner toward the transport destination by means of the potential difference between a plurality of transport electrodes, and the electrical potential generating means is configured so as to generate an electrical potential with a value that makes the strength of the electric field formed by the potential difference between the mesh and the electrostatic toner transport means no more than half the maximum strength of the electric field formed between the transport electrodes.

32. A toner transport method for moving and transporting toner on the surface of electrostatic toner transport means having a plurality of electrodes arranged at a prescribed pitch, by an electrostatic force, comprising the steps of:

sifting the toner through a mesh from a mixture of toner and a friction-promoting substance stored in a mixture container or in a connecting portion that is communicated therewith, and feeding the toner to the electrostatic toner transport means;

stirring the mixture in the mixture container; and creating a DC electrical potential difference between a mesh provided to the mixture container or the connecting portion and a counter electrode that faces the mesh via the mixture in the mixture container or connecting portion.

33. A toner transport method for moving and transporting toner on the surface of electrostatic toner transport means having a plurality of electrodes arranged at a prescribed pitch, by an electrostatic force, comprising the steps of:

sifting the toner through a mesh from a mixture of toner and a friction-promoting substance stored in a mixture container or in a connecting portion that is communicated therewith, and feeding the toner to the electrostatic toner transport means;

stirring the mixture in the mixture container; and creating a DC electrical potential difference between a mesh provided to the mixture container or the connecting portion and the electrostatic toner transport means.

34. A toner transport method for moving and transporting toner on the surface of electrostatic toner transport means having a plurality of electrodes arranged at a prescribed pitch, by an electrostatic force, comprising the steps of:

sifting the toner through a mesh from a mixture of toner and a friction-promoting substance stored in a mixture container or in a connecting portion that is communicated therewith, and feeding the toner to the electrostatic toner transport means;

stirring the mixture in the mixture container;

creating an electrical potential difference between a mesh provided to the mixture container or the connecting portion and a counter electrode that faces the mesh via the mixture in the mixture container or connecting portion; and creating a DC electrical potential difference between the mesh and the electrostatic toner transport means.

35. An image forming method for forming an image, comprising:

a latent image formation step whereby a latent image is formed on a latent image carrier; and a development step whereby toner is moved on the surface of electrostatic toner transport means having a plurality of electrodes arranged at a prescribed pitch, by an electrostatic force, the toner is transported to a position that faces the latent image carrier, and the latent image is developed into a toner image;

a feeding step, whereby the toner is separated from the mixture of toner and the friction-promoting substance and fed to the electrostatic toner transport means, is carried out and also carries out:

a step for storing the mixture in the mixture container;

a step for stirring the mixture in the mixture container; and a step whereby a DC electrical potential difference is created between a mesh provided to the mixture container or to a connecting portion that communicates therewith and a counter electrode that faces the mesh via the mixture in the mixture container or the connecting portion, and between the mesh and the electrostatic toner transport means;

and wherein the toner in the mixture is sifted by the mesh and fed to the electrostatic toner transport means.

36. A developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating a DC electrical potential difference between the counter electrode and the mesh.

37. A developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means; and potential difference generating means for creating a DC electrical potential difference between the mesh and the electrostatic toner transport means.

38. A developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating a DC electrical potential difference between the counter electrode and the mesh, and between the mesh and the electrostatic toner transport means.

39. A process unit in which at least a latent image carrier for carrying a latent image in an image-forming device and developing means for developing a latent image on the latent image carrier are supported as a single unit by a shared support, wherein the developing means is a developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating a DC electrical potential difference between the mesh and the electrostatic toner transport means.

40. A process unit in which at least a latent image carrier for carrying a latent image in an image-forming device and developing means for developing a latent image on the latent image carrier are supported as a single unit by a shared support, wherein the developing means is a developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means; and potential difference generating means for creating a DC electrical potential difference between the counter electrode and the mesh.

41. A process unit in which at least a latent image carrier for carrying a latent image in an image-forming device and developing means for developing a latent image on the latent image carrier are supported as a single unit by a shared support, wherein the developing means is a developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating a DC electrical potential difference between the counter electrode and the mesh, and between the mesh and the electrostatic toner transport means.

42. An image-forming device comprising:

a latent image carrier for carrying a latent image; and developing means for developing the latent image on the latent image carrier; wherein the developing means is a developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating a DC electrical potential difference between the counter electrode and the mesh.

43. An image-forming device comprising:

a latent image carrier for carrying a latent image; and developing means for developing the latent image on the latent image carrier; wherein the developing means is a developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means; and potential difference generating means for creating a DC electrical potential difference between the mesh and the electrostatic toner transport means.

44. An image-forming device comprising:

a latent image carrier for carrying a latent image; and developing means for developing the latent image on the latent image carrier; wherein the developing means is a developing device for transporting toner residing on the surface of electrostatic toner transport means having a plurality of electrodes arranged at a prescribed pitch, provided to a toner transport device to a position that faces a latent image carrier while moving the toner by an electrostatic force, and developing the latent image carried on the latent image carrier, wherein the toner transport device comprises:

a mixture container for storing a mixture of toner and a friction-promoting substance;

a stirrer for stirring the mixture in the mixture container;

a mesh provided to the mixture container or to a connecting portion that is communicated therewith;

toner feeding means for sifting the toner in the mixture in the mixture container or the connecting portion through the mesh and feeding the toner to the electrostatic toner transport means;

a counter electrode that faces the mesh via the mixture in the mixture container or the connecting portion; and potential difference generating means for creating a DC electrical potential difference between the counter electrode and the mesh, and between the mesh and the electrostatic toner transport means.

45. A toner transport device provided with an electrostatic toner transport device comprising a plurality of electrodes arranged at a prescribed pitch, for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

a toner feeding device configured and positioned to sift the toner in the mixture in the mixture container or the connecting portion through the mesh and feed the toner to the electrostatic toner transport device;

a counter electrode that faces the mesh via the mixture in the mixture container or the connecting portion; and a potential difference generating device connected to create an electrical potential difference between the counter electrode and the mesh, wherein the electric potentials of the counter electrode and the mesh include a DC component.

46. A toner transport device provided with an electrostatic toner transport device having a plurality of electrodes arranged at a prescribed pitch, for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

a toner feeding device configured and positioned for sifting the toner in the mixture in the mixture container or the connecting portion through the mesh and feeding the toner to the electrostatic toner transport device; and a potential difference generating connected to generate an electrical potential difference between the mesh and the electrostatic toner transport device, wherein the electric potentials of the counter electrode and the electrostatic toner transport device include a DC component.

47. A toner transport device provided with an electrostatic toner transport device having a plurality of electrodes arranged at a prescribed pitch, for moving and transporting toner on a surface by an electrostatic force, comprising:

a mixture container for storing a mixture of toner and a friction-promoting substance;

a stirrer for stirring the mixture in the mixture container;

a mesh provided to the mixture container or to a connecting portion that is communicated therewith;

a toner feeding device configured and positioned for sifting the toner in the mixture in the mixture container or the connecting portion through the mesh and feeding the toner to the electrostatic toner transport device;

a counter electrode that faces the mesh via the mixture in the mixture container or the connecting portion; and a potential difference generating device connected for creating an electrical potential difference between the counter electrode and the mesh, and between the mesh and the electrostatic toner transport device, wherein the electric potentials of the counter electrode and the mesh include a DC component.

48. A toner transport method for moving and transporting toner on the surface of electrostatic toner transport device having a plurality of electrodes arranged at a prescribed pitch, by an electrostatic force, comprising the steps of:

sifting the toner through a mesh from a mixture of toner and a friction-promoting substance stored in a mixture container or in a connecting portion that is communicated therewith, and feeding the toner to the electrostatic toner transport device;

stirring the mixture in the mixture container; and creating a DC electrical potential difference between a mesh provided to the mixture container or the connecting portion and the electrostatic toner transport device.

49. A toner transport method for moving and transporting toner on the surface of electrostatic toner transport device having a plurality of electrodes arranged at a prescribed pitch, by an electrostatic force, comprising the steps of:

sifting the toner through a mesh from a mixture of toner and a friction-promoting substance stored in a mixture container or in a connecting portion that is communicated therewith, and feeding the toner to the electrostatic toner transport device;

stirring the mixture in the mixture container; and creating a DC electrical potential difference between a mesh provided to the mixture container or the connecting portion and the electrostatic toner transport device.

50. A toner transport method for moving and transporting toner on the surface of electrostatic toner transport device having a plurality of electrodes arranged at a prescribed pitch, by an electrostatic force, comprising the steps of:

sifting the toner through a mesh from a mixture of toner and a friction-promoting substance stored in a mixture container or in a connecting portion that is communicated therewith, and feeding the toner to the electrostatic toner transport device;

stirring the mixture in the mixture container;

creating an electrical potential difference between a mesh provided to the mixture container or the connecting portion and a counter electrode that faces the mesh via the mixture in the mixture container or connecting portion; and creating a DC electrical potential difference between the mesh and the electrostatic toner transport device.

51. An image forming method for forming an image, comprising:

a latent image formation step whereby a latent image is formed on a latent image carrier; and a development step whereby toner is moved on the surface of electrostatic toner transport device having a plurality of electrodes arranged at a prescribed pitch, by an electrostatic force, the toner is transported to a position that faces the latent image carrier, and the latent image is developed into a toner image;

a feeding step, whereby the toner is separated from the mixture of toner and the friction-promoting substance and fed to the electrostatic toner transport device, is carried out and also carries out:

a step of storing the mixture in the mixture container;

a step of stirring the mixture in the mixture container; and a step whereby a DC electrical potential difference is created between a mesh provided to the mixture container or to a connecting portion that communicates therewith and a counter electrode that faces the mesh via the mixture in the mixture container or the connecting portion, and between the mesh and the electrostatic toner transport device;

and wherein the toner in the mixture is sifted by the mesh and fed to the electrostatic toner transport device.

* * * * *